US011319802B2

(12) United States Patent
Andreychuk et al.

(10) Patent No.: US 11,319,802 B2
(45) Date of Patent: May 3, 2022

(54) DOWNHOLE OPERATIONS USING REMOTE OPERATED SLEEVES AND APPARATUS THEREFOR

(71) Applicant: KOBOLD CORPORATION, Calgary (CA)

(72) Inventors: Mark Andreychuk, Calgary (CA); Per Angman, Calgary (CA); Allan Petrella, Calgary (CA)

(73) Assignee: KOBOLD CORPORATION, Calgary (CA)

( * ) Notice: Subject to any disclaimer, the term of this patent is extended or adjusted under 35 U.S.C. 154(b) by 34 days.

(21) Appl. No.: 16/884,842

(22) Filed: May 27, 2020

(65) Prior Publication Data

US 2020/0284144 A1 Sep. 10, 2020

Related U.S. Application Data

(63) Continuation of application No. 15/752,164, filed as application No. PCT/CA2016/050974 on Aug. 19, 2016, now Pat. No. 10,704,383.

(60) Provisional application No. 62/250,628, filed on Nov. 4, 2015, provisional application No. 62/250,617, filed on Nov. 4, 2015, provisional application No. 62/207,855, filed on Aug. 20, 2015.

(51) Int. Cl.

| | |
|---|---|
| ***E21B 34/16*** | (2006.01) |
| ***E21B 34/14*** | (2006.01) |
| ***E21B 43/26*** | (2006.01) |
| ***E21B 47/12*** | (2012.01) |
| ***E21B 33/14*** | (2006.01) |
| ***E21B 43/12*** | (2006.01) |

(52) U.S. Cl.

CPC ..... *E21B 47/12* (2013.01); *E21B 33/14* (2013.01); *E21B 43/126* (2013.01); *E21B 43/26* (2013.01)

(58) Field of Classification Search

CPC ..... E21B 34/066; E21B 34/14; E21B 34/16; E21B 43/26

See application file for complete search history.

(56) References Cited

U.S. PATENT DOCUMENTS

| | | | | |
|---|---|---|---|---|
| 7,802,627 | B2 * | 9/2010 | Hofman | E21B 43/14 166/386 |
| 9,745,823 | B2 * | 8/2017 | Wood | E21B 34/06 |
| 9,759,061 | B2 * | 9/2017 | Lerner | G05D 7/0629 |
| 10,119,377 | B2 * | 11/2018 | Snider | E21B 34/16 |
| 10,221,656 | B2 * | 3/2019 | Barton | E21B 43/14 |

(Continued)

*Primary Examiner* — Kenneth L Thompson

(74) *Attorney, Agent, or Firm* — Parlee McLaws LLP; Patrick Laycock

(57) ABSTRACT

One or more remote-operated sleeve valves are placed along a tubular string downhole. The sleeves can be opened and closed wirelessly, and in embodiments over and over again. Differential pressure between wellbore fluid pressure and an accumulator chamber enable repeated shifting. Each sleeve can have a unique actuation code removing constraints regarding sequence of operation and need for well intervention to access the sleeves. Hydraulic fracturing can be achieved without wellbore obstructions, and other operations benefit for reduced expense in service rigs and the ability or selectively shut off problem zones. Remote signals received downhole include those generated by percussive and seismic, distinguishable from background noise including during pumping.

33 Claims, 36 Drawing Sheets

(56) References Cited

U.S. PATENT DOCUMENTS

| | | | | |
|---|---|---|---|---|
| 10,436,017 | B2 * | 10/2019 | Coss | E21B 47/06 |
| 10,704,383 | B2 * | 7/2020 | Andreychuk | E21B 33/14 |
| 11,035,203 | B2 * | 6/2021 | Merron | E21B 43/088 |

* cited by examiner

RO S STATUS

| | | | |
|---|---|---|---|
| SLEEVE 1 | CLOSE | OPEN | |
| SLEEVE 2 | CLOSE | OPEN | |
| SLEEVE 3 | CLOSE | OPEN | |
| SLEEVE 4 | CLOSE | OPEN | |
| SLEEVE 5 | CLOSE | OPEN | |
| SLEEVE 6 | CLOSE | OPEN | |
| SLEEVE 7 | CLOSE | OPEN | |
| SLEEVE 8 | OPEN | CLOSED | |
| SLEEVE 9 | CLOSE | OPEN | |
| SLEEVE 10 | CLOSE | OPEN | |

*FIG. 22C*

DOWNHOLE OPERATIONS USING REMOTE OPERATED SLEEVES AND APPARATUS THEREFOR

CROSS REFERENCE TO RELATED APPLICATIONS

This application is a continuation of U.S. application Ser. No. 15/752,164 filed Feb. 12, 2018 and issued as U.S. Pat. No. 10,704,383 as a 371 of International Application PCT/CA2016/050974 filed Aug. 19, 2016, which claims the benefit of U.S. Provisional Application 62/250,628 filed Nov. 4, 2015, U.S. Provisional Application 62/250,617 filed Nov. 4, 2015; and Provisional Application 62/207,855 filed Aug. 20, 2015, the entirety of each of which are incorporated fully herein by reference.

BACKGROUND

Controlling flow downhole in an oil and gas well is an established practice in the oil and gas industry. It is well known to run in shifting tools downhole to open and close sleeve valves installed deep within casing in the wellbore to control the flow of fluids to and from the wellbore and formation. Similarly, it is known to distribute steam along steam injection wells in Steam Assisted Gravity Drainage operations (SAGD), by pre-determining distribution, or manually shifting valves.

Common amongst these operations is a desire for flexibility in the timing and where to control such flows.

In hydraulic fracturing operations, described in more detail below, downhole tools, such as a bottom hole assembly (BHA), are typically run downhole on coiled tubing to control sleeves in a completion string of casing and can also be used to control stimulation fluids through open sleeves.

In hydrocarbon operations, plug-and-perforation (plug and perf) systems require wireline services/coiled tubing (CT) services to run in hole (RIH) a select-fire perforating gun with one or more bridge plugs so as to plug and perforate sections of cased horizontal wells for subsequent stimulation operations such as hydraulic fracturing. This is a time consuming process, oft-times requiring the alternate suspension of a frac operation of a previous perforation to move uphole and perforate subsequent sections of the well. This process is then repeated for the number of stimulations desired for the horizontal wellbore. After all the stages have been completed, coiled tubing is typically RIH and used to drillout the plugs for establishing access to the toe of the wellbore. The residual, open perforations cannot be easily blocked off thereafter. Further, the initial operation of pumping the bridge plug and the perforating guns downhole against a closed lower end, bottom of the well or lower plug, particularly in horizontal completions, can be impeded by trapped fluid and pressure buildup therebelow, particularly for the first stage at the end of the well. Sometimes a costly separate first wireline trip is required to perforate the first, end stage.

Similarly, other downhole operations requiring a BHA run downhole to the bottom of the well can similarly face RIH resistance by trapped fluid below. Particularly challenging are first stage operations, lacking fluid release therebelow. Toe subs are known for relieving trapped fluid at least one time at the end of the well. Also characteristic of plug and perf operations, casing integrity pressure testing is often conducted before operations, requiring initial blockage of the cased wellbore below the test. Pressure actuated tools are available, such as the PosiFrac Toe Sleeve™, to TAM International, to enable closing of the wellbore below the sleeve for high-pressure testing thereabove without opening during the test, yet later can opened for frac operations without a need to overpressure above testing pressures. The apparatus and methodology is involved and can require staged pressure sequences, shear devices and internal metering to enable initial testing in a closed state and subsequent conversion to an open stage. Other methodology uses a plurality pf burst ports, which must accept varied pressure for actuation, sometimes at greater pressures than testing pressures, and once actuated, the reliability and volumetric flow capability being dependent upon a tricky and simultaneous opening of all ports rather than bursting of just a first port.

Turning to control of flow along a wellbore, such as hydraulic fracturing, common completion systems to open and close sleeves have used coiled tubing fit with shifting tools and dropped actuating objects such as balls. Ball drops are typically limited to a uni-direction action—usually to open sleeves in a downhole direction. Conveyed shifting tools such as those conveyed with coiled tubing are now being configured for both opening and closing of sleeves. The conveyed tools also incorporate fluid delivery systems for providing sealing and stimulation fluids, including hydraulic fracturing fluids. Wellbore access, such as with coil tubing has been, to date, a conventional and necessary expense to sleeve operations.

The sleeves themselves are often internal cylindrical sleeves having an internal profile for engagement with a like shifting tool, or an internal piston-like sleeve operated using differential pressure created by pressuring up the entire string above a packer. While those sleeves engaged by a shifting tool are being configured for more and more for shifting open and shifting closed, they are characterized by the need for a bore-restricting conveyance coiled tubing, and the infrastructure, time and expense for running the shifting tool in and out of the wellbore.

In one alternative methodology, and avoiding conveyance tubing, sleeves can be opened or closed from surface with umbilical hydraulic lines attached on the exterior of the casing and run to surface from every sleeve. The hydraulic lines are attached to a hydraulic pump/control system and they can be pumped opened or closed. Each sleeve has its control line or lines, depending on design. The fundamental problem with umbilical hydraulic line controlled sleeves is installation logistics. The cost to install the umbilical lines into a well without damaging them is also a hindrance. As horizontal wells get longer and longer the number of stages increases and after a certain point the number of umbilical control lines required to control every stage becomes too unwieldy to be practical.

In another sleeve technology, such as that disclosed in U.S. Pat. No. 9,359,859 to Metrol Technology Limited (Aberdeenshire GB), a safety valve is remotely actuated to block all flow up a production well, such as in a blowout situation. Directed to offshore scenario's, a signal is directed to tools in the production string, either though the sonar or other wireless signals. The signals are intended to be short distance transmissions, including by located a remote operated vehicle (ROV) in close proximity to the tool, or using some other wireless waveform in the 1-10 HZ range. Noise reduction is discussed for disseminating the useful signal from the background. This technology seems limited to offshore and closely spaced transmitters and receivers.

Opening and closing of sleeves has many advantages including but not limited to conventional access to the wellbore for fracing operations, for strategic closing of sleeves after fracing for wellbore healing and to mitigate flow back problems, to perform staged production testing and zonal flow control such as to block flooding.

In another aspect discussed herein, zonal flow control can be dependent upon knowledge of the flow, not from the well as a whole, but from zones or from sleeves themselves.

In another aspect, flow control into the well may be useful where incursion of water into a wellbore at a particular zone, such as from a naturally occurring aquifer or a high permeability channel, affects oil production therein. Intervention to close a sleeve valve can be taken once the zone through which the water is entering the well has been identified.

Controlling flow is also typically utilized in an effort to maximize hydrocarbon production from a particular well, stage or group of wells in a field. Reservoir flooding, using water or $CO_2$, is one established example of techniques for maximizing hydrocarbon production using a group of wells which are fluidly connected through the reservoir. Some of the wells are used as injector wells, while other of the wells are used as production wells. The fluid, typically water or gas, is injected into the injector wells to increase reservoir energy and to sweep oil towards the production wells through which the oil is recovered. Often, maximizing reservoir flooding capability is more economical than drilling or fracturing new or existing wells.

Determination of flow patterns in the wells or groups of wells, with the objective of maximizing oil production, is conventionally determined by:

- production logging a well, wherein production logging tools are run-in-hole (RIH) on the end of coiled tubing, jointed tubing or wireline for measuring, for example, rate of flow and/or whether the fluid flowing is gas, liquid, hydrocarbon, water, etc.;
- injection of chemical or radioactive tracers with subsequent detection to determine where the tracers exit the particular well or group of wells; and
- permanent installation of fiber optic or other sensors on the outside or the inside of the casing, with or without sleeve control lines for each sleeve valve in the casing.

Temporary fiber optic lines can be run on wireline or coiled tubing. For example, they can be used to measure well temperature to infer inflow from various stages. Currently, the industry is predominantly using hard line fiber optic systems, where the fiber optic line is run on the exterior or interior of a casing/liner string to measure temperature and vibration at every injection point or stage in a well to infer flow. Measurement and recording of vibration and temperature over time, as well as monitoring of production changes at surface, for example an oil well in which water production increases over time, allows an operator to make judgements and decisions regarding which stage or stages are involved in the increase in water production so that an appropriate intervention can be taken. This is especially the case when the field application is a reservoir flooding application utilizing both injector wells and producing wells.

The challenge presented by conventional methods of flow detection is that, in most cases, the well must be taken off production and intervention is required, which is costly. Further, using permanently installed conventional detection and control systems is costly and logistically complicated. For example, installation of such systems is often hampered by the lack of annular space between production equipment and casing.

There is interest in the industry to develop hardware to aid in flow control, such as the injection and production of fluids from injection and/or producing wells. Further, the industry seeks to retrieve information from within the well in either a memory mode or on a real time basis from each stage or sleeve, to obtain intelligence regarding the type of fluids flowing and the location of the flow. There is great interest in retrieval of information without the need for a separate intervention to retrieve the information from the wellbore. Alternatively, there is interest in retrieval of information stored in the wellbore in memory mode at the same time as there is a need for an intervention for other reasons, such as when the existing flow is to be modified.

SUMMARY

Remote Operated Sleeve

Herein, one or more individual ported sleeve valves or remote-operated sleeve valves are provided. Remote operated sleeve valves are also simply referred to as RO Sleeves herein. Looking forward, to applications as shown in FIGS. 21A, 21B and 28, one or more RO sleeves are located at the end of, or along, a tubular string traversing a wellbore. The tubular string may or may not be cemented in the wellbore.

The RO Sleeves can be opened and closed without a need for a separate actuation tool. The RO sleeves are coded with a unique code for enabling targeted remote operation. Using remote and wireless communication for actuation, the RO Sleeves eliminate the need for object drop technologies, hydraulic umbilicals, wireline, pressure manipulation and expensive and time consuming entry and re-entry with coiled tubing conveyed tools. The RO Sleeves enable control of fluid communication from the bore of the tubular string, and through the wall of the tubular string, to the wellbore annulus outside the string, such as to the formation. As neither wireline nor CT is required to actuate said RO sleeves, the bore of the tubular string is unimpeded by shifting apparatus.

In embodiments disclosed herein, one or more RO Sleeves and in hydraulic fracturing operations, a plurality of sleeves, are disposed in a wellbore. The RO Sleeves are disposed at the end of, or along, a string of well tubulars such as a casing completion string a production string or an injection string. One or more of the sleeves are fit with means for remote operation. Thus, without tool actuation apparatus impeding the bore of the well, one can selectively choose to open and close RO Sleeves such as through wireless communication from surface. Communication can include remote means such as electronic including RFID or wireless, acoustic including seismic, or fluid pressure pulse transmission. In basic implementation, the communication need only provide an open and close signal, achieving a threshold suitable to be distinguishable at the sleeve for actuation, such a binary communication being substantially impervious to noise, and thus false positives and unintended actuation. Optionally, the signal can include a code, for unique actuation of a corresponding and unique RO Sleeve of a plurality of sleeves. Again, the signal can be binary or rendered as binary to avoid noise considerations.

Each RO Sleeve can be equipped with a power source, a signal receiver and an actuating device for opening or closing or both opening and closing a sleeve. A signal transmitted from surface is received by the sleeve and triggers the actuating device for opening or closing the sleeve. The sleeve can be single use or multi-use.

In an embodiment, each RO sleeve comprises a tubular housing connected to a well tubular such as at the end of or intermediate a tubular string. Each tubular housing for an RO Sleeve is fit with an internal, hydraulic-actuated sleeve that is movable axially back and forth to alternately close and open ports in the tubular housing, for fluid communication through the housing, such as between a tubular bore and an annulus between the casing and the wellbore. The sleeve forms a valve chamber between the tubular housing and the sleeve.

In an embodiment, the sleeve is hydraulically actuable from the axial ends of the sleeve, and in another embodiment, the sleeve is fit with an annular shoulder thereabout that is sealable along the valve chamber forming a bi-directional piston. The internal, hydraulic-actuated sleeve is a bi-directional sleeve, having a downhole actuation chamber on the uphole side of the piston and an uphole actuation chamber on the downhole side of the piston.

The uphole and downhole actuation chambers are in communication with an actuating valve. The valve is fluidly interposed between the tubular bore (a source of pressure) and one side of the bi-directional valve chamber. Another valve or the same valve, is also fluidly interposed between a dump chamber (an accumulator) and the opposing or second side of the bi-directional sleeve chamber sleeve chamber. The valve alternates between driving and dumping each side as it moves back and forth. As known in hydraulic ram technology, a two position hydraulic valve can simultaneously communicate to both sides of the piston for opposing fluid functions, one to drive the piston, the other to received displaced dump fluid.

Upon receipt of a triggering signal the valve is actuated to establish a driving pressure between the one side of the sleeve chamber and the bore for opening or closing the sleeve depending on the hydraulic coupling arrangement. The other side, also connected through the valve, dumps previous or spent driving fluid to the accumulator. Shifting of the two position valve, or coordinated actuation of two separate valves, the process can be operated in reverse to close or open the sleeve, opposite in actuation to the prior actuation. The accumulator is preferably at a sufficient pressure differential, and having sufficient volume, for multiple operations before the accumulator pressure differential falls before useful levels. In an embodiment, the accumulator is initially at atmospheric pressure Communication As stated, communication of a signal from surface to actuate the RO Sleeve enables operation free of shifting tools, wired or hydraulic connection to surface. Such wireless communication includes signals embedded in electronic, acoustic (herein, the term acoustic is used generally to include seismic body waves both P- and S-waves), or fluid pressure pulse transmission. The communication signal transmitted from surface is received by the sleeve and triggers the actuating device for opening or closing the sleeve.

It is known in the art, as taught in U.S. Pat. No. 9,284,834 to Schlumberger to provide electronic communication from deep in a well to surface or between locations in the well. Information including downhole temperature, pressure, fluid flow, and viscosity may be obtained by memory tools downhole, in which information and data from the tools and assembly may be recovered later after the tools have been retrieved back at the surface. However, if the recorded data is corrupt or insufficient, such a failure may not be apparent until after the tools have been retrieved back at the surface. Further, other testing methods such as running a cable from the surface to the data recording tools are troublesome in that it could obstruct fluid flow and be easily damaged. Electromagnetic or acoustic wireless signals may be used for shorter range applications, such as transferring data within and between adjacent downhole tools, commonly referred to as the "short hop section" and longer range applications, such as transferring data between the downhole tools and the surface are commonly referred to as the "long hop section." For long distances, a long hop section may be used to receive the data signals from the short hop section and re-transmit the signals at a higher level and/or higher power. Further, for long distances, such as to surface, repeaters may be used to provide communication between the short hop sections and the long hop sections.

Such systems are complex, and intended to manage comprehensive data to effect, control or modify operations or parameters. A multiplicity of components are required, any of which are subject to failure.

Instead, using embodiments disclosed herein, effective communication between the surface and the RO Sleeve can be achieved at a very low baud rate. Simply, the RO Sleeve need only know it has received signal to actuate. Further, a low transmission rate, as low as one bit per second, is sufficient to be distinguishable as an actuation signal yet is noise tolerant and can represent more than a billion possible unique codes to actuate a specific RO Sleeve. Herein, an amplitude of whatever signal is transmitted is sufficient to exceed a threshold during a pre-defined window length. Applicant has determined that an acoustic signal, such as that from a hammer blow at the wellhead at the surface, is easily detectable at a downhole sleeve, above the background noise, and detectable even at the toe of a horizontal well, often some 2500 metres away.

RO Sleeves can be coded with identities for targeted operation, individual operation or in a sequence, or many sleeves en mass. Coding could be specific for opening and closing each sleeve individually in each well of a specific field. In more detail, the solution provided herein, provides one or more RO Sleeves that eliminate umbilical lines to activate sleeves between open and closed positions. Each RO Sleeve, having a receiver powered by a battery, receives communications from surface. There need not be return communication to surface from the RO Sleeve. A signal is sent from surface to the RO Sleeve and the sleeve is actuated to either open or close.

The signal can be sent from surface, such as via mud pulse, electromagnetic, acoustic, vibration, radio frequency, or conveyed trigger such as an RFID, to trigger a particular sleeve. The RO Sleeve has a receiver that decodes the transmitted signal for that specific sleeve and the sleeve reacts to the command to open or close. Further, the energy of the opening or closing of the RO Sleeve can be detected at surface such as through wellhead vibration, through acoustics or fluid transmission or through pressure response of a well.

Applications

In embodiments disclosed herein, use of even a single RO Sleeve can provide additional functionality to completion and stimulation operations, and significantly improve operability of existing well operations including ball drop, plug and perf, and SAGD operations and facilitating running in of measurement tools.

Illustrative of the breadth of the embodiments disclosed herein, use of one or more RO Sleeves provides functionality that includes operations at end-of-well fluid management and for fluid control along the wellbore.

For facilitating running in of downhole tools, an RO-Sleeve provides dependable and controllable fluid management at the toe. For other fluid control operations including stimulation operations such as hydraulic fracturing, a plurality of RO Sleeves provides locational control of fluid flow to and from the wellbore.

In one aspect, regarding the traversing of a wellbore with a downhole tool, particularly into a closed well, approaching the end thereof and even below an end-most stage, an RO Sleeve can provide a controlled fluid path to relieve fluid resistance a required on run in. As discussed above, most tubular strings, through which downhole apparatus are introduced, typically use an activation sub. Such activation subs are connected to the lower end of the casing string, or on the running tool itself, and are used to provide an open fluid flow path while running tools into the hole, avoiding downhole fluid resistance to tool movement. Thereafter, the activation sub is actuated to close the flow path such as to set a packer, or perform other pressure operations. With existing technology, the activation sub is actuated with a ball drop, or pressure actuation, both of which can be limiting with regards to reliability, timeliness and repeatability.

As disclosed herein, in contradistinction, an RO Sleeve can be actuated just once or multiple times and reliability actuated when required, not subject to the whim of a prior sequence of pressure conditions. As a result, for example, plug and perf operations can be more reliably and readily facilitated by opening an RO Sleeve on demand and closing it thereafter. Further, downhole tools can be run in to wells fit with an RO Sleeve for wellbores no otherwise fit with fluid relief or other activation subs on the casing string.

Applied to completion strings, a plurality of RO Sleeves distributed therealong, provide zonal access and can result in controlled fluid access for repeated opening and closing, as desired, using accumulator embodiments.

Remote Operated Sleeve Operations

Remotely opening and closing sleeves is advantageous for operation on demand without the need for well access or involved pressure sequence operations.

In one aspect, an RO Sleeve at the end of a completion string provides a new arrangement and apparatus for fluid release and end zone access and wellbore access.

Improved over multiple access and sleeve shifting by a coiled tubing conveyed tool, a well completion which comprises many RO Sleeves, could be opened and closed to improve the treatment process. The RO Sleeve can be opened as to allow a usual frac treatment to be injected into the formation. However, also and immediately after the frac, the RO Sleeve could be closed to allow the frac to heal. This can be important in areas where the frac sand for example would otherwise flow back into the well immediately after the frac treatment if the sleeve was not closed or pressure on the well was not maintained allowing a flow back into a well. With an RO Sleeve, this avoid yet another trip with a shifting tool.

In another methodology, one or more RO Sleeves could be opened one at a time with the remaining sleeves closed to production test many or every stage of the well individually. The permits a significant improvement over the prior art in which testing of a well on production only demonstrates commingled production of the stages is monitored. Now production from individual stages is readily available. Prior art production logging tools and isolation tools are available in the industry to measure or isolate flow at every stage to measure, but the economics is generally not attractive. Flowing every stage individually, while not necessary cumulatively equivalent to any changes in flow when all stages are commingled, it is yet another methodology for determining a relative production from every stage.

RO Sleeves, capable of multiple open and close cycles enable improvements in design of new wells and operation throughout the life of a well. In a new well, only sections of the well can be stimulated and produced. Later in the life of the well, more stages can be opened, and old ones that are now productive or water-bearing can be closed. During stimulation, RO Sleeves could be sequenced open or closed from surface in a way to allow frac pumping to continue from one stage to the next stage, unlike coiled tubing where pumping has to stop between stages. As described above, if sleeves can be opened or closed from surface, on a stage by stage basis, as is the case with RO Sleeves, then recorded flow data at every stage may or may not be required if actual per stage flow data can be recorded at surface. The recorded flow data could also be used as additional data compared to actual per stage flow data. Flow data could be retrieved at a later date via a data receiving tool on a specific CT run or via a communication system directly to surface.

In embodiments, both detection and control of problem wellbores is possible. Opening and closing RO Sleeves can control water, CO2 or chemical flooding of a reservoir over the life cycle of a producer or injector well in a field.

In SAGD operations, RO Sleeve equipped individual steam valves enable steam mass flow management and distribution along a steam injection.

In the prior art, conventional sleeves are typically actuated using coiled tubing. Among the challenges faced by the prior art actuation include the expense and limitations on the horizontal extent to which the coiled tubing can reach sleeves. Conventional coiled tubing can only travel so far horizontally before it locks up. In response, the size and length of the coiled tubing required for very deep wells is problematic and expensive to logistically manage at surface. Further the mere presence of coiled tubing in the bore of the string restricts the rate a frac can be pumped into a well during treatment, restricted if the CT bore is small and used for fluid delivery, and restricted if the CT cross-sections consumes a portion of the bore of the completions string.

Simply, eliminating the coiled tubing provides the operator more flexibility in the design of fluid treatment, management and testing operations, improvements in the length of strings and wellbores, and all at reduced expense.

As introduced above, individual RO Sleeves are remotely operated without re-entry with coiled tubing, without hydraulic umbilicals and without object drop technologies.

In embodiments disclosed herein, one or more sleeves and preferably a plurality of sleeves in a well are fit with means for remote operation. Thus, without impeding the bore of the well, one can selectively choose to open and close RO Sleeves such as through communication from surface. Each RO Sleeve has a power source and a receiving actuating device for opening or closing or both opening and closing a sleeve. A signal transmitted from surface actuates the sleeve.

In methodology embodiments, sleeves can be coded with identities for targeted operation, individual operation or in a sequence, or many sleeves en masse. Coding would be specific for opening and closing each sleeve individually in each well of a specific field.

In embodiments, a remote operated sleeve valve for downhole operations is provided comprising a tubular housing having a bore and one or more ports between the bore and an annulus thereout; a sleeve in the bore and forming an annular and bi-directional hydraulic valve chamber between the sleeve and the housing, the sleeve movable axially back and forth for alternately opening and closing the ports; and one or more actuating valves for fluid communication with the annular valve chamber for alternating driving the sleeve axially to open and close the ports.

The sleeve valve's annular valve chamber and sleeve form a bi-directional hydraulic sleeve and the one or more actuating valves is a two position hydraulic actuating valve.

In an embodiment, the sleeve has an annular shoulder intermediate is axial length, acting as a piston, for separating the annular valve chamber into uphole and downhole chambers, each chamber alternating as a driving and a dumping chamber. Alternatively, the remote operated sleeve valve wherein the sleeve as the piston for separating the annular valve chamber into uphole and downhole chambers, each chamber alternating as a driving and a dumping chamber.

The remote operated sleeve valve wherein the remote operated sleeve has an annular shoulder intermediate its axial length for separating the annular valve chamber into uphole and downhole chambers, the one or more valves fluidly connecting one of the uphole/downhole actuation chambers to the housing bore to fluidly drive the sleeve and the other of the downhole/uphole actuation chamber with a dump chamber to receive spent fluid, the one or more valves alternating between driving and dumping each actuation chamber as the sleeve moves one or more valves is a two position hydraulic actuation valve.

In an embodiment, the driving and dump chambers have a volume relationship suitable for receiving the dump fluid generated from multiple actuations in accordance with Boyles Law. In an embodiment, the driving pressure is generated from the fluid in the bore and differential pressure is relative to the dump chamber initially at atmospheric pressure.

The remotely operated sleeve further comprises hydraulic isolation cylinder and floating piston between the fluid in the bore of sleeve valve clean fluid in fluid communication with the driving chamber.

The remotely operated sleeve further comprises a valve actuator for operating the one or more valves and a receiver operatively coupled thereto to the actuator, the receiver responsive to receive a signal for actuating the sleeve.

The receiver or valve actuator or both are electrically powered and further comprise a downhole battery. The receiver further comprises a watchdog between the battery and electrically powered components. The watchdog further comprises a piezo-electric trigger for receiving and generating a wake up signal for powering the electrically powered components from the battery. The watchdog further comprises a clock for determining window during which the watchdog receives a wake up signal for powering the electrically powered components from the battery.

In embodiments, the remote operated sleeve valve receives an open or a closed actuation signal from surface. The signal is wireless and without fluid lines. In an embodiment, the signal is transmitted from surface along the wellbore for receipt by the remote operated sleeve, including through acoustic or pressure signals. In another embodiment, the signal is transmitted from surface through the intervening subterranean medium for receipt by the remote operated sleeve including electronic or seismic. The actuation signal further comprises a signal having an amplitude wherein, amplitudes above a threshold are indicative of an actuation signal. The actuation signal conveying a unique code signal further comprises a unique series of signal amplitudes above the threshold. The actuation signal wherein the series of signal amplitudes are transmitted at a baud rate of less than about 10 per sec. The actuation signal wherein the series of signal amplitudes are transmitted at a baud rate of about 1 per sec.

In other embodiments, a system for remotely managing the fluid flow in a wellbore comprises:

one or more remote operated sleeve valves located along a tubular string in the wellbore and forming an annulus therebetween, each of the remote operated sleeve valves having a tubular housing and a bore in fluid communication through one or more ports to the annulus, the sleeve being bi-directional and hydraulically actuable to open the ports in one direction and hydraulically actuable to close the ports in the other direction, spend drive fluid being dumped into a dump reservoir; and a signal transmitter for generating wireless signals and a signal receiver at a sleeve for actuating the bi-directional sleeve.

The system above further wherein the one or more sleeve valves is at least one sleeve valve located at a distal end of the tubular string adjacent the end of the wellbore.

The system wherein the at least one sleeve valve located adjacent the end of the wellbore is remotely operable to open to the annulus during running in of a tool to the normally closed end of the well. The system wherein the tool is selected from the group consisting of a plug and perf tool, measurement tool, frac imaging tool, conventional CT conveyed sleeve shifting tool.

The system above further wherein the one or more sleeve valves is a plurality of remote operated sleeve valves located along the tubular string, each of which is independently remotely operable between open and closed positions, for selectable communication with the annulus and the wellbore.

A method for hydraulically fracturing a wellbore comprising: placing the plurality of remote operated sleeve valves along the wellbore; selecting a zone for treatment; closing the tubular string above and below the zone; remotely opening one or more of the sleeve valves at the zone; and supplying fracturing fluids to the wellbore through the open sleeve valves.

The hydraulic fracturing methodology further comprising running in a fracturing tool to the zone to be treated, the fracturing tool comprising a resettable packer and a blast joint, sealing the resettable packer to the tubular string to isolate the balance of the tubular string and remotely opening one or more of the sleeve valves at the zone; and supplying fracturing fluids to the wellbore through the open sleeve valves.

The hydraulic fracturing methodology further comprising closing the open sleeve valves just used during the fracturing to heal the formation.

BRIEF DESCRIPTION OF DRAWINGS

FIG. 22C is a screen shot of a smartphone used by a technician to select the open/closed status of RO Sleeves, in this embodiment to shut off sleeve 8 due to water ingress noted at said sleeve 8 during production according to FIG. 22B;

DETAILED DESCRIPTION OF THE EMBODIMENTS

Figure 1:
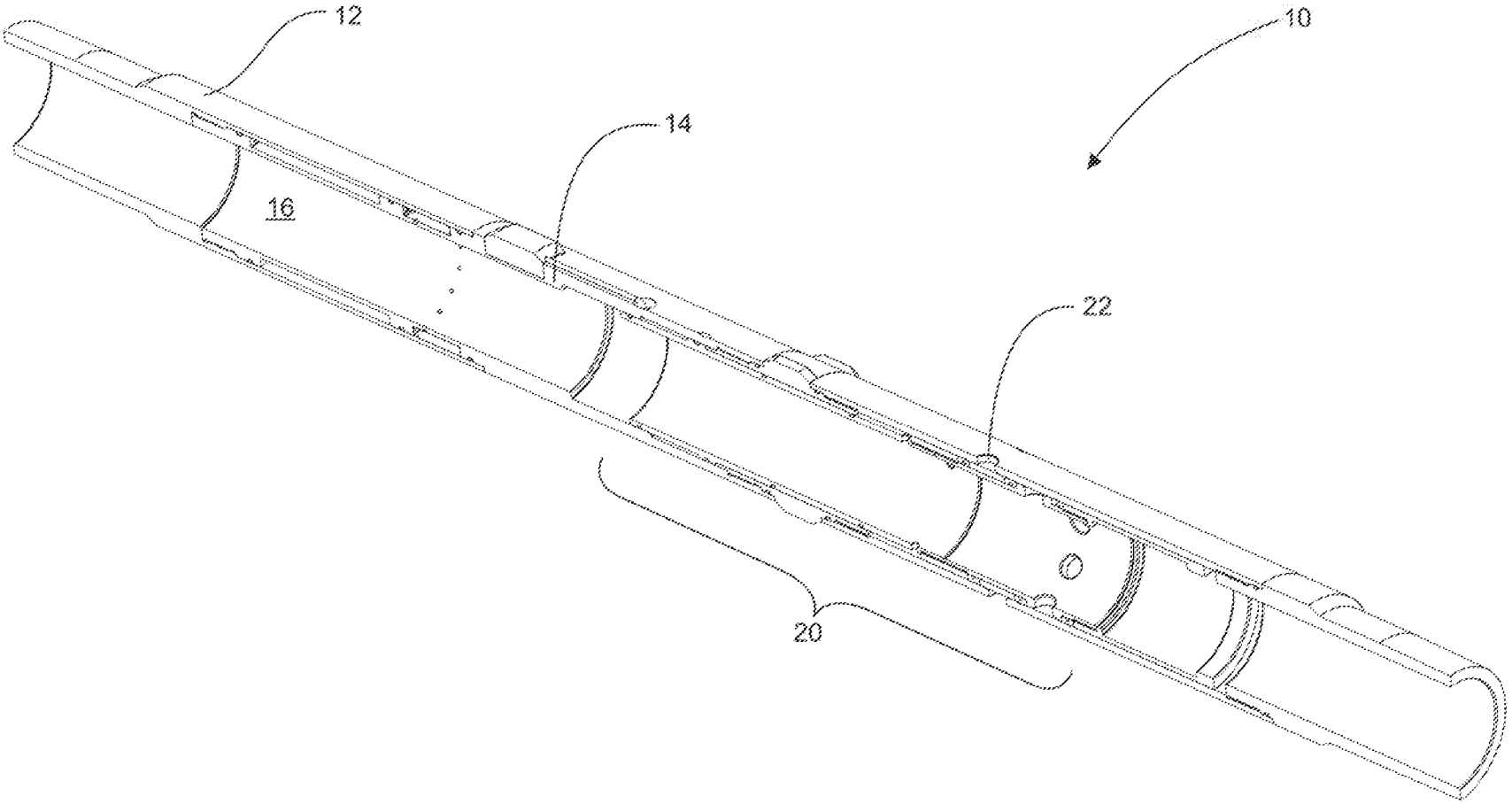
FIG. 1 is a perspective view of a remote operated sleeve valve according to one embodiment.

In more detail, the solution provided herein to eliminating coiled tubing and umbilical lines is to actuate sleeves valves between open and closed positions using Remote Operated Control Sleeves (ROCS) or simply RO Sleeves. The sleeve operation can be pressure-actuated or powered by battery, either of which can receive at least open close communications from surface. Herein, RO Sleeves and RO Sleeve valves are used interchangeably except where specific context suggests otherwise, for example for moving of the "sleeve" in the housing of the "sleeve valve". A signal is sent from surface to the RO Sleeve and the sleeve is actuated to either open or close. There need not be return communication to surface by the RO Sleeve. Other indicators are available for establishing the successful actuation of the sleeve.

The signal can be sent from surface, such as via mud pulse, electromagnetic, acoustic, vibration, radio frequency, or conveyed trigger such as an RFID, to trigger a particular sleeve. The signal can be uniquely coded to correspond to a specific sleeve. The RO Sleeve has a receiver that decodes the signal for that specific sleeve and the sleeve reacts to the command to open or close. The energy of opening or closing can be detected at surface such as through wellhead vibration, through acoustics, fluid transmission or through pressure response of a well. Optionally, at the some added energy cost, the RO Sleeve can also have a transmitter that can send confirmation of the sleeve open or closed position to surface or as part of other sleeve status information, instrumentation data bursts or flow parameters as discussed below. In embodiments, Applicant can include a piezoelectric device for charging onboard batteries using various pressure or direct mechanical impetus in operation, available in abundance in frac and other downhole operations.

A transmitter that sends data uphole can also send confirmation of the sleeve open or closed action position to surface. Alternatively, an accelerometer could be mounted at surface on the wellhead to detect the shifting of the sleeve open or closed eliminating the need of a two way communication system for sending confirmation message from downhole to surface. Vibration signals (as amplitude/time, vibration, seismic or similar thereto) in code are sent from surface to a particular sleeve. The sleeve detect its corresponding unique code in the signal and activates an electric/mechanical activation system to allow the sleeve to open or close. Detecting the activation could be achieved, if required, by a stand-alone system, such as accelerometers, installed at the wellhead. The electrical/mechanical activation system could be one of many designs, where the sleeve is opened entirely electrically like a solenoid or electric mechanical drive, or a pilot system could be used where precharged pressure or wellbore pressure is used to physically shift the sleeve open or closed.

Sleeve instrumentation can also include the flow information transmitted to surface without the intervention of coiled tubing to download the flow data from the sleeve and Frac Imaging Module (FIM) (such as a microseismic sensor) bottom hole assembly (BHA), or otherwise collected by a data collection device run at the end of coiled tubing.

Sleeves can be sequenced open and closed from surface in a way to allow frac pumping to continue from one stage, not necessarily adjacent stages, to the next. This would be similar to ball drop systems however without the associated disadvantage of a pre-defined sequence of balls or the ball seats later impeding the wellbore.

Many advantages of RO Sleeves prevail over ball drop sleeves including the sleeves can be both opened are closed; there is no or little restriction of the wellbore, there are no post-operation interfering balls or ball seats and if a stage screens out during a fracturing operation, other stages can be opened to displace the screenout, and as described above, in a new well, only selected sections of a well can be stimulated and produced. Later in the life of the well, more stages can be opened, and old ones that are now productive or water-bearing can be closed.

RO Sleeves can be sequenced open or closed from surface in a way to allow frac pumping to continue from one stage to the next stage, unlike coiled tubing where fluid pumping needs to be stopped between stages.

As described above, as the sleeves can be opened or closed from surface, on a stage by stage basis, then recorded flow data at every stage may or may not be required as actual per stage flow data can be recorded at surface. The recorded flow data could also be used as additional data compared to actual per stage flow data. Flow data could be retrieved via a data receiving tool on CT or via a communication system directly to surface.

Remote operation to open and close sleeves, controlled from surface, can now be used without coiled tubing or umbilical's including to open a sleeve for a frac and close it after a frac to allow the frac to heal; for production testing of the frac on a stage by stage basis; and for stage control during or after field flood, including water, CO2, and chemical situations.

Use of the RO Sleeve results in use of full bore or near full bore tubular string, liner or casing internal diameter. Further, there are now few flow or access restrictions including, for example, no interfering conveyance CT, and no ball seats to mill out or dissolve like in plug and perf completion systems. Further, there is no need for open hole packers such as those required in "ball drop" systems. For clients who want open hole packers versus pinpoint cemented systems, these RO Sleeves could be used in place of the traditional ball drop sleeves. Clearly, remote operations are not restricted to cemented liners. In other operations, use of the RO Sleeves no longer require wire line operations as currently required in "plug and perf" systems, and no coiled tubing is required as is the case with conventional coiled tubing systems.

The RO Sleeves are actuated at the sleeve by sleeve-borne components and thus, theoretically, the sleeve need only be as long as needed to alternately cover flow ports and shift clear of the port. As ports are arranged circumferentially, the sleeve length need only be about twice the port diameter plus an additional length at each end to accommodate seals.

In an embodiment having a hydraulic actuated sleeve, incorporated in an annular sleeve chamber, a valve is interposed between the bore and the sleeve chamber. Upon receipt of a triggering signal the valve to establish communication between the sleeve annulus and the bore for opening or closing the sleeve depending on the hydraulic coupling arrangement. Depending on the mode of triggering the valve could be directly actuated, such as by fluid pressure, or could be pilot-actuated. Alternate actuation apparatus including solenoids or drives utilizing higher power and more robust batteries.

RO Sleeve Valves or RO Sleeves

With reference to FIGS. 1 through 6B, in one embodiment and as introduced above, an RO Sleeve 10 comprises a tubular housing 12 having a cylindrical wall 14 and an axial bore 16 therethrough. The tubular housing is connected at a downhole end or intermediate a tubular string, such as a casing string (conventional, not shown). The tubular string or casing string extends to surface, perhaps through intermediate and surface casing, all of which is deemed the tubular string or casing string. The axial bore of the tubular housing is fluidly contiguous with the tubular string.

Figure 2:
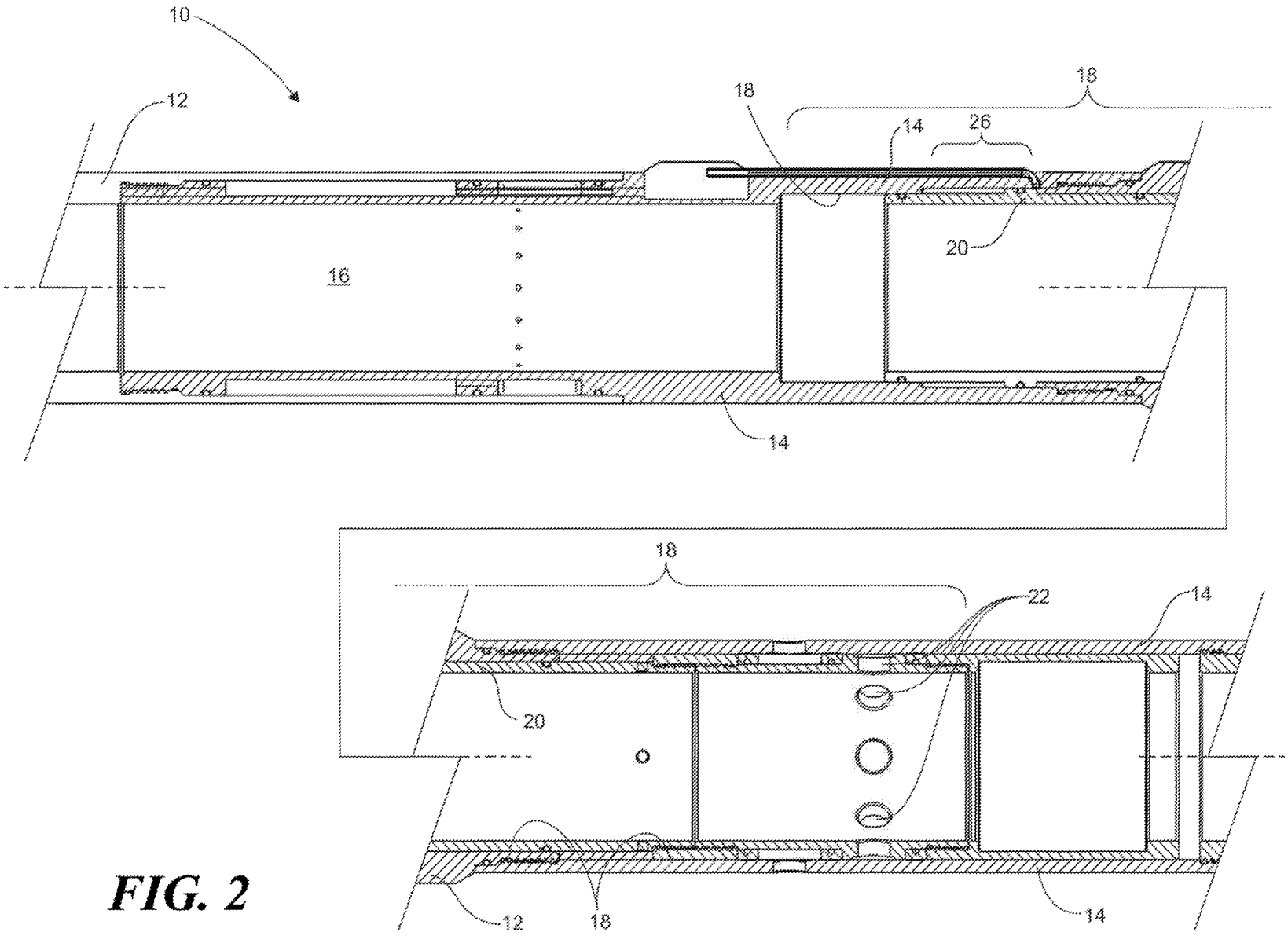
FIG. 2 is a side, cross-sectional view of the sleeve valve of FIG. 1.
Figure 3A:
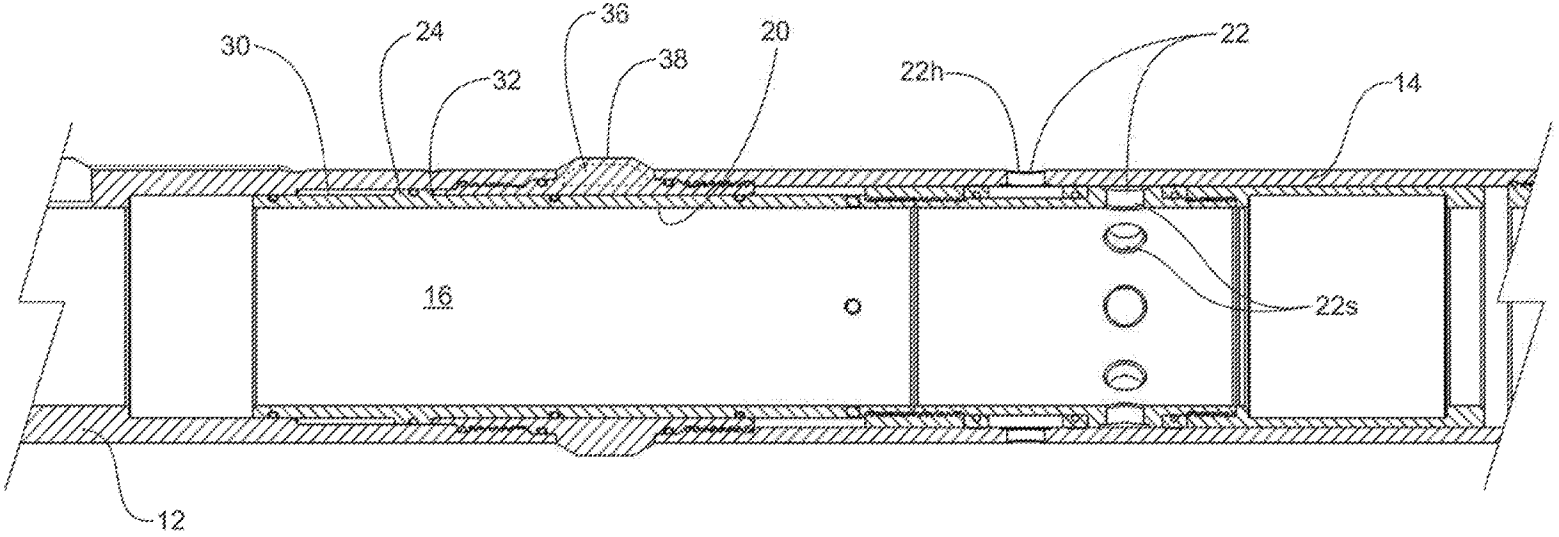
FIG. 3A is a cross-sectional view of the sleeve valve of FIG. 2 with the sleeve in the closed position.
Figure 3B:
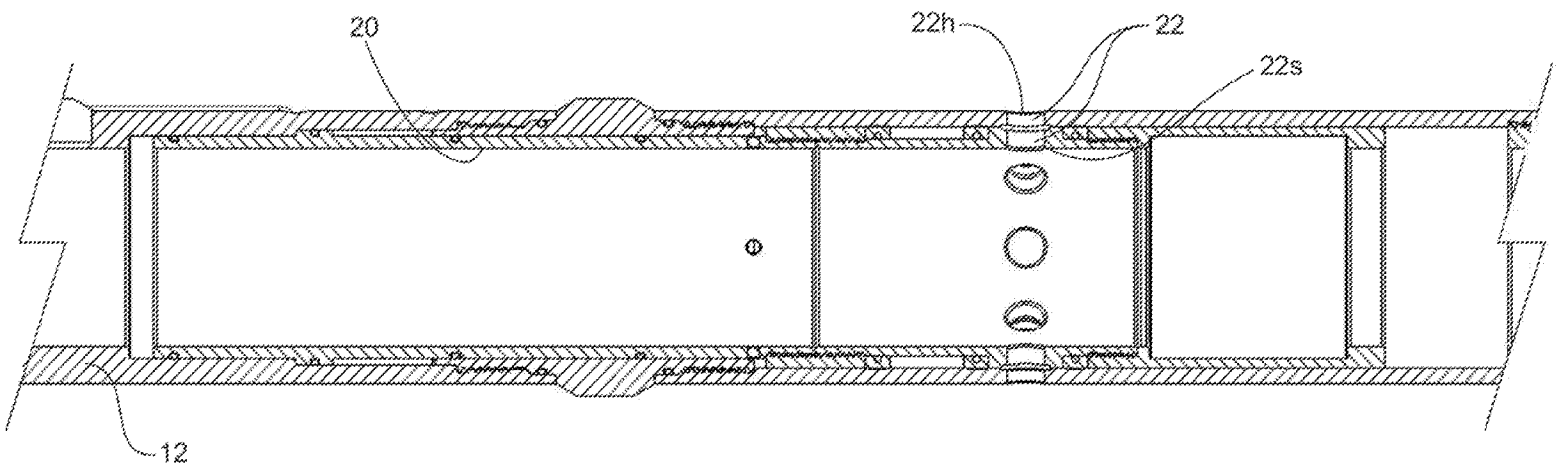
FIG. 3B is a cross-sectional view of the sleeve valve of FIG. 2 with the sleeve in the open position.

Best seen in FIG. 2, the tubular housing 12 supports a cylindrical sleeve 20 movable axially along the inside of the wall 14 of the tubular housing. The sleeve 20 is sealably movable along or within a sleeve recess 18 and does not interfere substantially with the bore 16. The sleeve recess 18 is formed annularly from the bore and into the wall 14, either wholly within the wall 14 in a radially closed annular chamber (See FIG. 8A) or as an annular chamber formed between the sleeve and the housing.

In an embodiment, the sleeve is hydraulically actuable to open and close the ports 22. At least a portion of the recess 18 is blocked intermediate its axial length by a portion of the sleeve, either at the ends of the sleeve (FIG. 8A) or, as shown in FIGS. 1-6B, as an annular shoulder 25 extending radially outward from the sleeve 20 into the sleeve recess.

Figure 12:
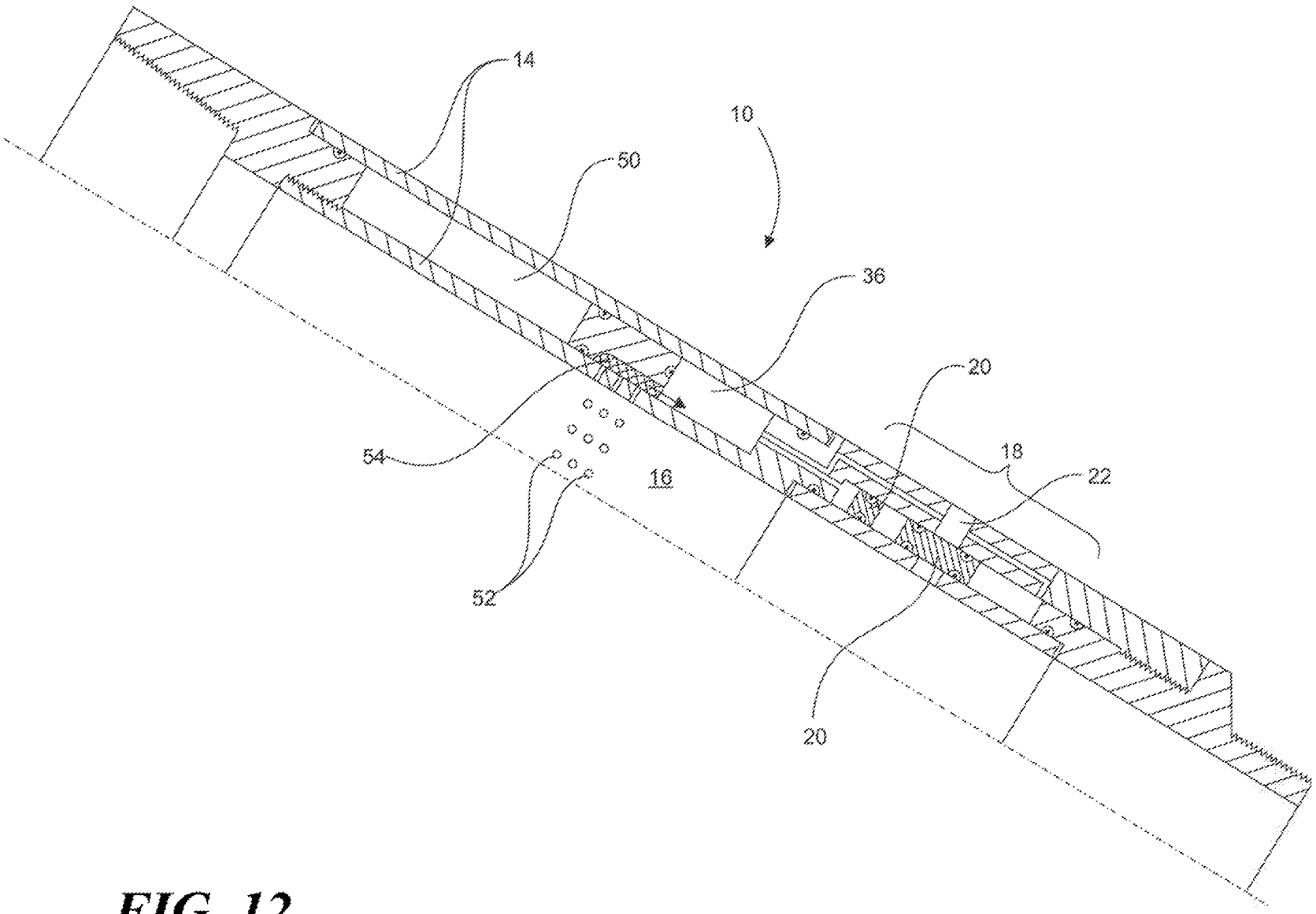
FIG. 12 is a half cross-section view of a sleeve valve incorporating bi-directional sleeve and the actuation embodiment of FIG. 9, the sleeve itself acting as the piston.
Figure 13:
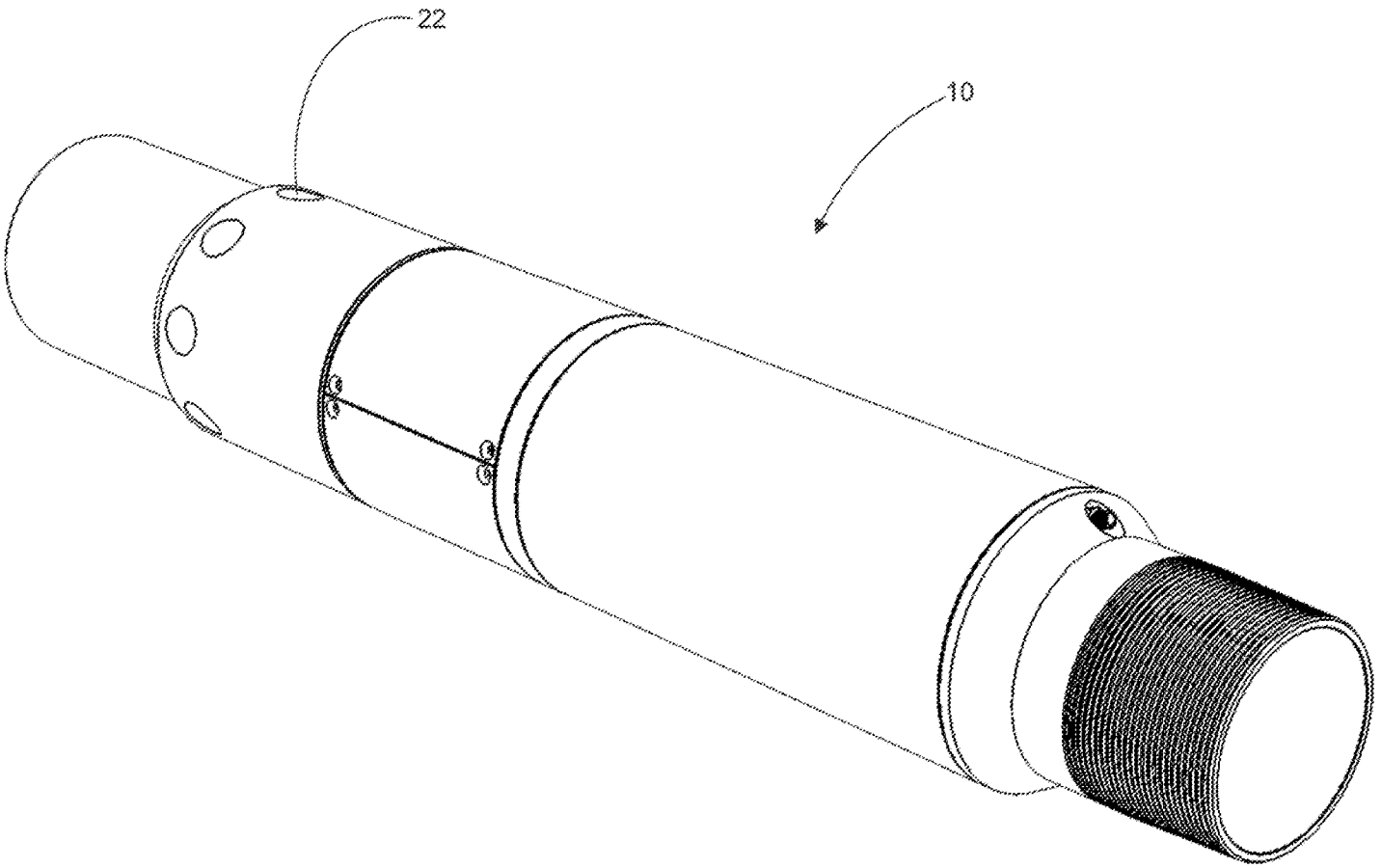
FIG. 13 is a perspective view of another embodiment of a remote operated sleeve valve.
Figure 14:
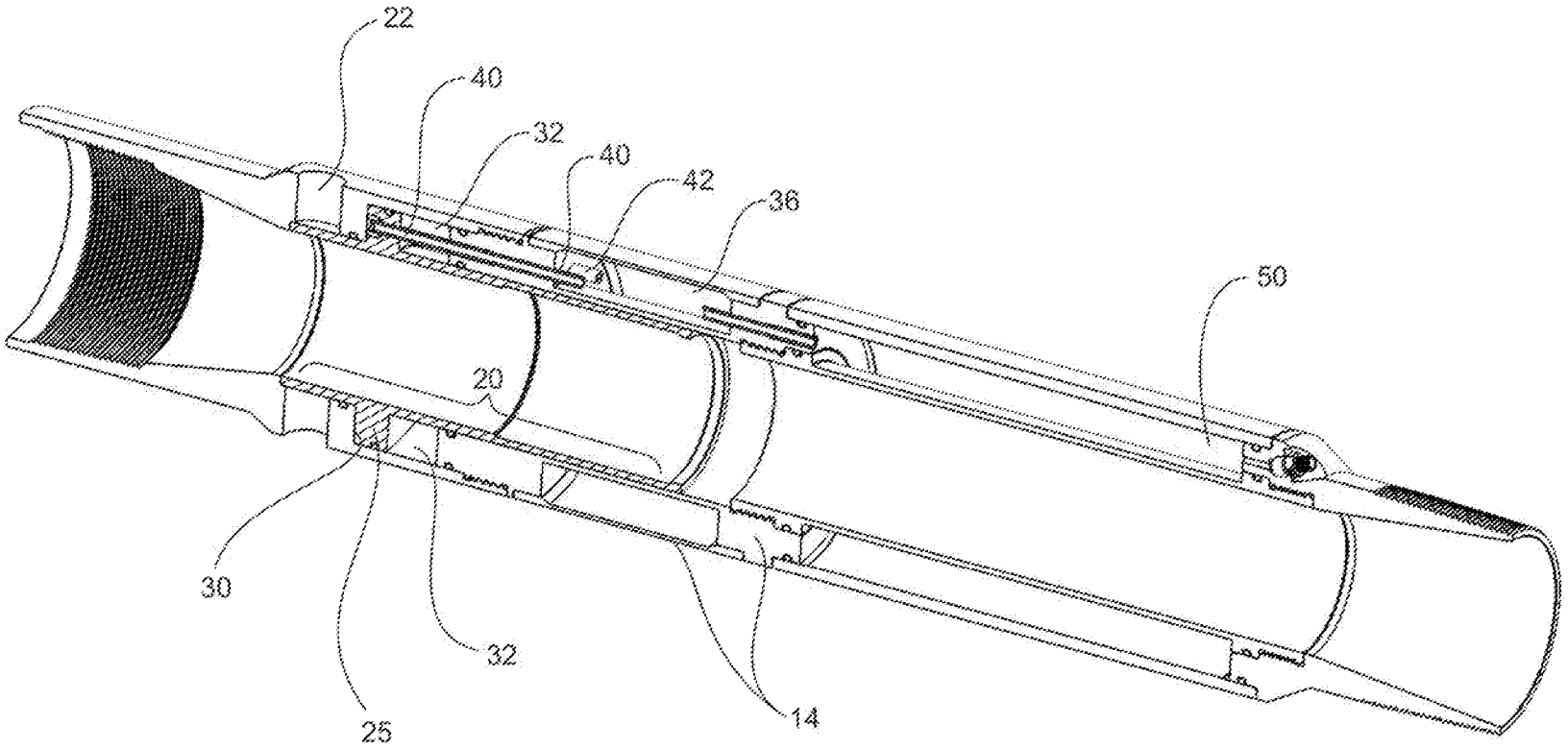
FIG. 14 is a perspective, cross-sectional view of the sleeve valve of FIG. 13.
Figure 15A:
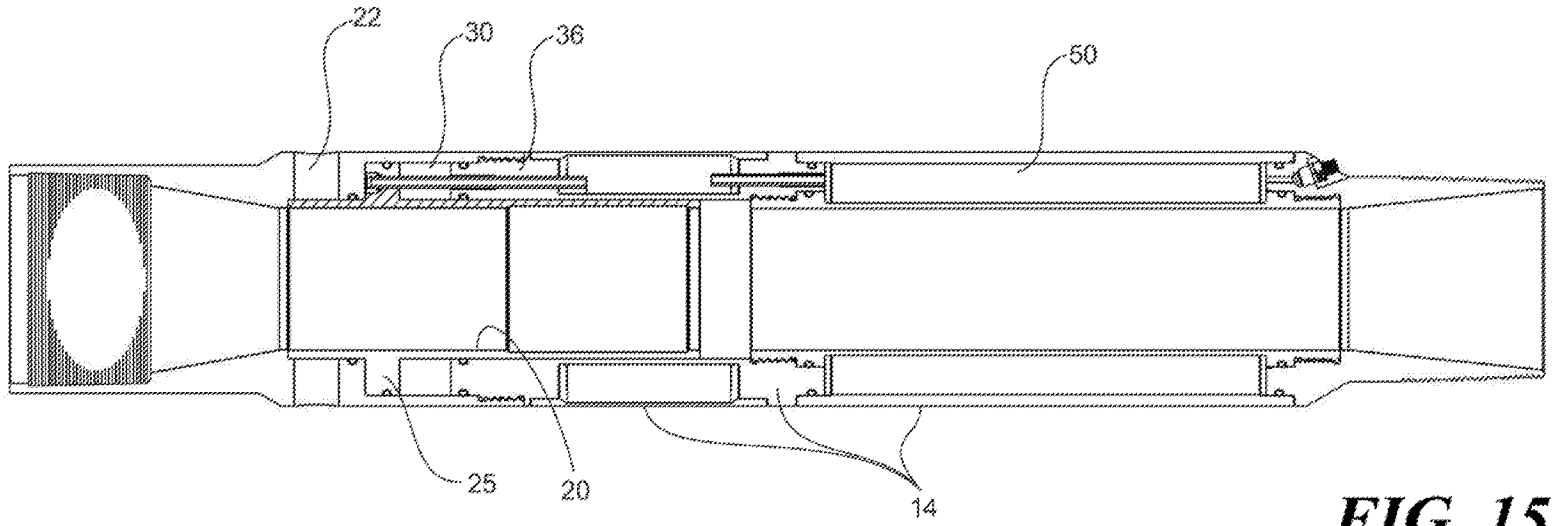
FIG. 15A is a side, cross-sectional view of the sleeve valve of FIG. 13 with the sleeve in the closed position.
Figure 15B:
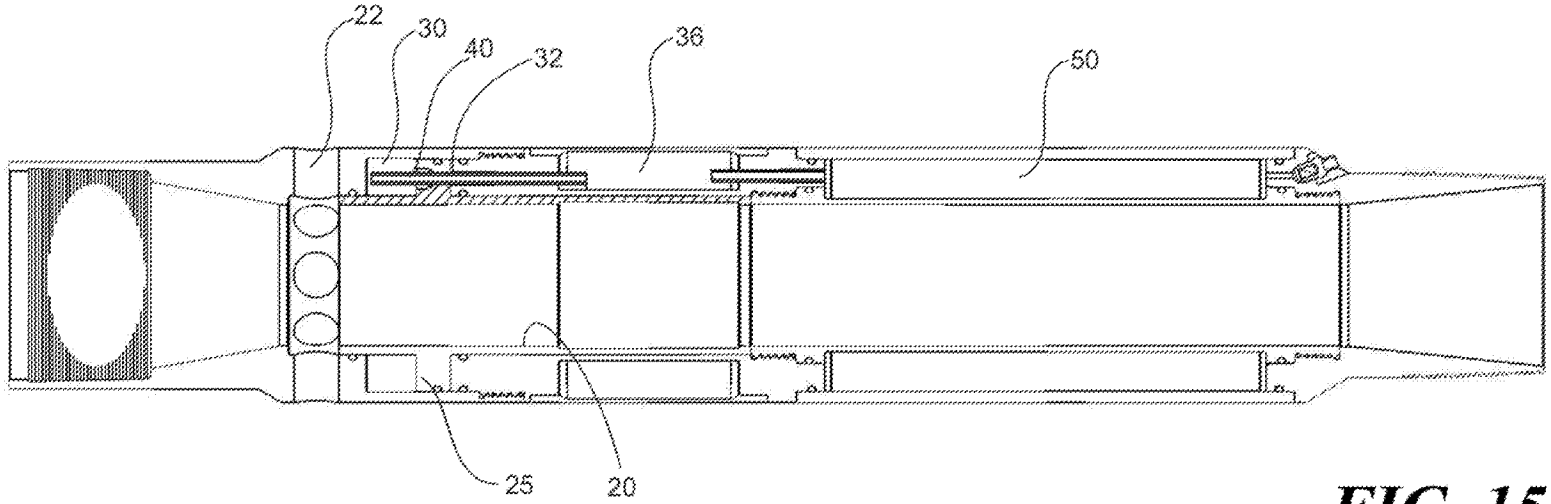
FIG. 15B is a side, cross-sectional view of the sleeve valve of FIG. 13 with the sleeve in the open position.

In FIG. 12, the sleeve 20 is hydraulically actuable from opposing ends axial ends thereof 20, the entire sleeve forming a bi-directional hydraulic piston within the sleeve recess 18. The illustrated embodiment of FIG. 2, the sleeve 2—is fit with an annular shoulder 25 thereabout that is movably sealable along the sleeve recess 18, the shoulder 25 forming the bi-directional hydraulic piston. Both embodiments form a bi-directional piston sleeve 20.

The internal, hydraulic-actuated sleeve 20 is bi-directional sleeve, having a downhole actuation chamber 30 on the uphole side of the piston and an uphole actuation chamber 32 on the downhole side of the piston, or shoulder 25 portion as shown.

The downhole actuation and uphole chambers 30,32 are in communication with an actuating valve 36 (discussed below) that can be conveniently housed in the wall 14 of the tubular housing 12 in a sub-housing or control module 38. The valve 36 is fluidly interposed between the axial bore (a source of pressure) and one side of the bi-directional valve chamber. Another valve or the same valve, having dual flow paths therethrough, is also fluidly interposed between a dump chamber (an accumulator) and the opposing or second side of the bi-directional sleeve chamber sleeve chamber. The valve or valves are connected to the chambers 30,32 with respective flow lines 40,42. The valve alternates between driving and dumping each side of the piston portion of the sleeve 20 to move the sleeve back and forth between open and closed positions. The tubular housing is fit with one or more ports 22 formed through the wall 14 forming a flow path extending generally radially from the axial bore 16 to a wellbore annulus outside the tubular housing. The sleeve 20 is movable along the sleeve recess 18 to alternately cover the ports 22 (close—FIG. 6A) and uncover (open—FIG. 6B).

As known in hydraulic ram technology, a two position hydraulic valve 36 can simultaneously communicate to both sides of the piston for opposing fluid functions, one to drive the piston, the other to receive displaced dump fluid.

The control module could be sized as a centralizer, to provide additional space for valve 36, electronics and the like, and to protect actuating lines 40,42 used to operate the bi-directional sleeve.

As stated, the sleeve alternately opens and closes the housing's port from fluid communication with the axial bore by uncovering and covering the housing ports respectively with the sleeve. The housing ports 22 can be covered by an end of the sleeve moved axially to cover the port, to block the bore 16 from the port 22 and opened by the end of the sleeve moved axially to uncover the ports 22. Alternately, and as shown here, a sleeve port 22*s* spaced from the end of the sleeve 20 can be axially aligned with the housing ports 22,22*h* to fluidly communication with the housing ports 22*h* and the bore 16, and while misaligned to block the close the housing's ports 22*h*.

Figure 4A:
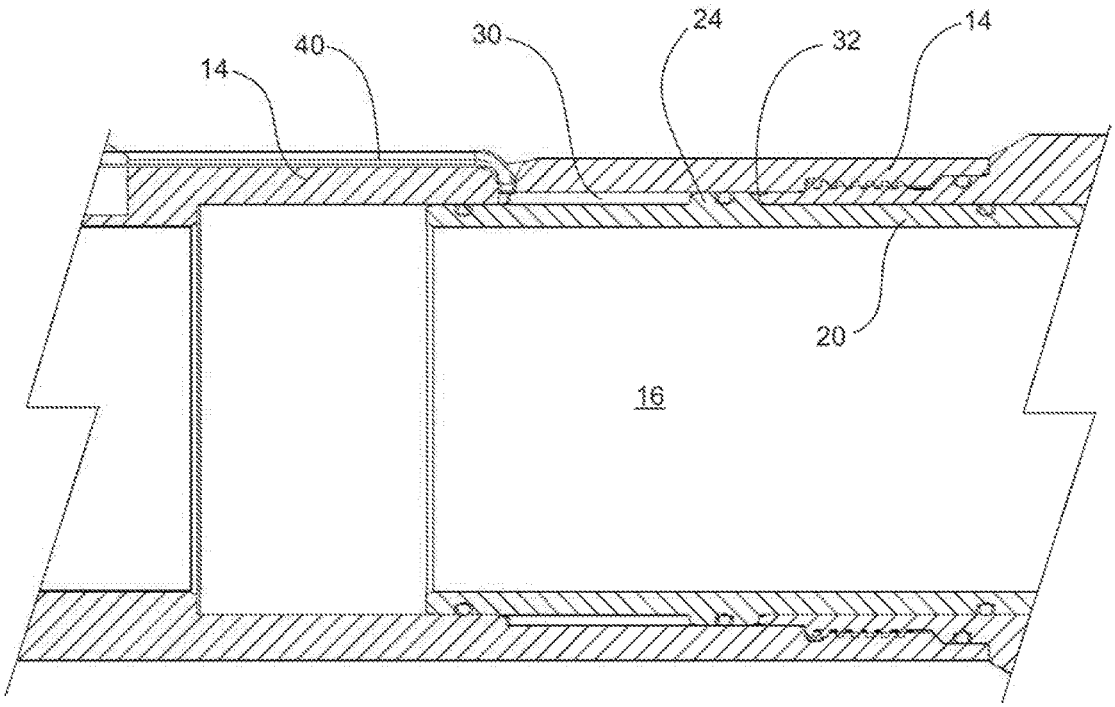
FIG. 4A is a cross-sectional view of the sleeve chamber with a first line fluidly connected to the uphole side of the sleeve chamber.

In closer detail, FIG. 4A illustrates that portion of the cross-section of the tubular housing that is shown sectioned through the first side hydraulic line 40. As illustrated, with downhole to the right, the first side line is fluidly connected to the uphole side, or downhole actuation chamber 30, for hydraulically driving the sleeve 20 to the closed position to the right. As shown in corresponding FIG. 3A, the sleeve ports 22*s* are misaligned from the housing ports 22*h* for blocking flow therethrough.

The second downhole side or uphole actuation chamber 32 is axially reduced to substantially zero volume as the annular shoulder 25 has shifted to the far right extent of the uphole actuation chamber 32. The downhole actuation and uphole actuation chambers 30,32 alternate between minimum (zero) volume and their maximum operating volume.

Figure 4B:
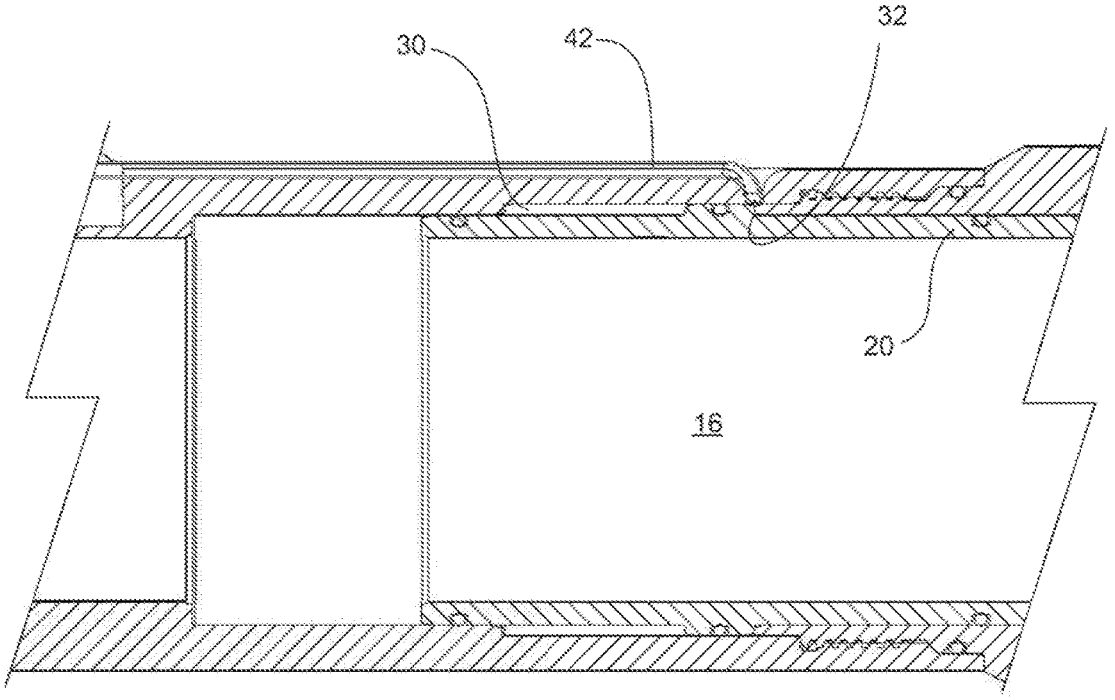
FIG. 4B is a cross-sectional view of the sleeve chamber with a second line fluidly connected to the downhole side of the sleeve chamber.
Figure 5A:
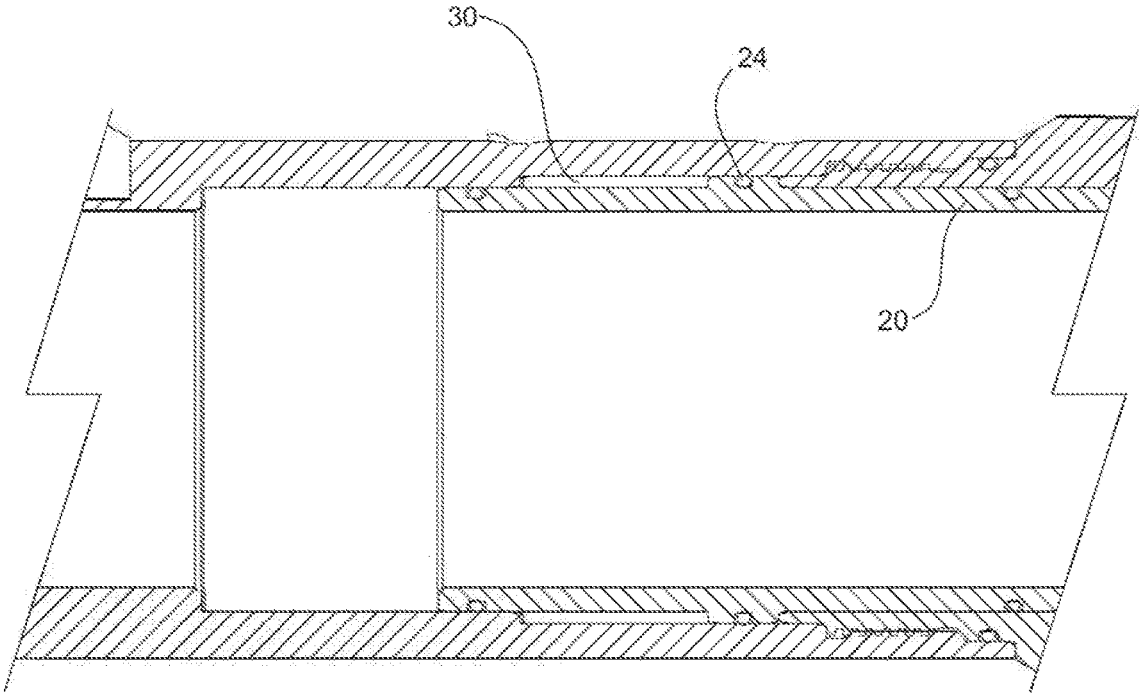
FIG. 5A is a cross-sectional view of the sleeve valve according to FIG. 3A with the sleeve in the closed position.
Figure 5B:
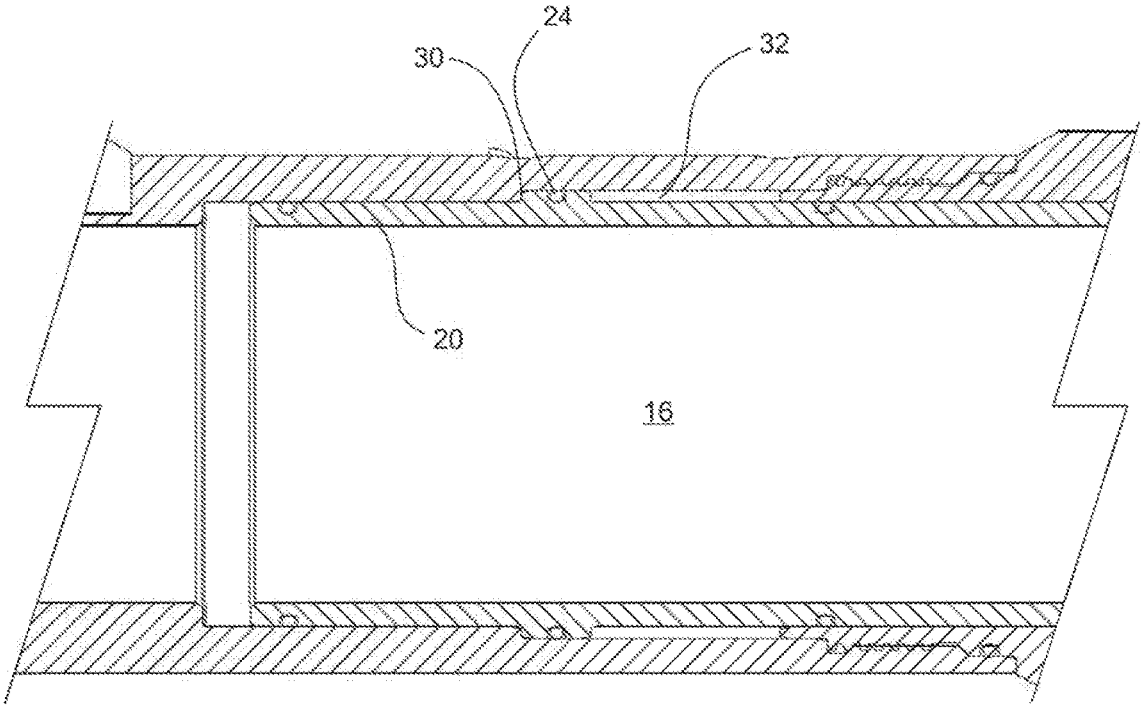
FIG. 5B is a cross-sectional view of the sleeve valve according to FIG. 3B with the sleeve in the open position.

FIG. 4B illustrates that portion of the cross-section of the tubular housing that is shown sectioned through the second side hydraulic line 42 fluidly connected and accessing the second side or uphole actuation chamber 32. The sleeve is shown again in the previous closed position, with the housing ports 22*h* and sleeve ports 22*s* aligned.

Figure 6B:
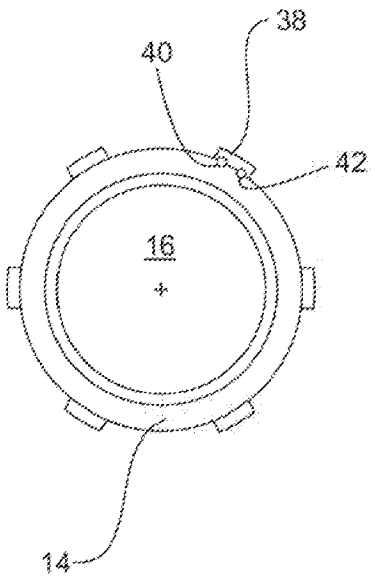
FIG. 6B is a cross-sectional view of the tubular housing of FIG. 6A through the first and second valve lines.
Figure 6A:
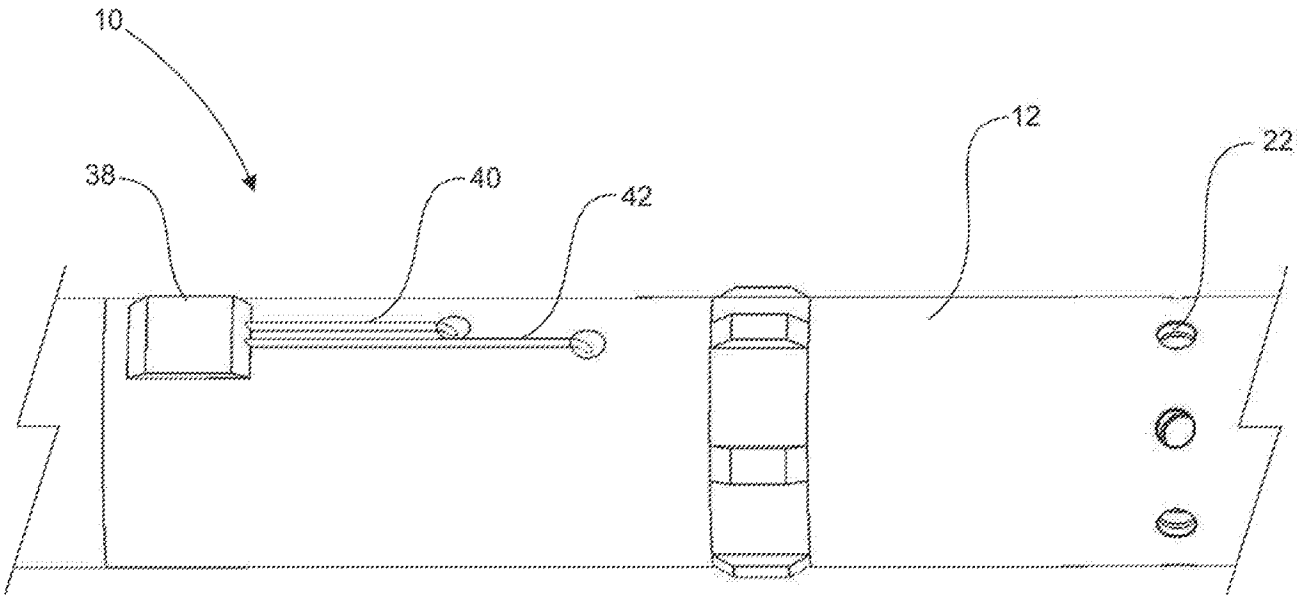
FIG. 6A is a side view with the tubular housing rotated on its axis to illustrate the first and second valve lines.

FIG. 6A is a side view of the tubular housing 12, illustrating the first and second side hydraulic lines 40,42 extending along an exterior or recessed exterior surface of the tubular housing from the control module 38 to the first and second side, downhole actuation and uphole actuation chambers 30,32 respectively. As shown in FIG. 6B, to minimize an outer diameter of the tubular housing 12, recess profiles may be formed in the outer wall body to accommodate at least a portion of the hydraulic lines 40,42.

Actuator System for Operating a Down Hole Tool

In embodiments herein, the valve or valves 36 control the application of an actuation pressure to the bi-directional piston sleeve. Where pre-charged pressure or wellbore pressure is used to physically operate a downhole tool, such as to shift the sleeve open or closed, the pre-charged pressure can be either a positive pressure or a negative pressure relative to wellbore pressure. Embodiments as illustrated in FIGS. 1 to 9, are discussed below in the context of a shifting sleeve 20 and a negative pressure system however, as introduced in FIGS. 10A,10B, the system can be pre-charged with positive pressure at surface. Either system can be applied to actuate other forms of downhole tools.

Having reference to FIGS. 7, 8 and 9, embodiments of a negative pressure system are shown and described below. As one of skill will appreciate, embodiments are disclosed in the context of shifting of a sleeve however the negative pressure system may be applicable to remote activation of other apparatus in a wellbore.

Figure 7:
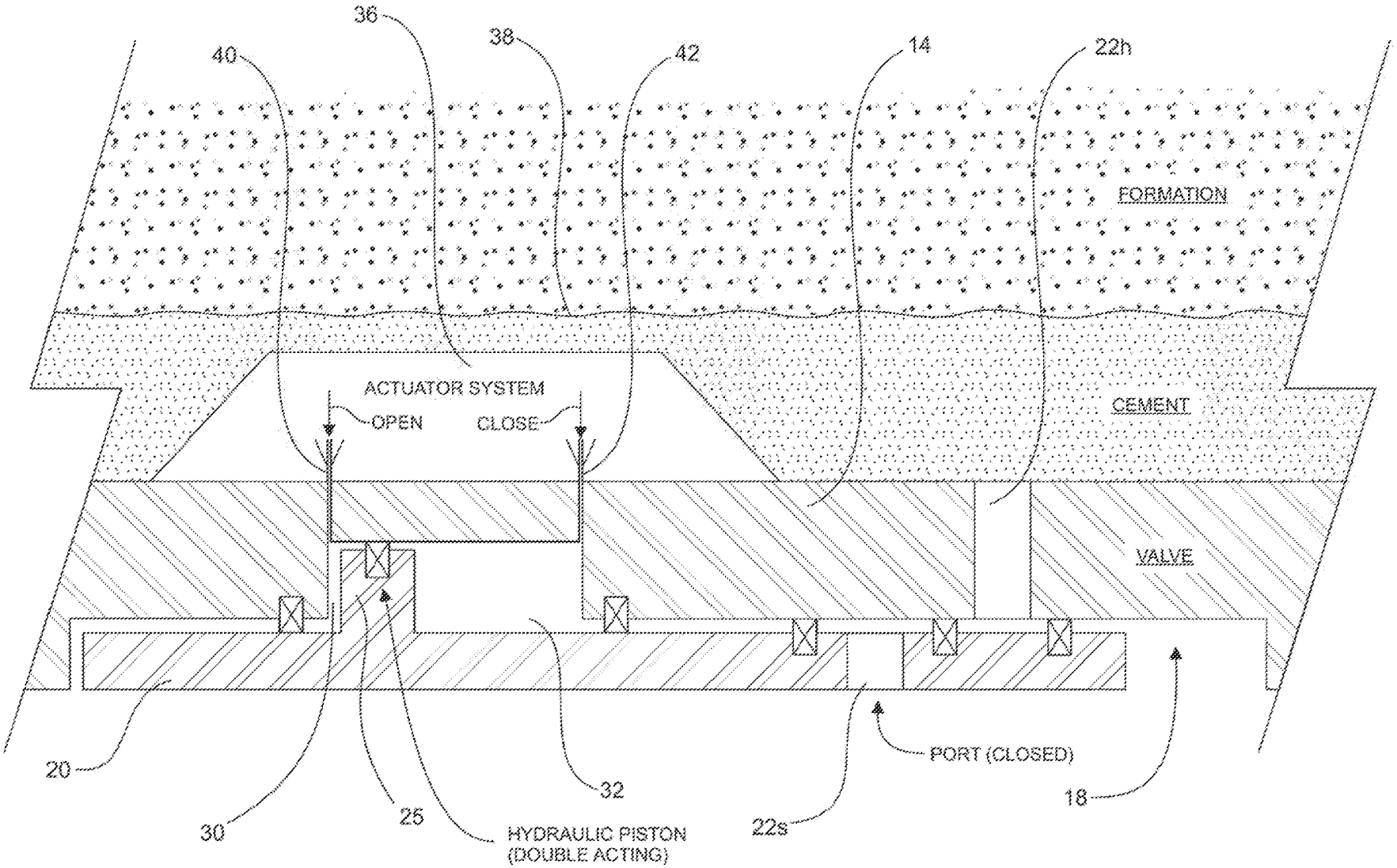
FIG. 7 is a schematic partial cross-sectional view of the tubular wall of a sleeve valve, with the sleeve closed.
Figure 8:
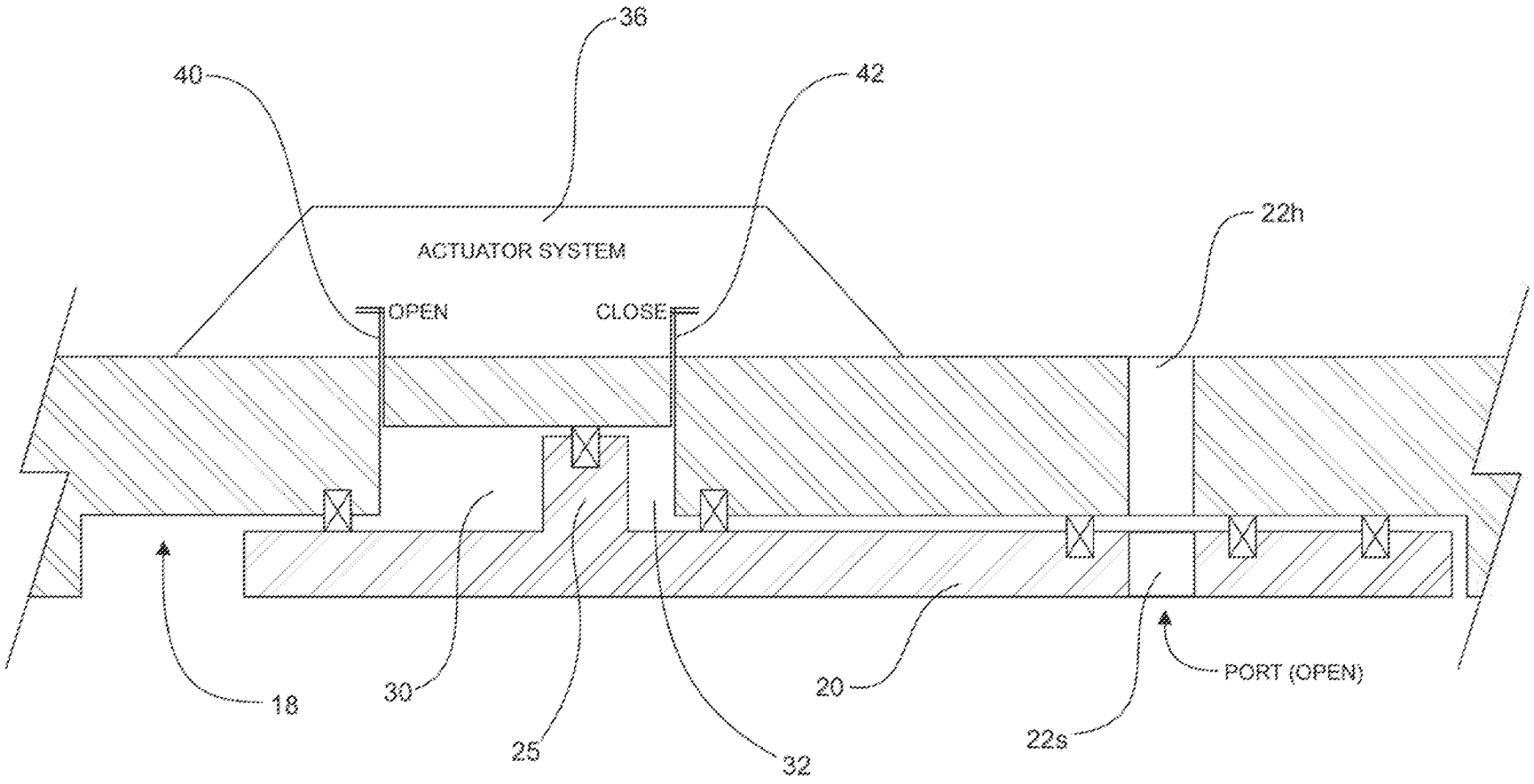
FIG. 8 is a schematic partial cross-sectional view of the tubular wall of a sleeve valve, with the sleeve open.
Figure 9:
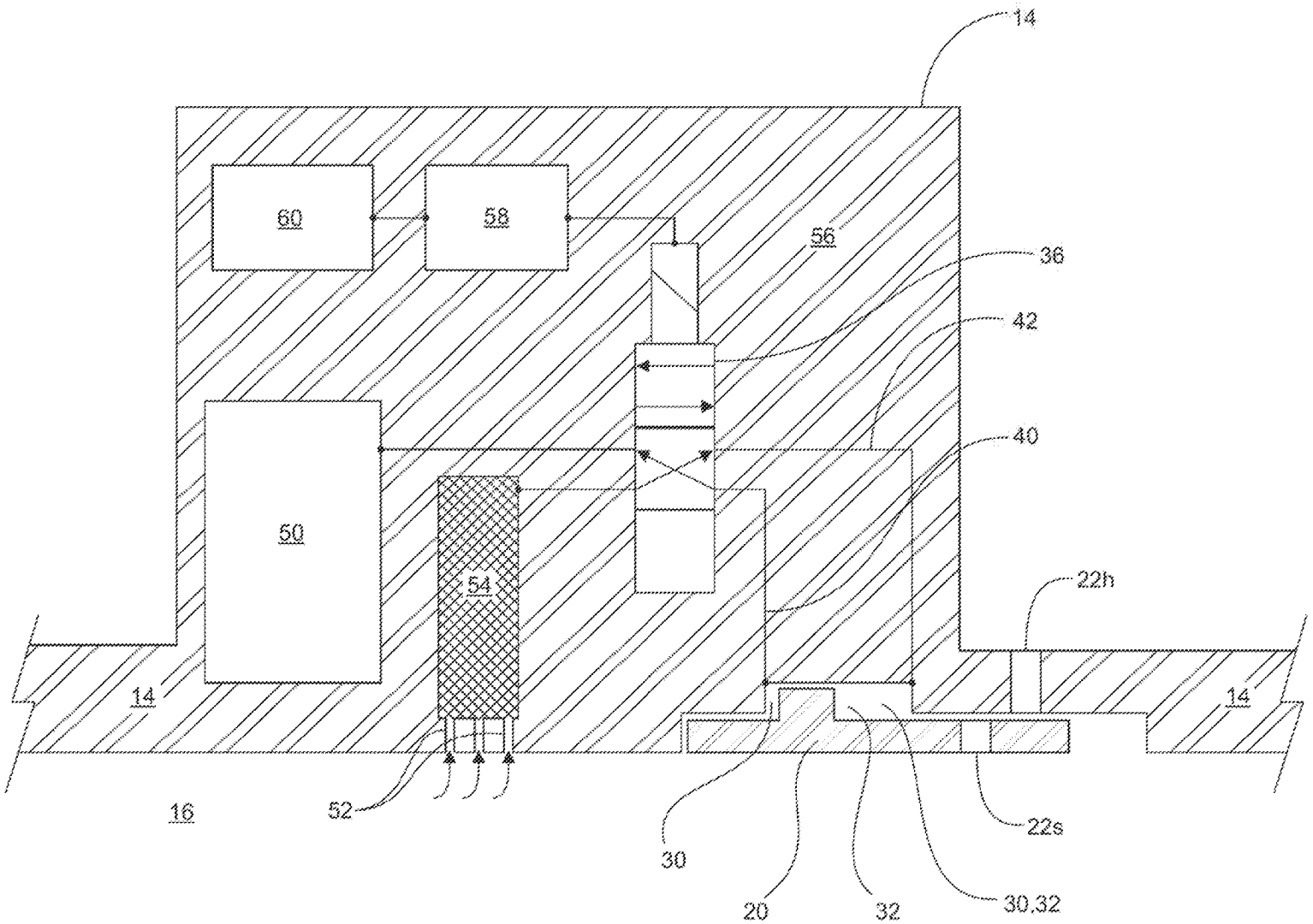
FIG. 9 is a schematic of one embodiment of an actuation system with atmospheric dump chamber.

FIGS. 7 to 9 illustrate an actuator system which is fluidly connected to the sleeve 20, located within a tubular housing 12 which is incorporated into a casing string. The actuator system acts on the sleeve 20 hydraulically to shift the sleeve to either block the ports 22*h*, in a closed position, or to open the ports 22*h* in, in an open position. The sleeve 20 is shifted back and forth between the open and closed position as required.

In embodiments, a signal is sent from surface to the control module 36 within the actuator system for initiating actuation of the sleeve. In embodiments, the signal can be an acoustic signal, such as impact pulses or seismic vibration. In an example, a coded series of impact pulses are transmitted, described in more detailed later. A hammer is used to impact the wellhead or other connected portion of the tubular string; impacted at a specific code sequence for sending a unique signal down the casing string to the control module 36 of a selected RO Sleeve 10 for opening and closing its sleeve 20. In another example, also described in more detail below, for transmitting seismic vibration, a seismic vibrator is placed on surface to send a configured sequence of vibrations to the control module 36 of the selected RO Sleeve 10 for opening or closing its sleeve 20.

In a more schematic format, best seen in FIGS. 7 and 8, the annular, double-acting hydraulic piston is formed by the shoulder 25 formed on an outer surface of the sleeve 20. The piston having first and second opposing piston faces or sides. The wall 14 is profiled on an internal surface thereof to provide a valve or sleeve chamber along which the annular shoulder 25 of the piston is axially moveable. Fluid, under the direction of the actuator assembly, is applied to one of either the first uphole or second downhole sides of the annular piston, referred to herein as a the downhole and uphole actuation chambers 30,32 respectively. Fluid applied to the first side shifts the sleeve in a first direction, to close the ports 22, or to shift the sleeve in an opposing direction to close the ports depending on the relative location of the ports 22 and sleeve 20. Shown in an arrangement consistent with FIGS. 1 to 6B, fluid applied to the first uphole side/downhole actuation chamber 30 shifts the sleeve downhole to close the ports 22.

Fluid applied to the second side, shifts the sleeve in a second opposing direction, to open the ports 22, or to shift the sleeve in an opposing direction to open the ports. Again, consistent with FIGS. 1 to 6B, fluid applied to the second downhole side/uphole actuation chamber 30 shifts the sleeve uphole to open the ports 22.

Axial movement of the piston and sleeve attached thereto is delimited by a length of the sleeve recess 18. Seals spaced along the sleeve or recess, sealing between the sleeve 20 and the wall 14 prevent fluid applied to the piston from leaking from the chambers 30,32.

Having reference to FIG. 9, the actuator system further comprises a dump chamber 50, which is charged at atmospheric pressure at surface the pressure being significantly negative relative to the wellbore pressure in-situ, downhole. Under hydrostatic pressure at depth within the wellbore, the pressure of the dump chamber 50 becomes a negative pressure chamber. The dump chamber 50 is fluidly connected to the chambers 30,32, to received fluid from the double acting piston, through hydraulic lines 40 or 42 connected to the chambers 30,32 on the opposing first and second sides of the annular piston shoulder. Fluid at some higher pressure is applied to the pressure side of the piston to force the piston and sleeve to shift and, at the same time, fluid is dumped from the opposing back side or dump side of the piston to the dump chamber 50. The actuating fluid at higher pressure enters from the bore 16. Inlet ports 52 in the wall 14 provide fluid communication from the bore 16, contiguous with the tubular string or casing, to a two position or 2-way hydraulic directional valve 36 which is fluidly connected to the dump chamber and to the hydraulic lines 40,42. A differential pressure is established between the dump chamber 50 and the bore 16, which causes fluid to enter the actuator through the inlet ports, and at sufficient differential pressure for shifting the sleeve 20. The fluid passes through a filter 54 to remove sand and debris therefrom, excluding same from the valve 36.

In embodiments, the hydraulic lines 40,42 could also include relief valves, so as to dump fluid therein when required, such back through the filter 54.

A solenoid 56 is operatively connected to the 2-way valve 36 to change the state of the valve 36 to alternately apply fluid received from the bore 16 to the downhole actuation chamber to shift the sleeve from one position (e.g. open position) to the other position (e.g. closed position) or vice versa.

The actuator assembly further comprises electronics 58, such as those for receiving the coded signal and processing the signal to establish if the signal corresponds to that needed to actuate the solenoid 56. A long-life temperature tolerant battery 60 is provided for powering the electronics 58.

Upon receipt of a triggering signal at the electronics 58, the valve 36 is actuated to establish a driving pressure communicated between the one side of the sleeve chamber and the bore 16 for opening or closing the sleeve depending on the hydraulic coupling arrangement. The other side of the piston, also connected through the valve, dumps previous or spent driving fluid to the dump chamber 50 as an accumulator.

When the actuator receives a signal to close the sleeve, the solenoid 56 changes state to cause fluid from the bore to be delivered to the first side of the piston to shift the internal sleeve to the closed position. As fluid is applied to the first side of the piston through the first side hydraulic line, the first side chamber of the cavity expands to accept the fluid and drive the piston and sleeve to the closed position. The second side chamber of the cavity reduces in volume and the fluid therein is discharged through the second side hydraulic line to the main chamber.

When the actuator system receives a signal to open the ports, the solenoid 56 changes state to apply fluid from the bore to the second side of the piston to shift the sleeve to the open position. The fluid in the first side chamber of the cavity is discharged to the main chamber through the first side hydraulic line as the volume of the first side chamber of the cavity is reduced. The second side chamber in the cavity expands to accept the fluid from the bore and drives the piston to shift the sleeve to the open position.

Shifting of the two position valve 36, or coordinated actuation of two separate valves (not shown), the process can be operated in reverse to close or open the sleeve, opposite in actuation to the prior actuation. The dump chamber 50 is at a sufficient pressure differential, and having sufficient volume, for multiple operations before the dump chamber pressure differential falls below useful levels.

As fluid is applied through one hydraulic line 40 or 42 to the chamber 30 or 32, fluid is discharged or dumped, through the other hydraulic line 42 or 40 to the dump chamber 50, from the other chamber 32 or 30 on the opposing side of the shoulder 25 as the volume diminishes. Thus, a known bolus or volume of fluid is discharged to the dump chamber 50 each time the sleeve 20, once each direction, each time the sleeve is shifted to open ports and each time the sleeve is shifted to close ports.

The first time the sleeve 20 is shifted, only air is discharged through the hydraulic line to the dump chamber. Thereafter, fluid present in the cavity on what was previously the pressure side of the piston and is subsequently the dump side of the piston is discharged therefrom to the dump chamber 50 as the sleeve 20 is shifted in the opposing direction.

Applicant believes that the volume of the dump chamber 50 can be sufficiently large to allow many shifting cycles before the dump chamber 50 becomes substantially filled with fluid and no longer has the compressible volume remaining therein and the pressure differential sufficient effective to shift the sleeve.

By way of example, air pressure in the atmospheric main chamber at the elevation about Calgary, AB, Canada, is about 14 psi. The well pressure at depth is about 0.44 psi per foot of depth. At 5000 ft (1,524 m), the available pressure is about 2,150 psi (5000×0.44 psi=2150 psi) for a differential of over 2100 psi.

As the pressure increases in the dump chamber 50 as it fills with fluid, the available differential pressure to shift the sleeve diminishes. Thus, there is a limited number of shift cycles that can be performed for any given volume of the main chamber. If, for example, the exhaust volume of the uphole or downhole sides of the piston is 3.6 $in^3$ (4.75 OD×4.50 ID×2.0 stroke), after 4 shifts (open-close-open-close) the pressure in the chamber would go from 14 psi to 30 psi, leaving about 2,120 psi available for subsequent shifting. At 2,120 psi, the force, per the piston area, available to shift the sleeve remains at a robust 3,800 lbs. Applicant believes therefore that more than enough force remains to shift the sleeve as many times as a sleeve is likely to be shifted during oilfield operations over the lifetime of a well.

Figure 11:
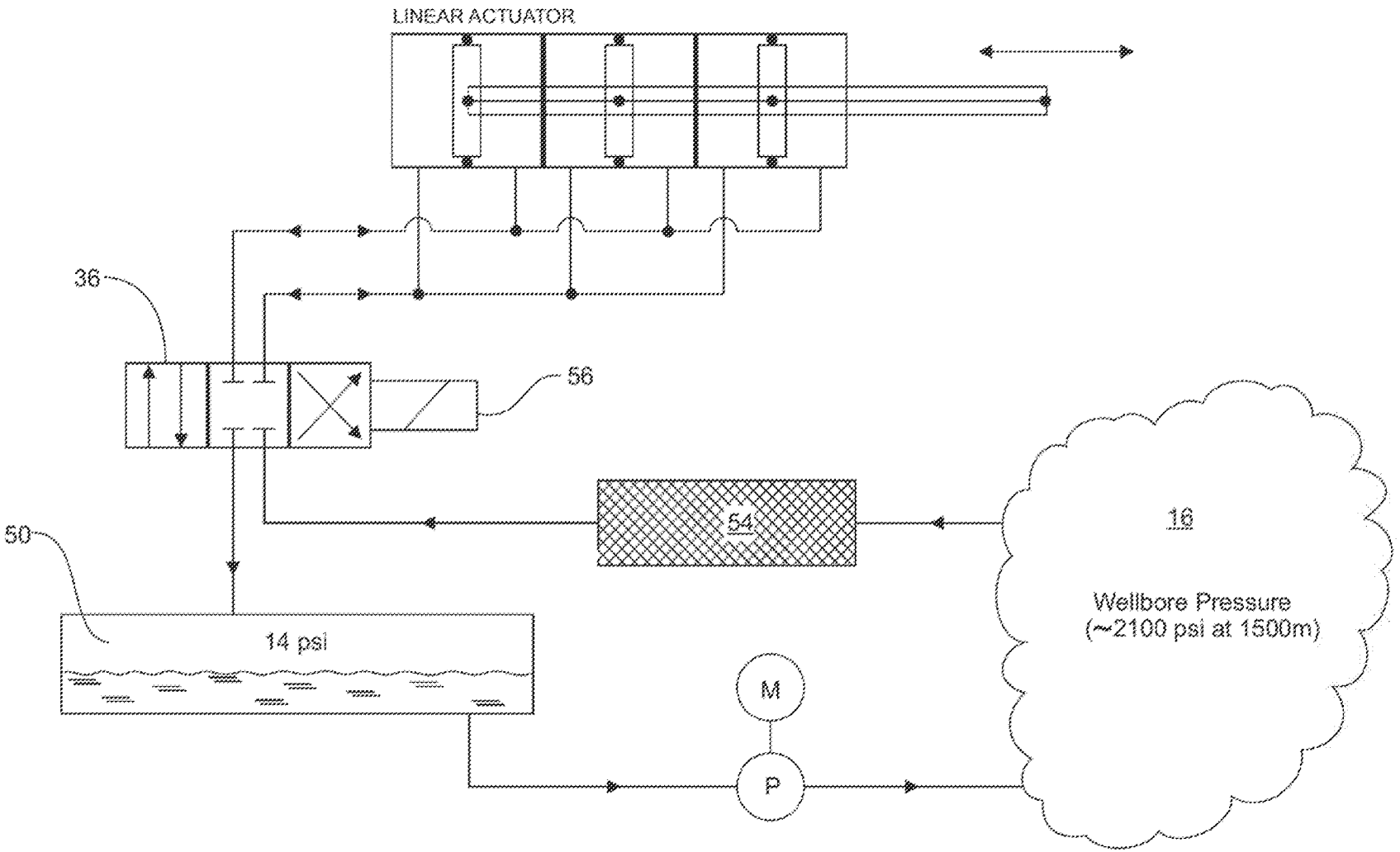
FIG. 11 is a schematic representation of another embodiment of an actuator for a sleeve valve implementing a linear actuator, either incorporated in a sleeve or separate actuator.

As shown in FIG. 11, the pressure differential can be applied to drive a downhole linear actuator. Further with access to long life batteries, downhole charging systems wireline or electrically enabled coiled tubing, it is also possible to operate small motor driven exhaust pumps to periodically remove accumulated liquid and prolong the life of the differential pressure shifting systems.

As shown, in an embodiment, the pressure hydraulic system is modified to work a downhole tool a substantially unlimited number of times. For ease of discussion, the system is described again in the context of a shifting sleeve. Unlimited use of the system to shift the sleeve open and closed, substantially an unlimited number of times, is achieved by slowly pumping fluid from the main chamber during periods of time when the sleeve is not being shifted.

Electrically-enabled coiled tubing or a wireline, deployed in coiled tubing or other tubular, is operatively connected to an electric motor and a pump, incorporated in the actuator system, for pumping the fluid which is accumulated in the main chamber each time the sleeve is shifted. The wireline is relatively small as the pump and motor are suitably small to pump the fluid at very low flow rates, given that the time period over which the accumulated fluid is to be pumped out of the main chamber is generally very long. Sleeves are typically shifted only as required and may be stationary for hours, days, weeks, months or years between shifts.

In the case where the downhole tool is a tool which must stroke or perform an operation, such as shifting a sleeve, setting a packer or punching a hole in casing, a large force is required over a short period of time. The dump or accumulator chamber generally acts therebetween as a rechargeable "hydraulic battery" for operation of the tool.

In the embodiment shown in FIG. 11, a linear actuator used for moving the tool is depicted as a triple, tandem cylinder wherein the force of the cylinder is three times the force achieved in a single cylinder. Advantages to use of a simple hydraulic ram system, compared to use of downhole, electrically-actuated systems, are as follows: the shape of the cylinder or ram is consistent with long, slender downhole tools; the system is relatively simple and cost effective compared to complicated, expensive electronic motor drives; the system does not require a hollow shaft on an electric motor which is typically more complicated an arrangement; electronic systems typically utilize extremely high ratio planetary gear reduction which must be cooled and lubricated; electronic systems typically utilize large thrust bearings which must be cooled and lubricated; and apply a rotary motion to a linear actuator which must be cooled and lubricated.

Figure 10A:
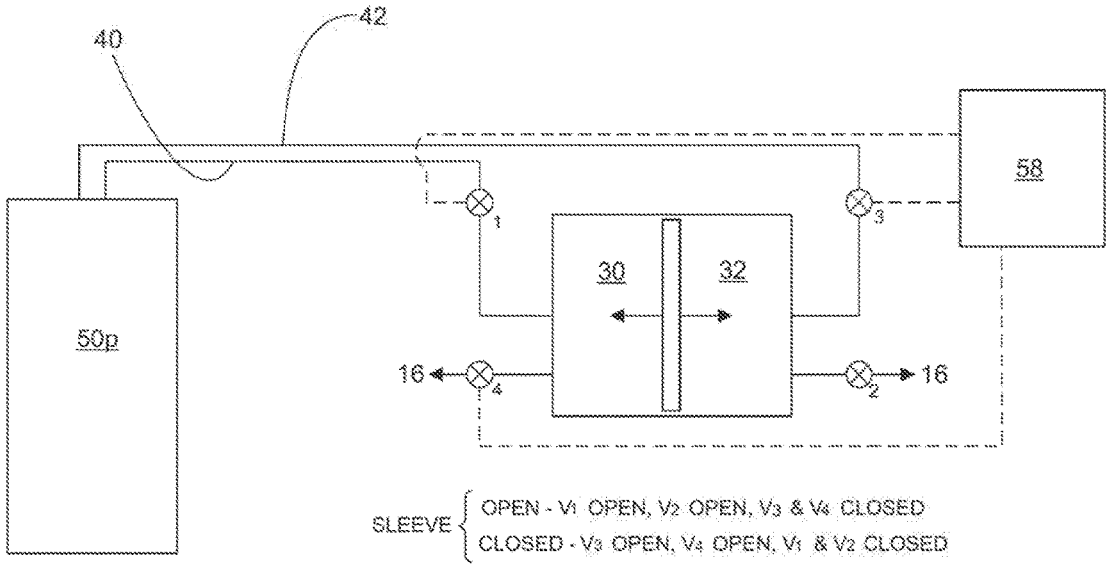
FIG. 10A is a schematic of another embodiment of the actuation system illustrating a hydraulic/instrumentation flow diagram with a high pressure Nitrogen drive chamber.
Figure 10B:
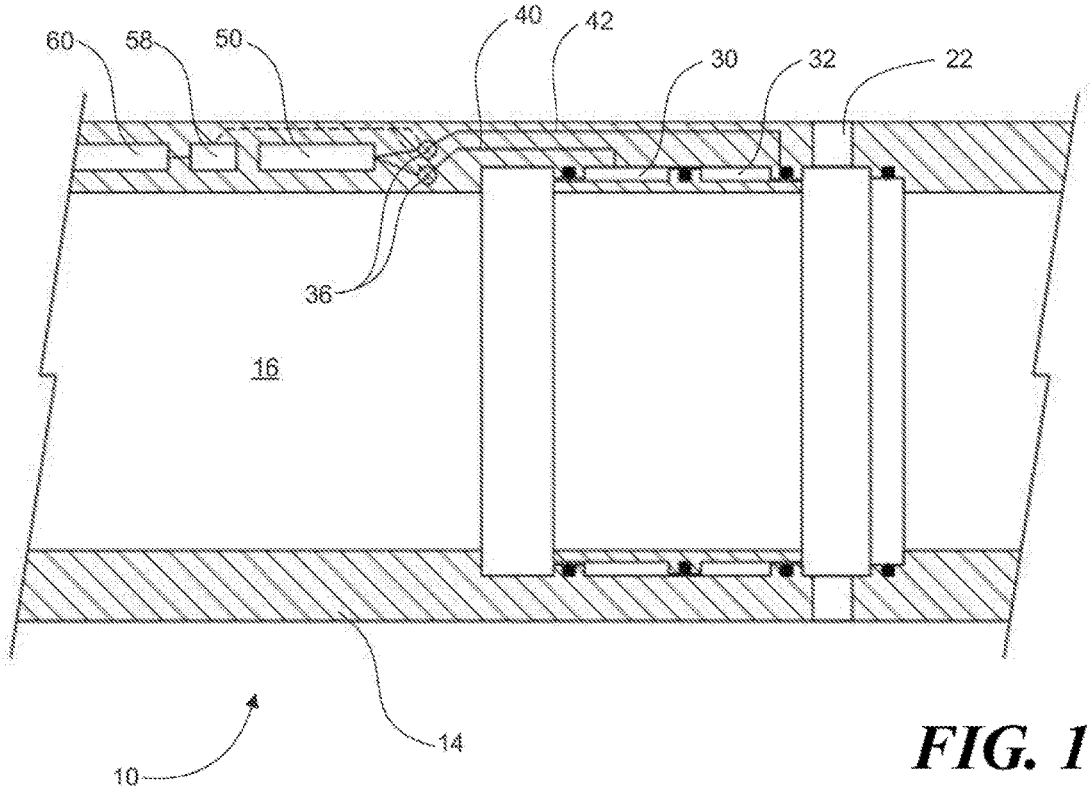
FIG. 10B illustrates a cross-section of the actuation system of FIG. 10A in a sleeve valve where the hydraulic driving force is a pressurized N2 chamber and the wellbore is used as tank.

With reference to FIGS. 10A and 10B, other embodiments include developing the differential driving pressure between a pre-charged, positive pressure chamber or accumulator 50P as differentiated from the wellbore pressure. As above, to result in differential pressures of >2000 psi for multiple cycles, for example the pressure in the accumulator 50P could be Nitrogen at 10,000 psi.

In such a positive pressure system, the pressure differential between the accumulator 50P and the bore 16 causes power fluid to move from the accumulator chamber 50P to act at the first and second sides of the piston, as required. Upon shifting, power fluid would be discharged from the discharge side of the piston, such as to the bore 16.

In FIG. 10B, an example of component layout is shown for an RO Sleeve 10. As shown, the sleeve 10 comprises in its wall 14 a battery 60 connected to instrumentation 58. The sleeve 10 also comprises in its wall the $N_2$ accumulator 50P fluidly connected to a first and second valves 36. The instrumentation separately controls the open and close of the first and second valves for shifting the sleeve to open or close the ports 22.

In another embodiment of the RO Sleeve, shown in FIGS. 13 through 15B, the sleeve operation is reversed, a pressure applied to the uphole side of the piston, the downhole actuation chamber 30, opens ports 22 and a pressure applied to the downhole side of the piston, the uphole actuation chamber 32, closes ports 22.

In this embodiment the hydraulic lines are wholly located within the wall 14 of the tubular housing 12. In order to enable the hydraulic line to access the uphole chamber 30, on the opposing side of the shoulder 25 from the dump chamber 50, the line passes sealably through the shoulder 25. The shoulder slidably, yet sealingly, reciprocates axially along the line 40.

In other embodiments, valve 36 can be pressure threshold-actuated to trigger or open at a pre-determined and signature pressure for opening fluid communication to the bore. Pressure in the main bore is then utilized for shifting the sleeve. The valve isolates the normal hydraulic actuation of the sleeve from inadvertent operation. Alternatively or in combination, the sleeve 20 can be further secured with shear screws for first time actuation.

In another embodiment using hydraulic-actuated sleeves, the triggering event for sleeve actuation may not be a robust hydraulic pressure source but instead may be merely of low energy nature. For example, a Radio-frequency identification (RFID) chip can be introduced into the wellbore. An RFID is pumped down the well with a specific code for every sleeve. The RFID travels past the sleeve as an example and transmits a code to a specific sleeve to activate or actuate it.

Each RFID can be signature matched with a particular sleeve. An RFID is pumped down the well with a specific code matched for every sleeve. The RFID travels past the sleeve as an example and transmits a code to a specific sleeve to activate it open only. Each RO Sleeve can be battery powered for both interrogating the chip and the chip can also battery powered for enhanced range. When the sleeve confirms the identity of the RFID, the RO Sleeve actuates the trigger valve. When powered by battery it is advantageous to use a pilot operated hydraulic valve for enabling low power electrical switching for opening a more capable fluid communication of the sleeve annulus. Then bore fluid pressure can be employed to shift the sleeve. Multiple RO Sleeves can be independently operated, and operated at any time.

Triggering signals, including RFID or vibration for example, can be used multiple times for the same sleeve, for opening, closing and repeating as necessary.

In the case of vibration, a specific vibration is provided unique to each RO Sleeve. Each vibration can be programmed to a unique frequency, amplitude or both. Each sleeve can have a first sleeve-open vibration signal, a second sleeve-closed vibration signal and also, all sleeves or a group of sleeves can be programmed with a third and fourth all-sleeves open, all sleeves closed signal. Further, with vibration, one does not need to await transfer of a triggering device arriving at the sleeve, as in the case with RFIDs. Vibration can be programmed to trigger sleeves, even spaced apart sleeves substantially simultaneously. For example, a signal could be received at a first sleeve or set of sleeves to open, while another sleeve or set of sleeves, moments later, receive a signal to close. An advantage of dispersed, yet contemporaneous, the actuation of sleeves means that fluid pumping of one frac can be continuous as one earlier set of sleeves closes and another set opens. After fracing is complete, all sleeves could be opened with yet another all-sleeves open signal.

Vibration can be produced at surface using conventional vibration trucks or even more portable vibration equipment carried by service vehicles, or by vibration equipment mounted on the well head. Small geophones or accelerometers, such as Microelectromechanical systems (MEMS) geophones/accelerometers, available as small as the size of a pencil eraser and known for microseismic detection, can be located at each sleeve, powered by battery and connected in the electronic circuit. Similarly, for detection of successful actuation, a geophone/accelerometers in vibration communication with the wellhead can monitor each sleeve shifting. Vibration may be detected and processed in the RO Sleeves. Vibration can be detected a 10,000 to 30,000 feet which is an advantage over coiled tubing deployed sleeve actuation devices.

The RO Sleeves can be electronically-controlled. The triggering signal can be programmed for opening or closing a particular sleeve. Typically upon detection of a first triggering signal, such a sequenced vibration or RFID, the controller at the RO Sleeve can unlock the sleeve and a servo or hydraulics would shift the sleeve, say to open the ports. Hydraulics can be the wellbore fluid, accumulator fluid or small hydraulic pump. The actuation can also cause the sleeve to latch in the open position. Upon detection of a second triggering signal, for that sleeve, the controller at the RO Sleeve would unlatch the sleeve for a shifting return to its initial position, such as through biasing or other hydraulic valving to shift the sleeve in the opposing axial direction to a starting position.

In a battery-powered embodiment, an electrical latch, solenoid, pilot valve or other mechanical device, for example, can release the sleeve to an open position. In an embodiment, the sleeve can be captured in the open position. Using wellbore hydraulics to open the sleeve would enable driving the sleeve open against biasing and to forcibly engage a latch, capturing the sleeve. A second circuit can provide a reciprocal system for the opposing action, in response to a second RFID, to release the latch and permit the sleeve to return to a closed position.

Further, embodiments of the remote controlled sleeve have the following components: mechanical means of opening and closing ports from the ID of the well to the OD of the liner; battery or power source; and instrumentation including receiver, transmitter, data storage, general instrumentation and logic. Optionally one could use conventional ball drop techniques to actuate sleeves to one position and remote operation (described above) to close; on failure of a sleeve, a CT conveyed tool or shifting tool can override the remote operation, and depending on the triggering signal, sleeves can be actuated substantially simultaneously. In this instance, all sleeves could retain a common actuation code as well as unique individualized codes, even if the common code is rarely or never used.

Flow Monitoring—Instrumented Sleeves

With regards to the obtaining flow data from zones or individual sleeves within a zone, the ability to gain knowledge regarding the type of fluids flowing to and from each stage in a wellbore in a cost effective manner and with minimal well intervention allows an operator to direct and optimize the flow of fluids therethrough. Sleeves outfitted with cost effective instrumentation having the ability to measure and record information used to imply flow and to communicate the information either in memory, such as via coiled-tubing conveyed tools, or in real time mode, through a variety of transmission means, to surface provides the knowledge to do so.

Example of Flow Instrumentation for Use with Non-Ball-Drop Sleeves

Figure 23:
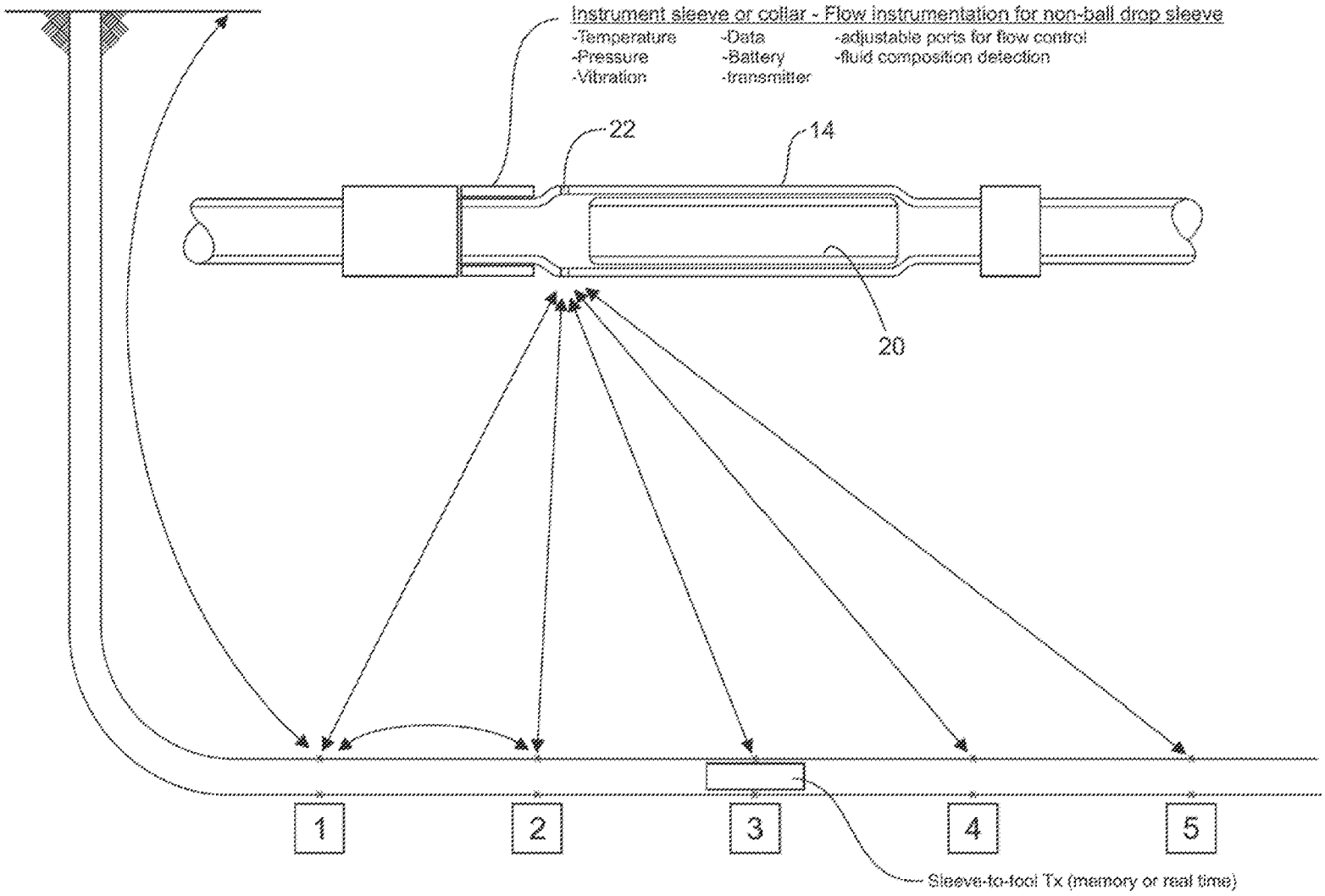
FIG. 23 illustrates communication of downhole data to surface including storing data at each stage and wirelessly communicated to surface or between stages to a single stage and from the single stage to surface.

With reference to FIG. 23, instrumentation to measure various parameters useful in determining fluid flow may be added to sleeves which are not actuated by ball-drop, such as coiled tubing actuated sleeves in various forms. The instrumentation may be added to the sleeve, such as in an independent collar, as integrated components of the sleeve themselves or as stand-alone components located near the sleeve but separate therefrom.

The instrumentation package added to the sleeve may incorporate components or sensors which measure one or more of the following, or additional, characteristics which provide information useful in determining fluid and flow characteristics.

Temperature—changes in temperature are commonly used to detect flow. The rate of inflow and outflow in a well generally provides an indication of where a flow point may be. In a water flood situation, where some wells are used as injectors, the fluid moving from the injector well to the producing well can be exposed to temperature variations which may also be affected by the rate of injection. For example, if cold fluid is pumped from surface down one injector well to a series of sleeves therein to exit the sleeves for travel to another well, the flow of the fluid may be detected by some level of temperature variation over time, such as by instrumentation at the other well.

Pressure—pressure changes measured at a point of injection or production in a well, such as at a particular sleeve, may indicate inflow or outflow at that point in the well. Pressure differential between the outside of a sleeve port and the inside of the sleeve port may also be used to determine flow. Pressure measurement for determining pressure differentials at a single stage or from stage to stage must be very accurate. Pressure gauges may be calibrated using temperature at the same stage for calibration of the pressure strain gauges to improve accuracy of pressure measurement.

Vibration—measurements of vibration variance may be used to determine flow, whether laminar or turbulent or both, at an injection/production point in a well.

Composition detection—various composition detection sensors, for example optical sensors, sensors which measure dielectric constants or nano-chemical technologies, such as those using gold nanoparticle chemiresistors, and the like, may be incorporated to differentiate between water and oil, to further assist in delineating the type of fluid that is flowing and where the flow is occurring. Direct flow detection sensors—sensors are available in a variety of different industries to directly detect or measure flow and may be adapted to be utilized in embodiments taught herein, with or without measurement of other variables such as pressure or temperature, as required.

Instrumentation Package Components:

Sensors as discussed above are provided. A power supply such as a hard line power supply, which is generally more expensive, or a battery system, which must be cost effective and designed to last for years. Data acquisition components include: real time data transmission to surface is ideal because no well intervention is necessary to pre-determine what stage or stages may need to be closed or opened to direct or control flow; real time, hard-lined—requires at least one data cable which extends from surface and is operatively connected to each sleeve and which is typically expensive; real time radio frequency (RF), electromagnetic (EM), acoustic or sonic data transmission, for example, may be cost effective. If data at multiple stages is being recorded, in one embodiment the data is stored at each stage, for example stage 1 to stage 5 as shown in FIG. 1, and the data is wirelessly communicated to surface or between stages to a single stage and from the single stage to surface.

In other embodiments, the data is stored downhole and is retrieved stage by stage or from one stage to which all the other stages communicate for real time communication to surface, such as via a coiled tubing tool, requiring intervention. Real time data is retrieved using a wireline or a tool that downloads data at every stage and conveys the data to surface, such as through electrically-enabled coiled tubing, for example IntelliCOIL™, such as taught in U.S. Pat. Nos. 8,567,657, 8,827,140 and US published application 2014/0345742 all to Andreychuk, each of which is incorporated herein in its entirety.

Such embodiments require intervention to the well to retrieve the data in real time, however such intervention is generally required anyway, such as to shift the required sleeves open or closed. In embodiments, data stored downhole from each stage is transmitted in real time to surface through means capable of obtaining the downhole stored data deployed in a bottom hole assembly, such as a shifting tool, deployed on the IntelliCOIL™ or other electrically-enabled coiled tubing, used to shift the sleeves open or closed. The data is then transmitted to surface through the electrically-enabled coiled tubing and is analyzed in real time to make decisions to close or open each sleeve using the shifting tool to control/optimize flow based upon the data retrieved from the sensors in the instrumentation package in the same run.

In embodiments, the bottom hole assembly is a pump-through assembly, such that debris entering the well at each stage/sleeve port is cleared from the well therethrough as the bottom hole assembly advances into the well. Thus, the economics of the operation is enhanced by cleaning the wellbore, obtaining data and interpreting the data to make decisions regarding opening and closing the sleeve ports at each stage and opening and/or closing the sleeves, in a single trip.

Alternatively, if electrically enabled coiled tubing or wireline capable of transmitting data to surface is not used, the data is retrieved from each sleeve in memory mode, and the tool which retrieves the data is tripped to surface to download the data from each of the instrumentation packages sensors to determine what sleeves require opening or closing. Thereafter, a sleeve shifting tool is run-in-hole (RIH) to manipulate the sleeves as necessary to control flow, after the data is interpreted.

The transmitter can comprises 2 way communication options including Stage to stage—each stage has its own unique IP address; Stage to tool—each stage downloads data to a tool, as described above, in memory or in real time; Stage to surface—data transmission to surface is most ideal as it avoids the need for additional intervention in the wellbore. Types of transmitting technology include Radio frequency (RF) transmission; Sonic transmission; Acoustic transmission—generally not strong enough over long distances; Electro magnetic (EM) transmission—limited by depth to costly and expensive; and Mud pulse-while-drilling transmission—which are generally not practical.

Once sleeve instrumentation data is transmitted to surface, it may be processed and made available via the internet. Alternatively the data can be accumulated and retrieved periodically by visiting the well site. Further, various systems are available in the industry today to make data access available from the well site to the internet.

Applicant envisions embodiments wherein conventional sleeves are replaced by ports which are controlled from surface, either to restrict the ports or close off the ports to "regulate" flow at each stage upon determining flow characteristic using instrumentation located in or adjacent each sleeve or port, as taught herein.

Example of Flow Instrumentation for Use with Ball Drop Sleeves

Figure 24:
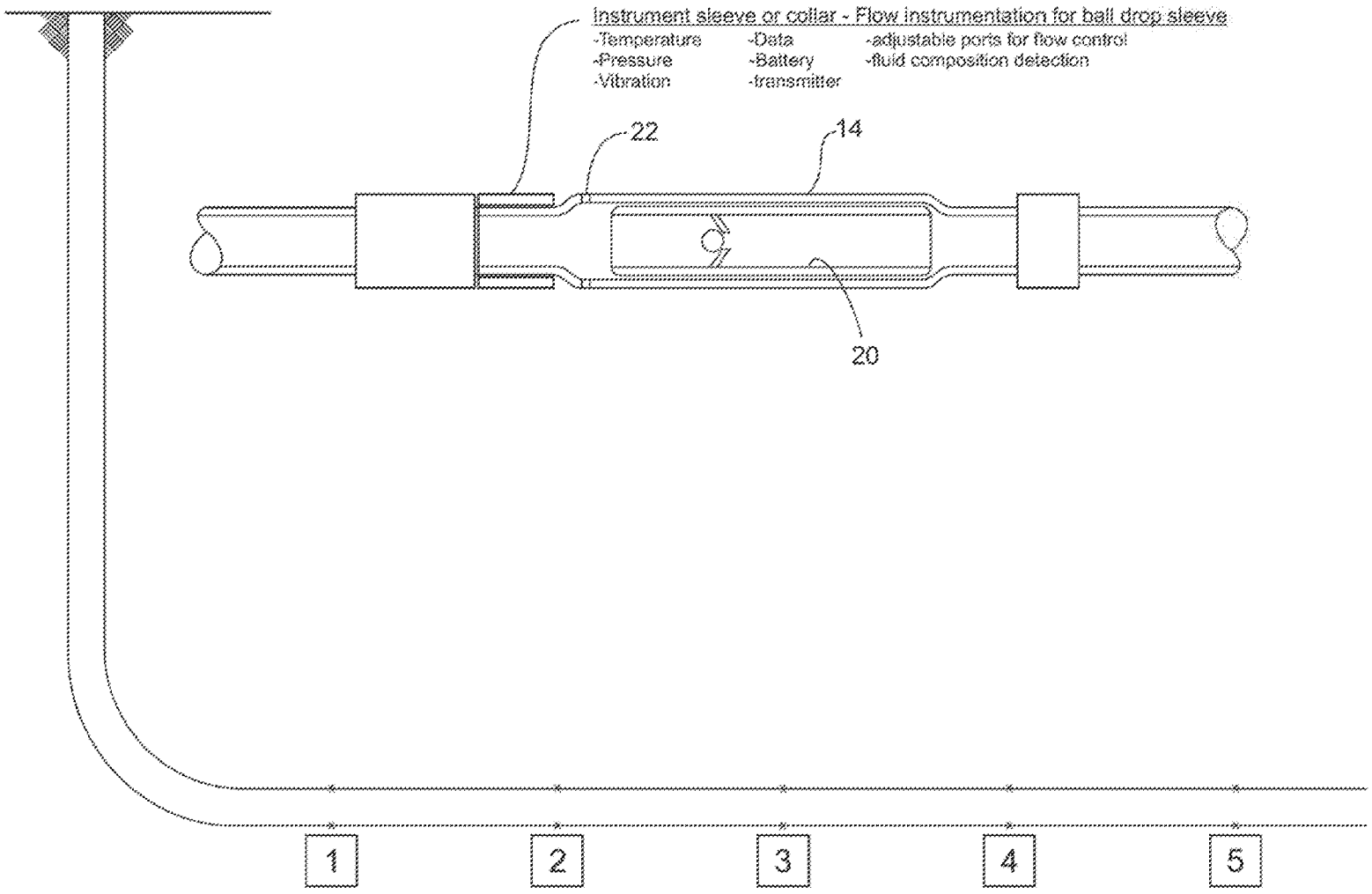
FIG. 24 illustrates collection of downhole data to evaluate stage flow performance and, having been opened by Ball-Drop and subsequently closed using well intervention such as Coiled Tubing.

With reference to FIG. 24, sleeves actuated to open using ball-drop are well known in the industry for use in both cemented and openhole packer configurations. Such systems are available from a variety of service providers, including but not limited to, Packers Plus, Kobold Services Inc. and NCS Multistage.

Ball drop actuated sleeves, opened with balls, are shifted to close using coiled-tubing deployed shifting tools with or without drilling out the ball seats, depending on the outer diameter of the closing tool and the inner diameter of the ball seats in the sleeves.

Instrumentation is added to ball drop sleeves as taught herein for the sleeves opened and closed using coiled tubing. The instrumentation is used to infer flow at every stage for the purpose of flow management decisions. After the flow data is analyzed to determine the appropriate course of action, the sleeves, opened by ball-drop, are then manipulated, if required, using the coiled tubing shifting tool.

Additional flexibility is provided when sleeves can be operated remotely as described above.

Example of an Ideal Reservoir Flooding Scenario

Figure 25:
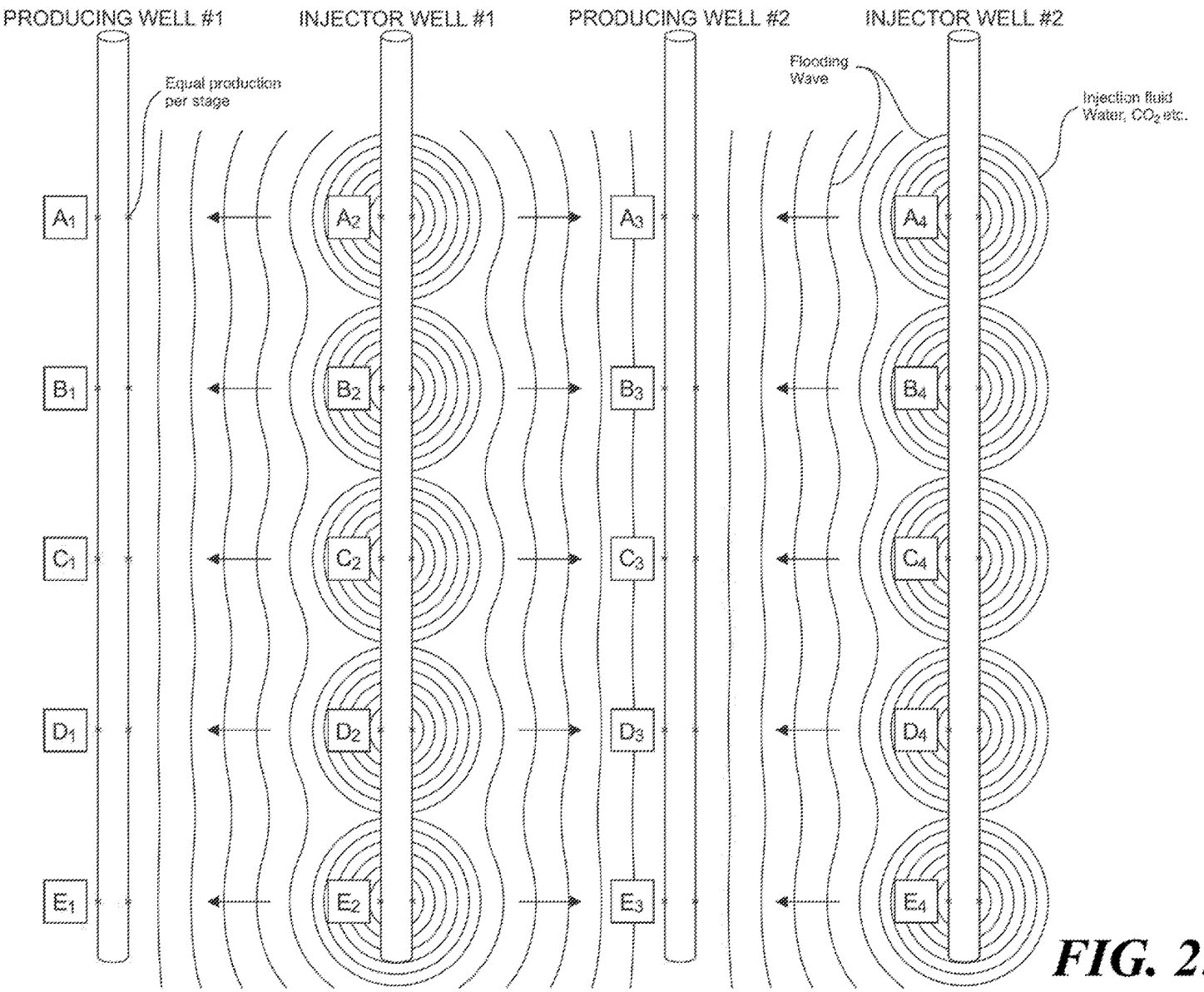
FIG. 25 is an elevation of horizontal wells in a field where fluid flooding, whether water, gas or chemical is applied having a generally uniform displacement.

With reference to FIG. 25, a plan view illustrates horizontal wells in a field where fluid flooding, whether water, gas or chemical, is contemplated. Ideally, fluid is injected into wells, which are designated as injector wells, at surface. The fluid escapes the wellbore through various perforations and open sleeves, either ball-actuated or coiled tubing actuated, to enter the formation. The fluid entering the formation develops a fluid sweeping front to sweep oil out of the formation and to the producing wells.

Reservoir flooding is dependent on many variables, such as the permeability of the formation. Not all formations can be flooded, but in those that can, flow management is a very important tool to maximize production of oil from a formation.

Flooding is often much more economic than drilling new wells and fracturing. The life of an oil reserve can be extended for fields accessing the reserve, if the oil can be effectively displaced out of the reservoir, especially in low pressure formations.

Porosity in a reservoir largely determines the effectiveness of a fluid flooding operation, whether it be a water, gas or chemical flood. While geological mapping can be performed between horizontal wells in a horizontal reservoir to model reservoir drainage, such modelling is not a reliable means by which the fluid flood can be managed as variables are constantly changing.

Use of embodiments taught herein provide ongoing real time or memory mode measurements which enable effective management of the fluid flood in an efficient, cost effective manner.

Example of a Non-Ideal Reservoir Flooding Scenario

Figure 26:
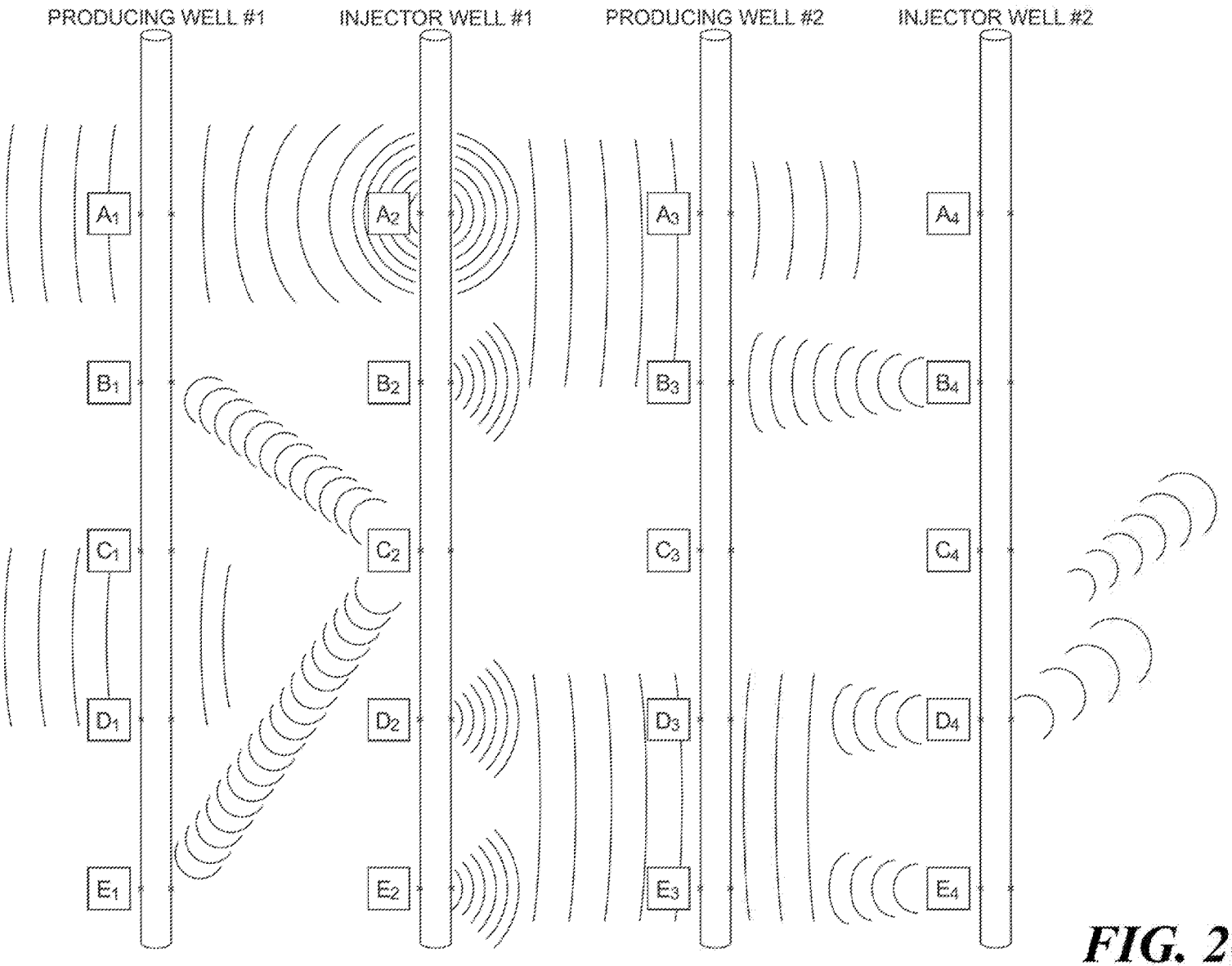
FIG. 26 is an elevation of horizontal wells in a field where fluid flooding, whether water, gas or chemical is applied having a non-ideal displacement scenarios.

With reference to FIG. 26, reservoir flooding may be exposed to irregular fluid movement throughout the reservoir. In this scenario, water production may present prematurely at some stages in a producing well compared to other of the stages, typically referred to as early water production. Early water production at only some of the stages will result in an increase in the overall water production in the producing well and acts to decrease the economics. Illustrated are some of the more relevant, non-ideal scenarios of the many possible, non-ideal flow scenarios.

Fiber-Optic Embodiment Used for Flow Control and/or Fracture Imaging

Fiber optic line run on the outside of wellbore casing or inside coiled tubing, such as IntelliCOIL™ may be used for flow detection as described above and/or for imaging of fractures during a fracturing operation, such as described in US Published patent application 2015-0075783 and in U.S. patent application Ser. No. 14/405,609, filed as a 371 application from PCT/CA2013/050441, each of which is incorporated herein by reference in its entirety.

In embodiments, the fiber optic line can be installed on the outside of casing permanently. During a multistage coiled tubing fracturing operation, a Frac Imaging Module (FIM) taught in US Published patent application 2015-0075783 and in U.S. patent application Ser. No. 14/405,609, both to Kobold Services Inc., could be attached to the coiled tubing fracturing tools. Using the FIM, in combination with the fiber optic line for noise cancellation as described in the aforementioned patent applications, fracture imaging before, during and after the fracturing operation can be recorded.

Fracture imaging can also be done in memory mode by running conventional coiled tubing with mechanical fracturing tools and an FIM. The FIM is tripped to surface to recover the data. Fiber optic data used for noise cancellation can be recorded in real time, but cannot be merged with the FIM data until the FIM tool is at surface.

In embodiments, electric wireline or fiber optics in coiled tubing or IntelliCOIL™ is used and hard-wired directly to the FIM tool or to an electric fracturing tool for real time data transfer for fracture imaging in real time. RF, EM, acoustic or some other type of wireless communication maybe used instead of hard-wired fiber optics or electric line, however the data transfer rate from these technologies may be somewhat limited.

Permanent installations of fiber optic on the outside of the casing or installation of fiber optic inside the coiled tubing in a temporary or permanent configuration could be utilized for both fracture imaging as described herein and stage flow monitoring using vibration and/or temperature monitoring.

During the life of the well, flow monitoring, initial fracture imaging and imagining during re-fracturing may be done with fiber optic in either permanent or temporary installations. During re-fracturing of the well at a later date, for example with permanently mounted fiber optic on the outside of the casing, the re-fractured stage(s) may be imaged. Thus, the operator is provided with imaging not only of initial fractures, but of any fractures created in the well over the life of the well. The ability to utilize the fiber optic installation for flow monitoring, as well as fracture imaging, may make the overall economics of fiber optic, whether permanent or temporary, more attractive.

Communication Systems for Tool Actuation

In embodiments taught above, remote actuation of a tool located downhole is accomplished without coiled tubing and thus, also eliminates the need for a coiled tubing rig and reel trailers, significantly reducing the cost of operation.

Signals are communicated, at least from surface, to actuate remote operated tools located in a wellbore, as described above. The signals are communicated to the tool actuator to operate the tool as desired. Further, as described, communication systems do not require two-way communication to actuate the tool. Generally, only one-way communication from surface is sufficient for tool actuation.

Embodiments are described herebelow in the context of a remote operated control sleeve (ROCS) of RO Sleeve, however as one of skill understands, the systems taught herein can be used to remotely operate other tools located downhole.

Figure 16:
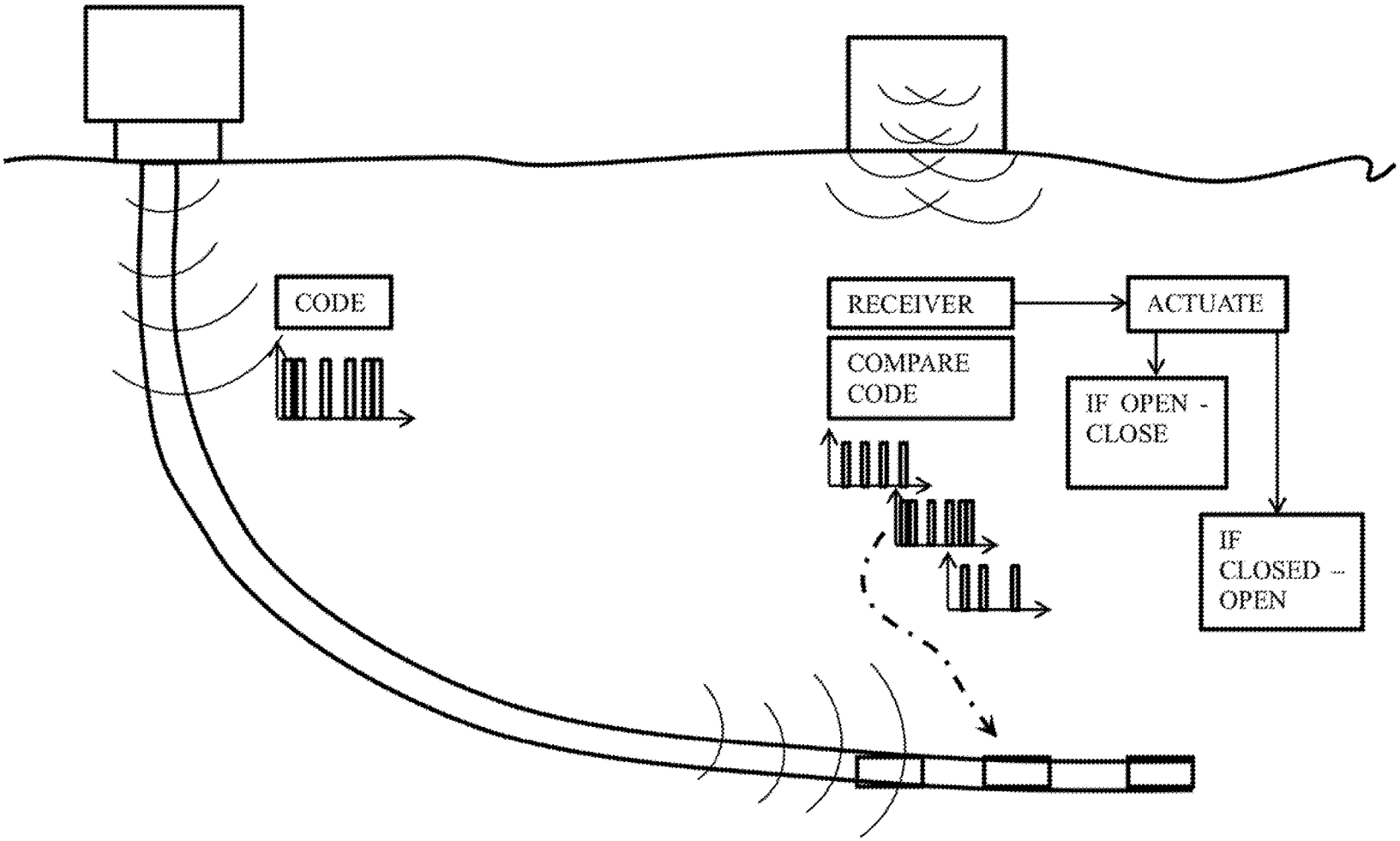
FIG. 16 is a schematic of a wellbore having RO Sleeves installed therein and a coded signal transmission and receiving process for selectively actuating a particular sleeve, the coded signal being wellbore or seismic directed.
Figure 17:
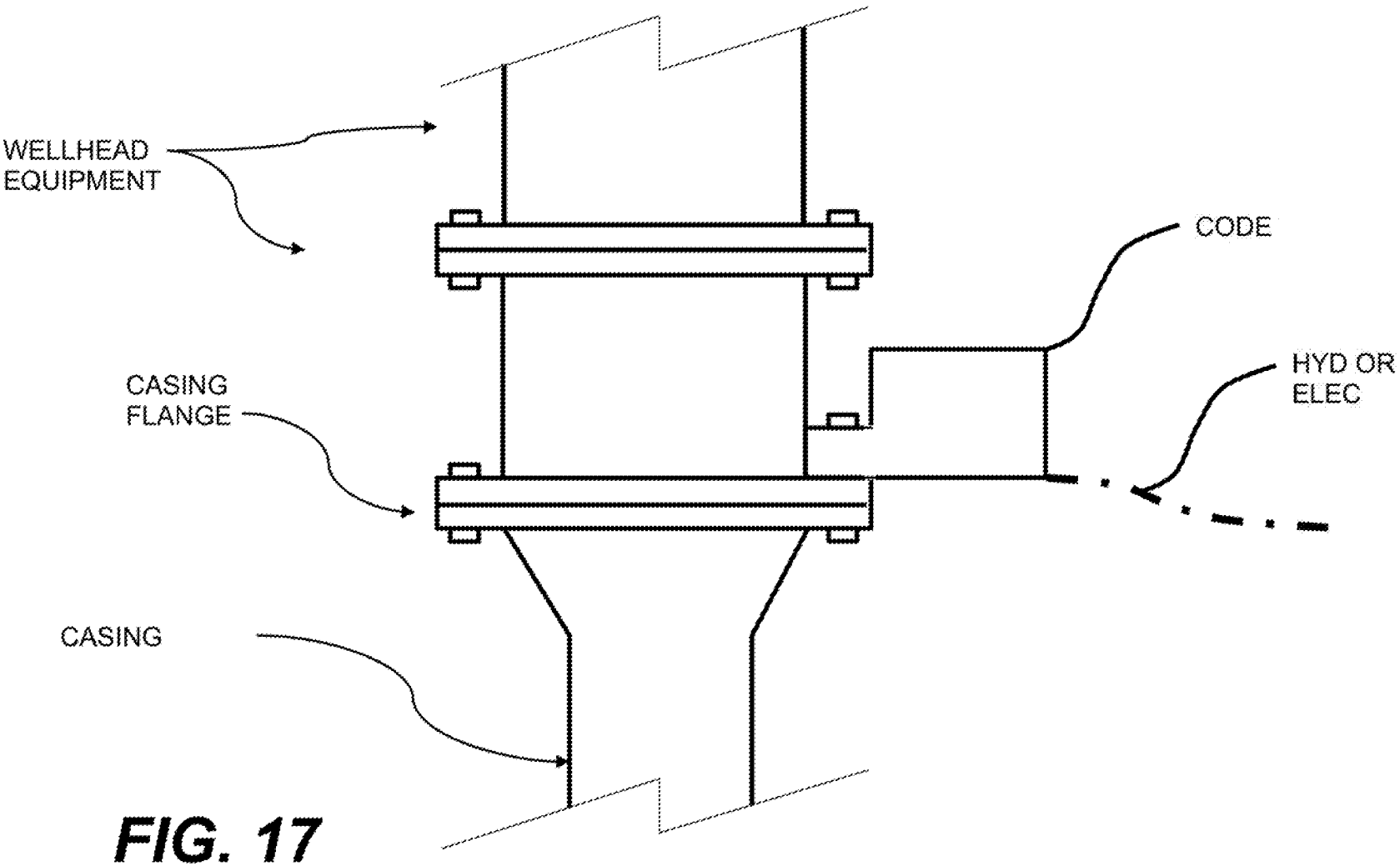
FIG. 17 illustrates a wellhead with a code generator thereon.
Figure 21A:
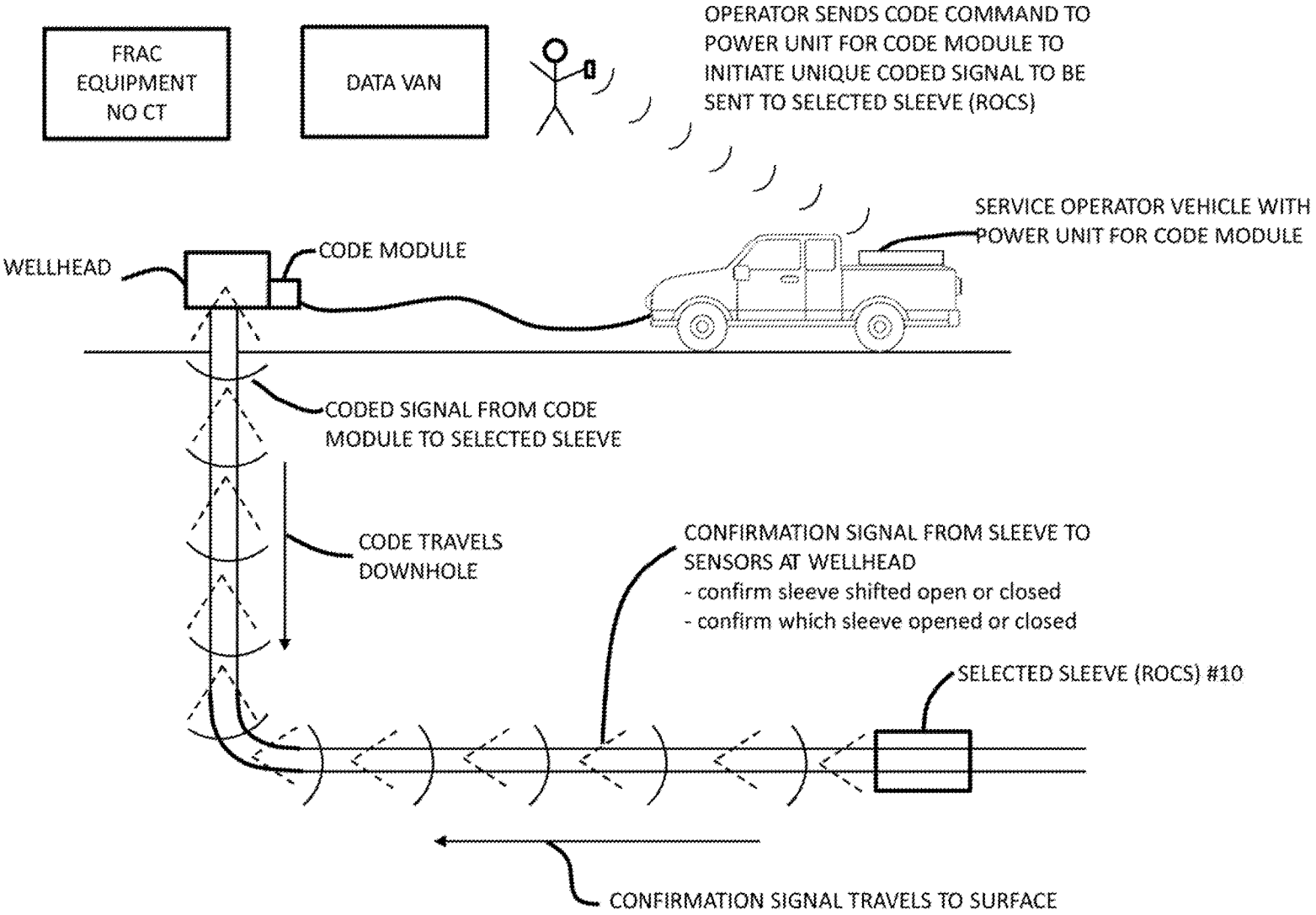
FIG. 21A is a schematic of a wellhead initiated code transmission to one or more downhole RO Sleeves.
Figure 21B:
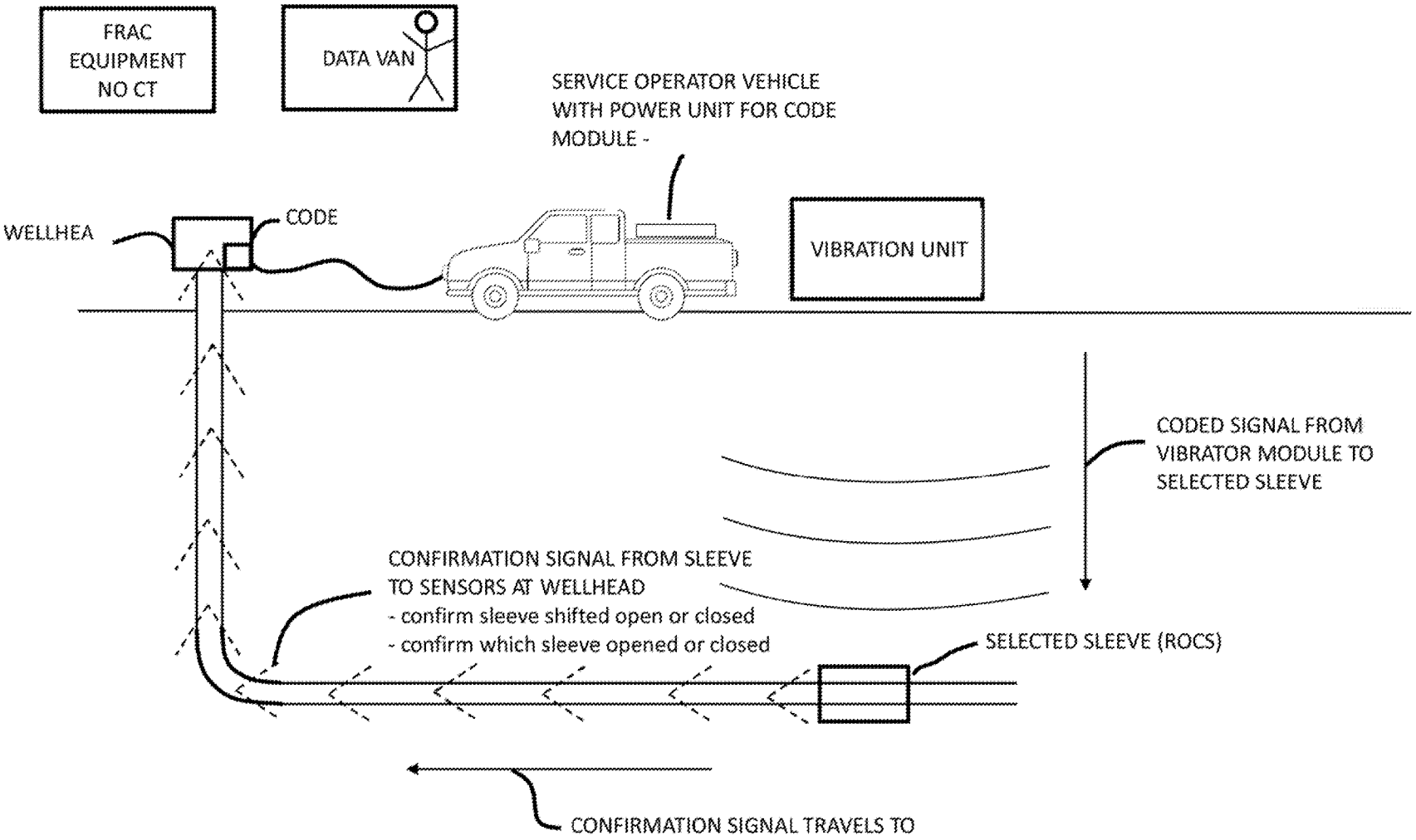
FIG. 21B is a schematic of a seismic or other vibrator initiated code transmission from the surface, spaced from the wellhead, to one or more downhole RO Sleeves.

Having reference to FIGS. 16, 21A and 21B, in embodiments taught herein, Applicant uses the following technologies to send code to the RO Sleeves:

wellhead percussion or impact pulses, wherein apparatus, such as a hammer of a control module shown in FIGS. 16,17, impacts the wellhead in a specific code sequence, the code sequence being transmitted through the wellhead and tubulars connected thereto to the actuator of the RO Sleeve; and seismic communication or vibration, wherein a seismic vibrator shown in FIGS. 16, 21B, is located at surface to transmit a configured sequence of vibrations through the earth to the actuator of the ROCS.

Wellhead Percussion System

As shown in FIG. 17, in embodiments, a control module (CM) capable of applying percussive coded signals is bolted to a wellhead, such as to a casing flange. The CM is powered such as by a cable connected from the CM to a pickup truck located onsite.

Figure 18A:
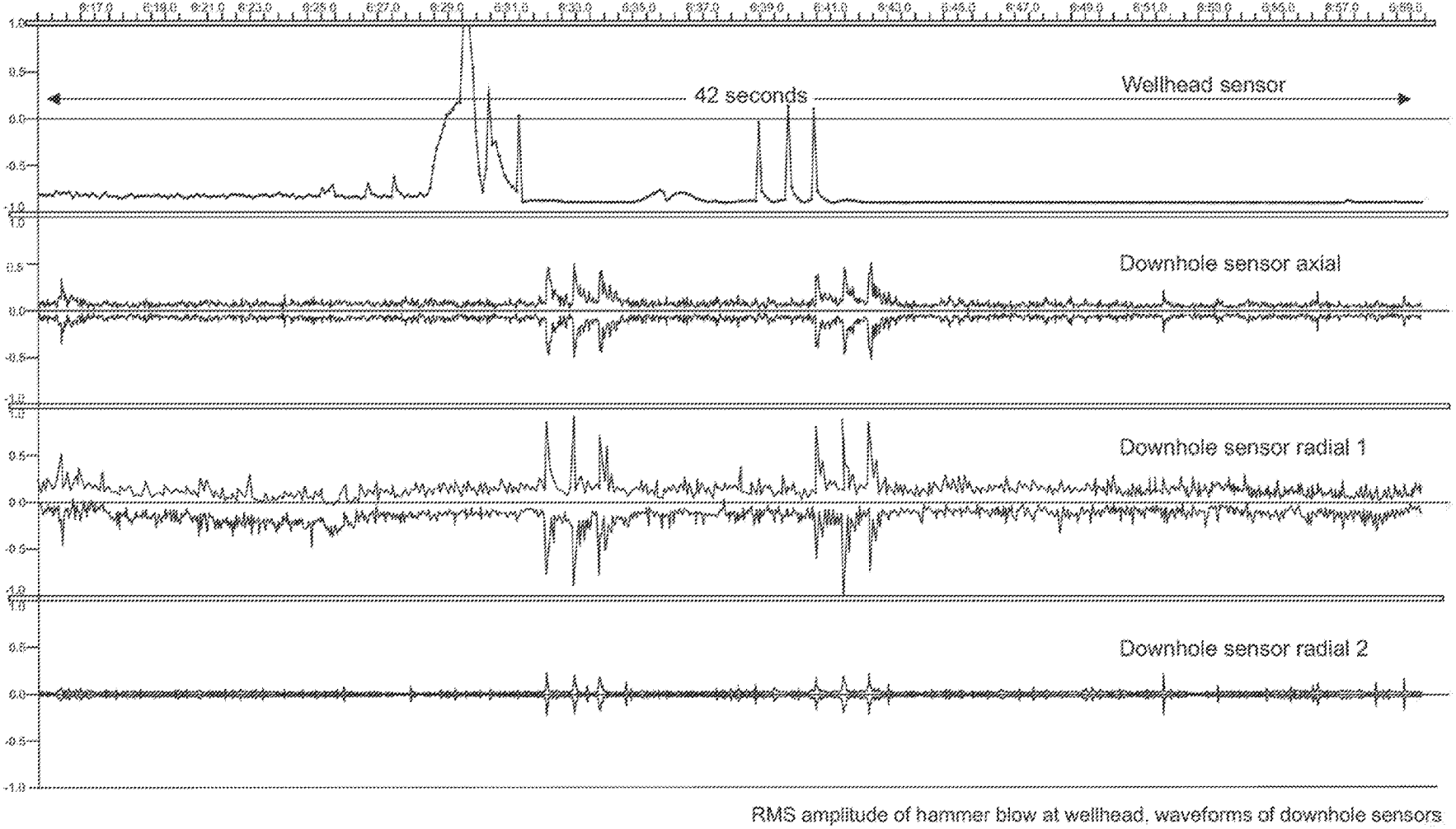
FIG. 18A is a chart illustrating comparative waveforms in the time domain for wellhead and downhole sensors in response to an impact or hammer type of code generator such as that of FIG. 17.
Figure 18B:
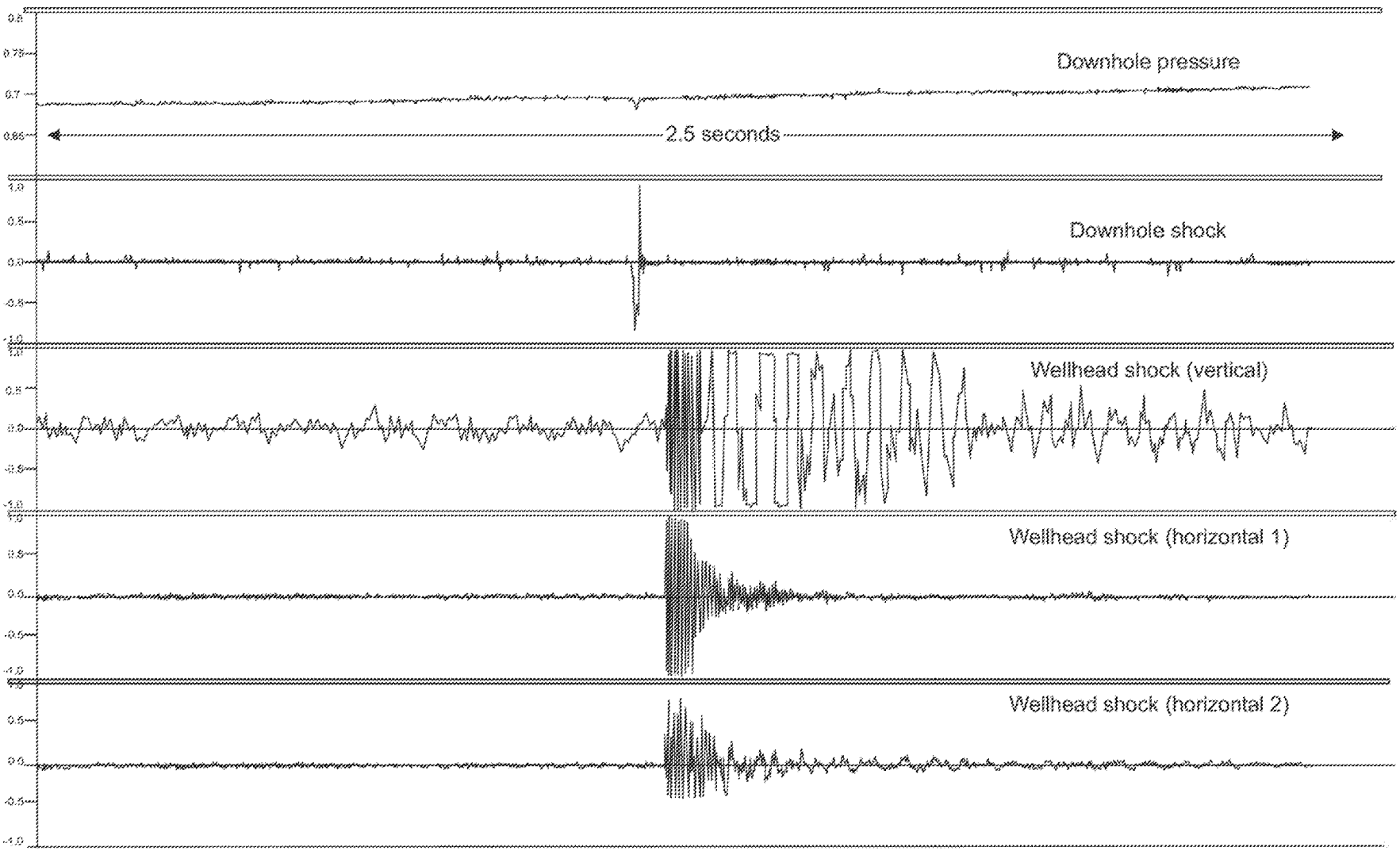
FIG. 18B is a chart illustrating a short time frame of the comparative waveforms of FIG. 18A including a pressure response.
Figure 18C:
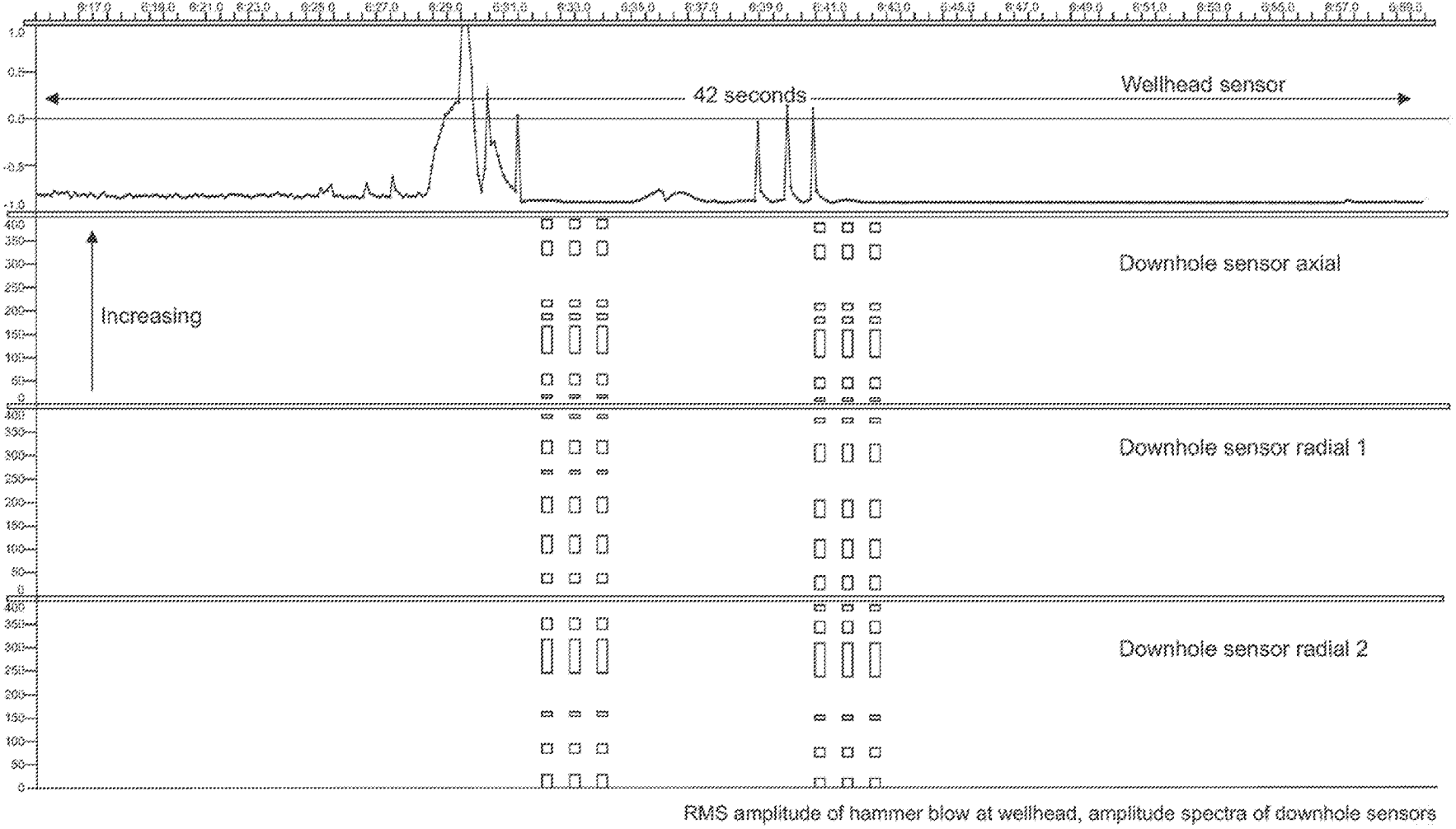
FIG. 18C is a chart illustrating comparative waveform for wellhead and amplitude spectra in the frequency domain for downhole sensors in response to the code generator such as that of FIG. 17 and the coded signal for FIG. 18B.

In operation, a unique pre-programmed code for a specific sleeve is sent manually or through a wireless device such as a cell phone, to a power pack for the CM mounted on the wellhead. The CM power pack powers and sends a command to the CM to percussively send the coded signal downhole through the casing to the specific ROCS. An example of the coded signal send by the CM, as measured by a wellhead sensor and received at the ROCS, as measured by a FIM tool in the wellbore, such as by a Frac Imaging Module (FIM) taught in US Published patent application 2015-0075783 and in U.S. patent application Ser. No. 14/405,609, both to Kobold Services Inc., is shown in FIGS. 18A and 18C. FIG. 18B illustrates a perceptible bump in the pressure when the sleeve shifts, or opens in the this case.

As shown in FIG. 18C, the coded signal is less evident in the FIM data than when cross-correlated to the pattern of the coded signal as shown in FIG. 18A.

The RO Sleeve decodes the signal containing an instruction, such as to open the RO Sleeve. As discussed above, in response to the code, a pilot actuated valve in the actuator, operated by a solenoid, opens to allow wellbore pressure to access the pressure side of the piston, which forces the sleeve open. The opposing dump side of the annular piston discharges or dumps fluid to the main or dump chamber as described above. As previously described, the first actuation causes air to dump into the main chamber, while subsequent actuations cause wellbore fluid communicated from the bore of the sleeve body to dump to the main chamber. The pressure available to shift the sleeve is dependent on the hydrostatic head in the well. For example, if the total vertical depth (TVD) of the RO Sleeve in the well is 1000 m, the available pressure to open the sleeve is 10 mPa, which converts to force when multiplied by the cross sectional area of the annular piston. For an embodiment wherein the main chamber is at atmospheric pressure at surface, the second or dump side pressure is initially atmospheric, however as the RO Sleeve is functioned, the main pressure chamber fills; with air on the first cycle then fluid from subsequent cycles.

The volume of the main chamber is adjustable, to allow for multiple shifting of the sleeve through the life of the well during the fracturing stage and early production years. The cycle life of the RO Sleeve is dependent on the negative pressure volume and the battery life of the batteries powering the RO Sleeve.

Overall, power conservation is a key concern with implementation of RO Sleeve technology. Programming and efficient circuit board manufacturing are important considerations. In embodiments, time delays, typically clocks which take little power, are added to the RO Sleeve circuitry to allow the RO Sleeve system to sleep most of the time and only look for signals from surface at specified times during the day, week, month or years.

Another issue of concern is noise. Applicant has found that actuating sleeves during pumping is more challenging than when there is no surface or downhole fluid movement.

Figure 18D:
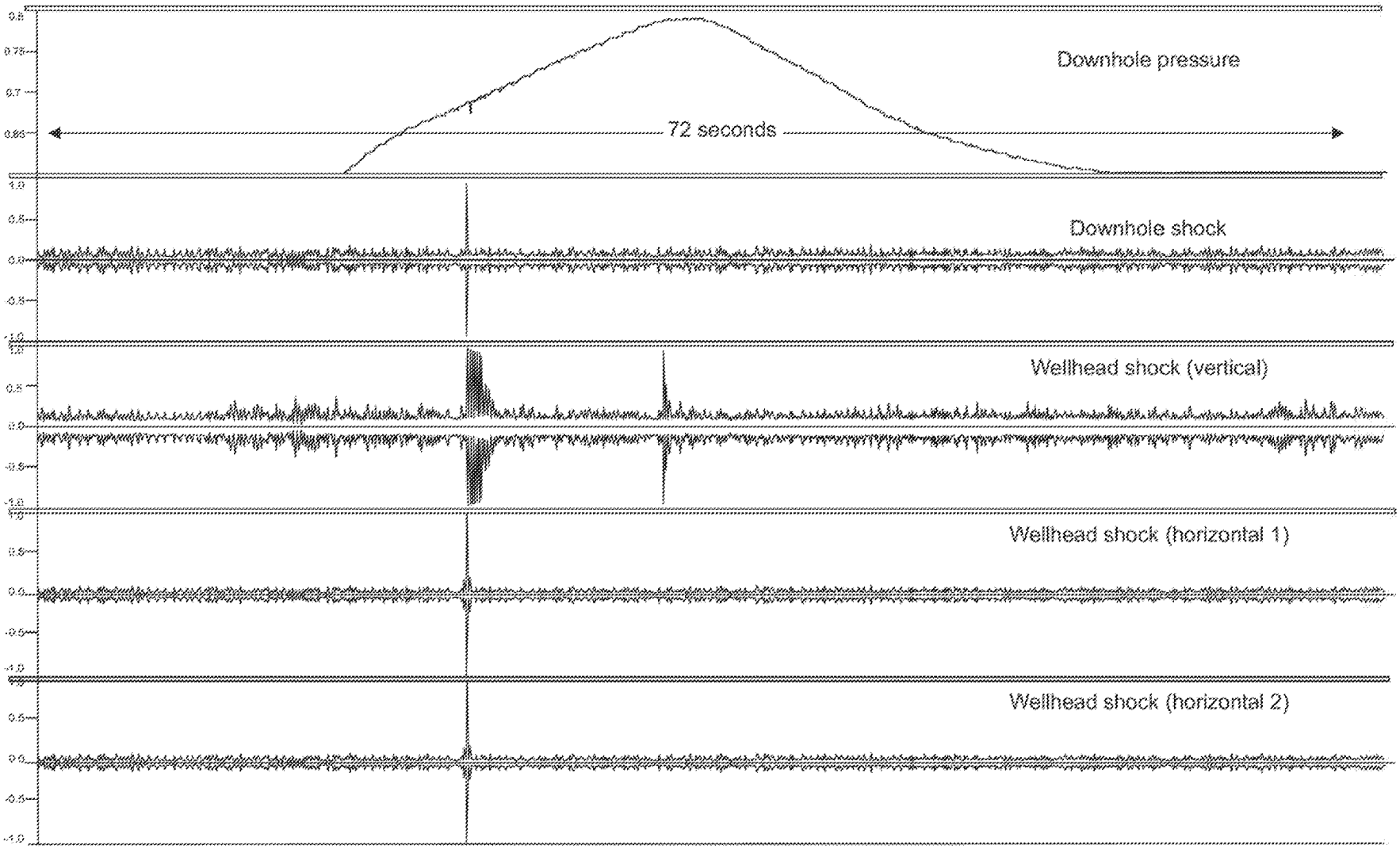
FIG. 18D is a chart illustrating the force of sleeve shifting detectable at the wellhead and in downhole pressure.

When the sleeve shifts, movement of the sleeve is delimited by the length of the cavity. As shown in FIG. 18D, the sleeve, shifted to open ports, shoulders out with significant force to create a shock that is detectable at surface. Shock data, such as measured by sensors on the wellhead, confirms the RO Sleeve has shifted. Because the instrumentation can be designed to have time delays and the speed of travel of noise through steel is known, the time response of the opening of the sleeve is monitored and the position of the sleeve in the wellbore can be calculated. The calculation helps identify that the intended ROCS has been actuated so the correct stage in the well is fractured in the right sequence.

The movement of fluid in the sleeve also affects the time from actuation of the sleeve to the time of impact when the sleeve shoulders out on the sleeve body, indicating opening or closing of the sleeve. The volume of fluid to actuate the sleeve however is so small the time for fluid movement to actuate the sleeve can be accounted for.

Once the sleeve is open, fracturing may commence.

After the frac has been pumped, pressure is maintained on the well. The ISIP (instantaneous shut in pressure) is determined and the RO Sleeve may be closed to prevent fracture fluids which have just been pumped into the stage from entering or flowing back into the wellbore. This practice, called "allowing the frac to heal" is desirable as the sand pumped into the reservoir at the stage stays in the reservoir vs flowing back in the well. Generally, time is needed for the gelled fluids, used to carry the sand into formation during fracturing, to reduce in viscosity or "break" to allow the fluid to flow back into the wellbore without carrying the sand.

When the RO Sleeve is shifted in the opposite direction to close ports, the sleeve shoulders out within the cavity and once again makes an impact, which again can be detected at surface. The position of the closed sleeve can once again be calculated confirming the desired sleeve was actuated to shift to close ports.

RO Sleeves can be opened or closed in any sequence in the wellbore, which may be advantageous to prevent a stage being frac'd from fluidly communicating with stages which have been frac'd above or below the stage being fractured. An operator may choose to frac a stage that is located more than one stage away from the stage just frac'd to prevent communication from happening. Spacing out the fracturing of the stages may be critical for optimizing the contact area of the reservoir to the wellhead. If the frac'd stages are too close, an operator may run the risk of fluid communication therebetween. If the frac'd stages are too far apart an operator may run the risk of bypassed pay in the well.

Further, when a stage is frac'd, the stress regime in the rock is changed and, if that fracture is depressurized, the next frac tends to flow in the direction of least resistance and may become in fluid communication therewith.

Many stages of fracing can be performed with the RO Sleeve system. The RO Sleeve system has the following advantageous over all other systems in the industry:

1. Unlimited stages;
2. Full bore ID matches the casing ID;
3. Cost effective;
4. No well intervention with coiled tubing or jointed pipe during the frac operation;
5. No well intervention with coiled tubing or jointed pipe during the production phase of the well;
6. Frac healing is possible;
7. Flow control during the production life of the well—undesirable fluids, like water, can be shut off at any time without removing or disrupting the production equipment. RO Sleeve can be opened and closed at surface at random until water production stops at surface;
8. No conventional flow control equipment is required to determine where flow is in the wellbore (ie. logging tools, casing patches, cement plugs etc). Well intervention changes the natural flow regime of the well, not the case with RO Sleeve.

RO Sleeves do not have to be closed after a frac, however they can be closed for the aforementioned reasons.

With reference to FIG. 25, RO Sleeves are also important after the frac operation during the production life of the well. When the production equipment is installed, the well generally will find a natural state of flow. When the well is flowing, over time, stage(s) may start producing water from an aquifer in which they are in fluid communication or from an injection well in a water flood field. Generally, regardless the problem, water influx via a stage is at high pressure, reducing the flow of oil from a field. For example a well producing 100 bbls/day oil over time can change to 10 bbls/day oil and 50 bbls/day water which is less economic. By manipulating RO Sleeves from surface without well bore intervention and restoring the well to 100 bbls/day production oil, to close off problem zones, the RO Sleeve system is a very economic methodology. No other frac completion systems in the industry today permit this type of control in the production life of the well.

Only hard-lined systems, where hydraulic lines run down the outside of the casing to each sleeve in a well, or RFID technologies currently exist to permit opening of sleeves during production. Both known technologies are expensive. RFID's require well intervention to some extent. Hard lined hydraulic controlled sleeves are expensive to install and limited as to the number of sleeves that can be used in a particular well.

Seismic Vibration

Embodiments which utilize seismic vibration to provide coded signals to actuate tool operation are substantially identical to those which use wellhead percussion with the exception of the source of the coded signals.

Having reference to FIG. 16, 21B and FIGS. 19A through 19C, a seismic vibrator is towed and positioned at surface adjacent the wellbore. Generally, for practical reasons such as access, the vibrator is positioned on the same leased land as was used to drill and fracture the wellbore.

Figure 19A:
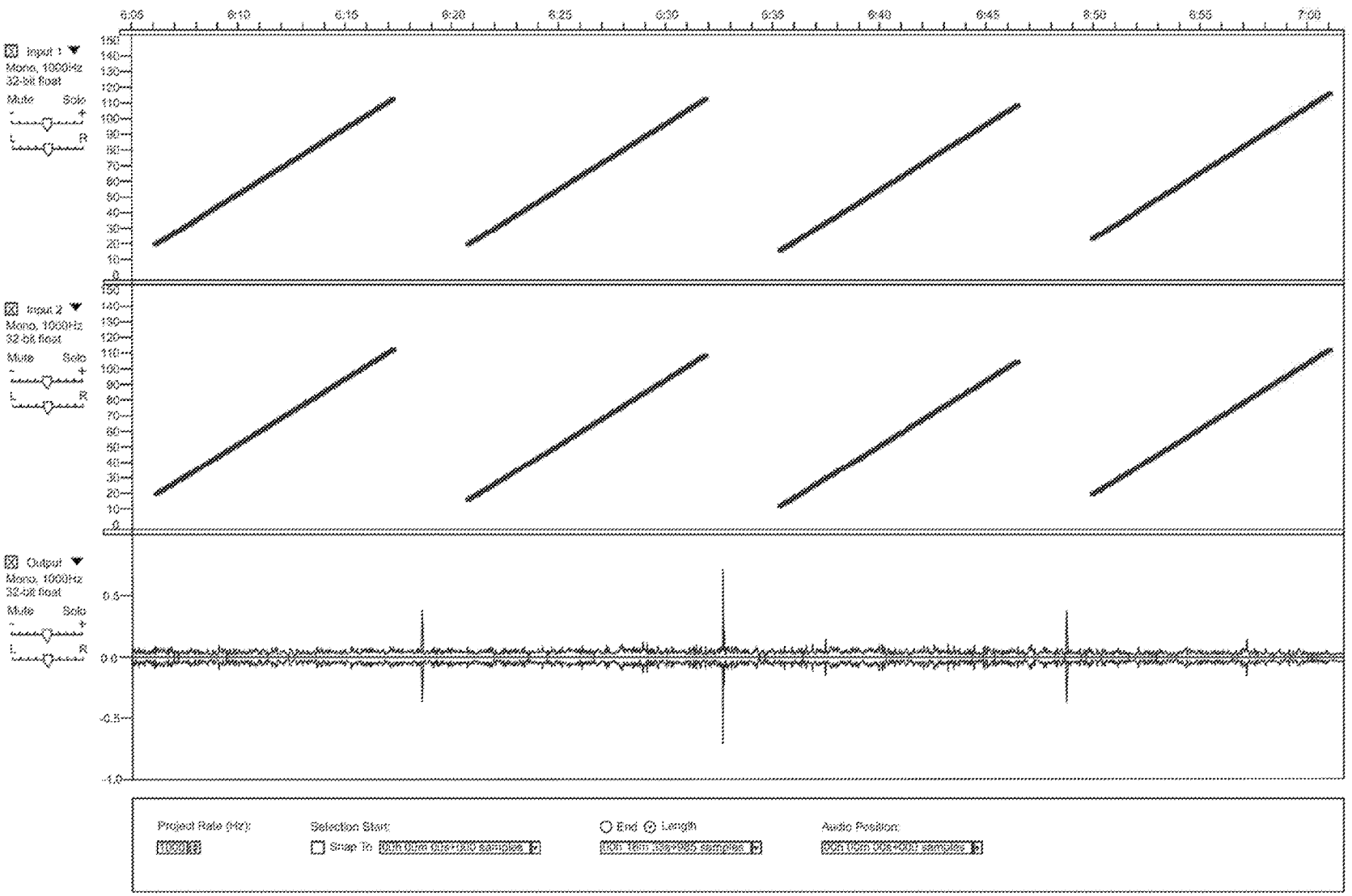
FIG. 19A is a chart illustrating correlation of downhole sensor waveform and signal differentiation in response to seismic vibrations at surface having a burst of vibration having a frequency sweep of about 20 to 120 Hz.
Figure 19B:
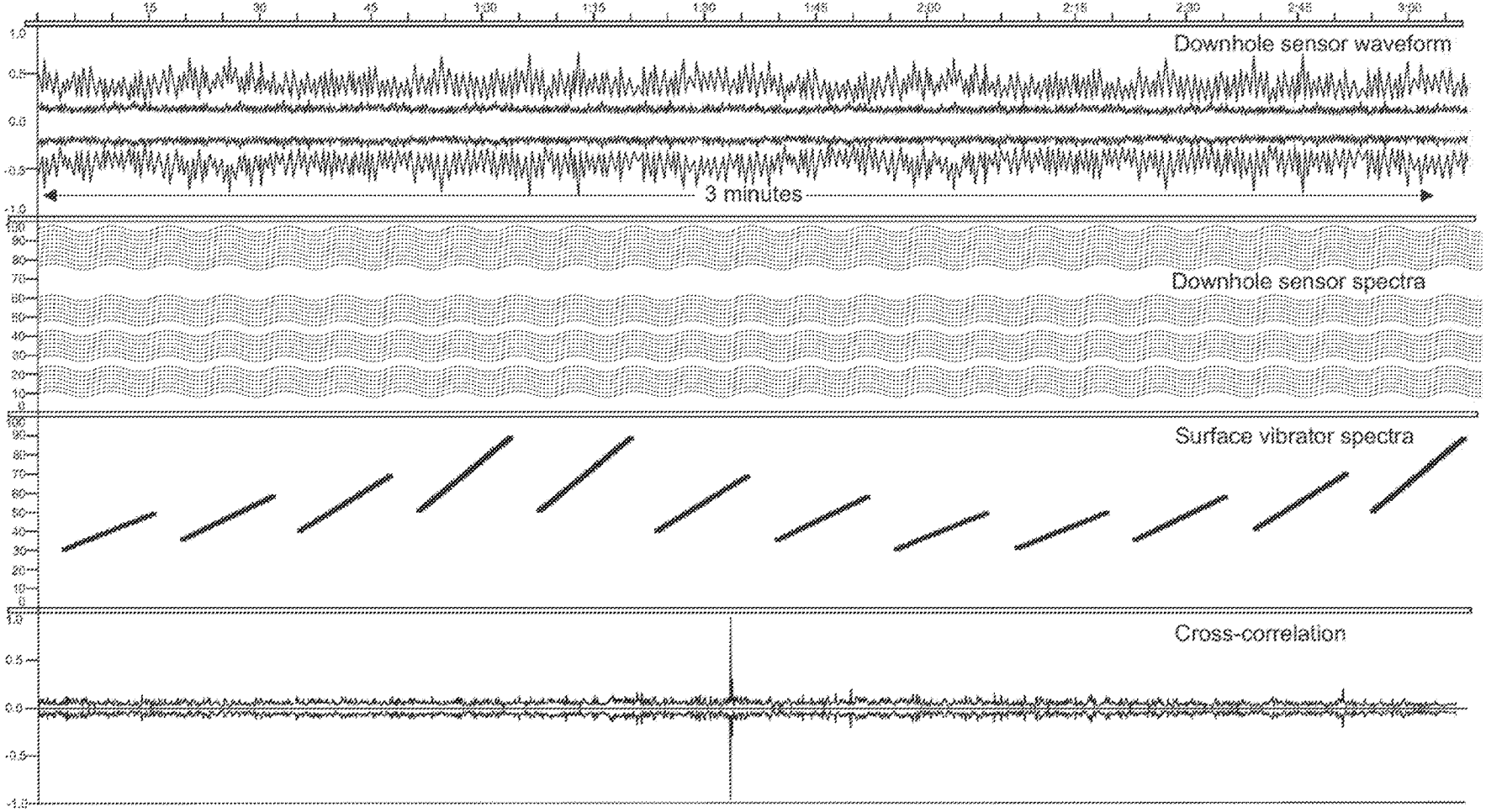
FIG. 19B is a chart illustrating comparative waveforms for surface and for downhole sensors in response to seismic vibrations at surface for a unique sequence of individual and variable frequency sweeps to define, collectively, a unique code distinguishable in a cross-correlation of the time and frequency domain responses.
Figure 19C:
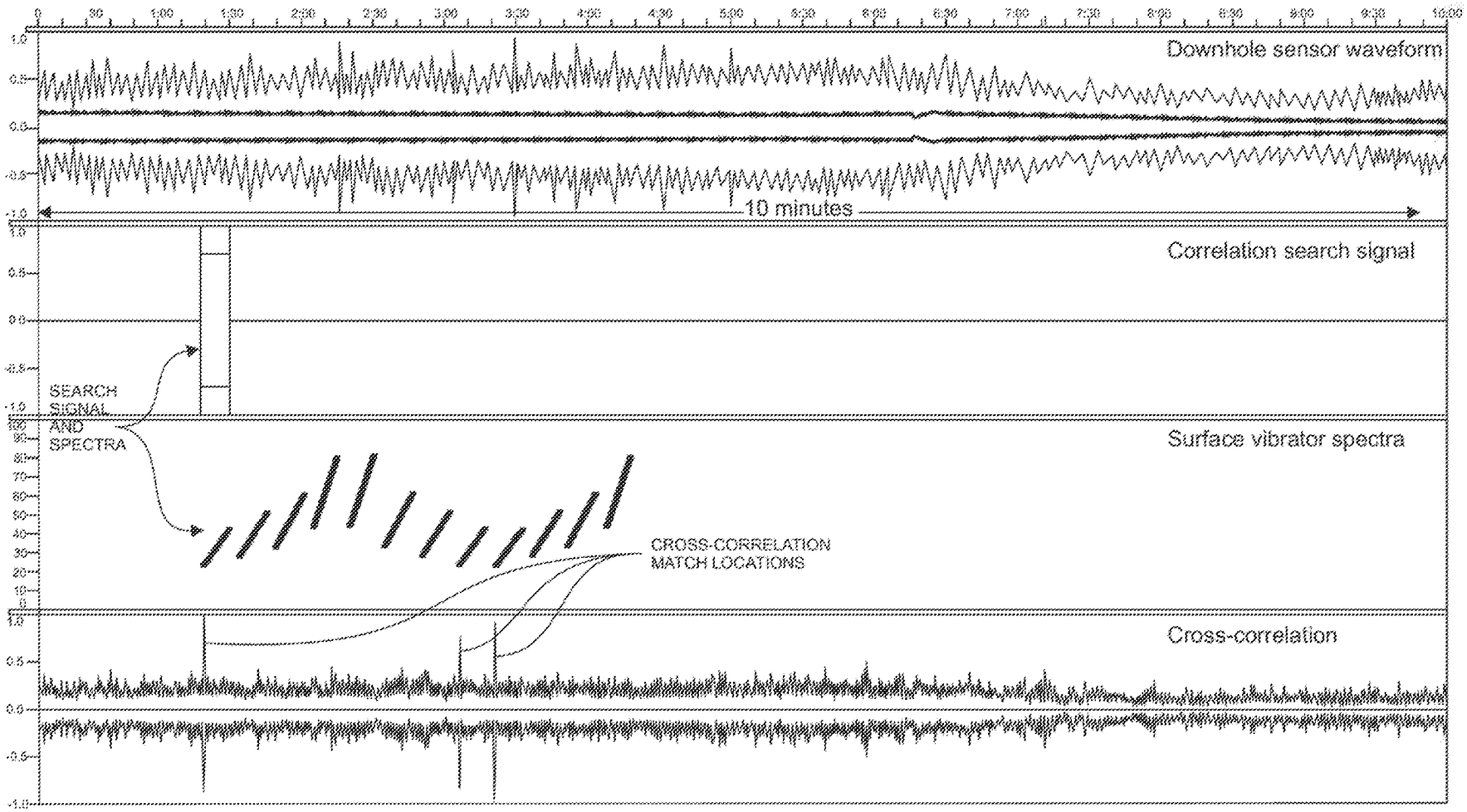
FIG. 19C is a chart illustrating the detection in the cross-correlation data at a downhole sensor for the detection of repeating code defined by a sequence of individual frequency sweeps imparted as surface.
Figure 20:
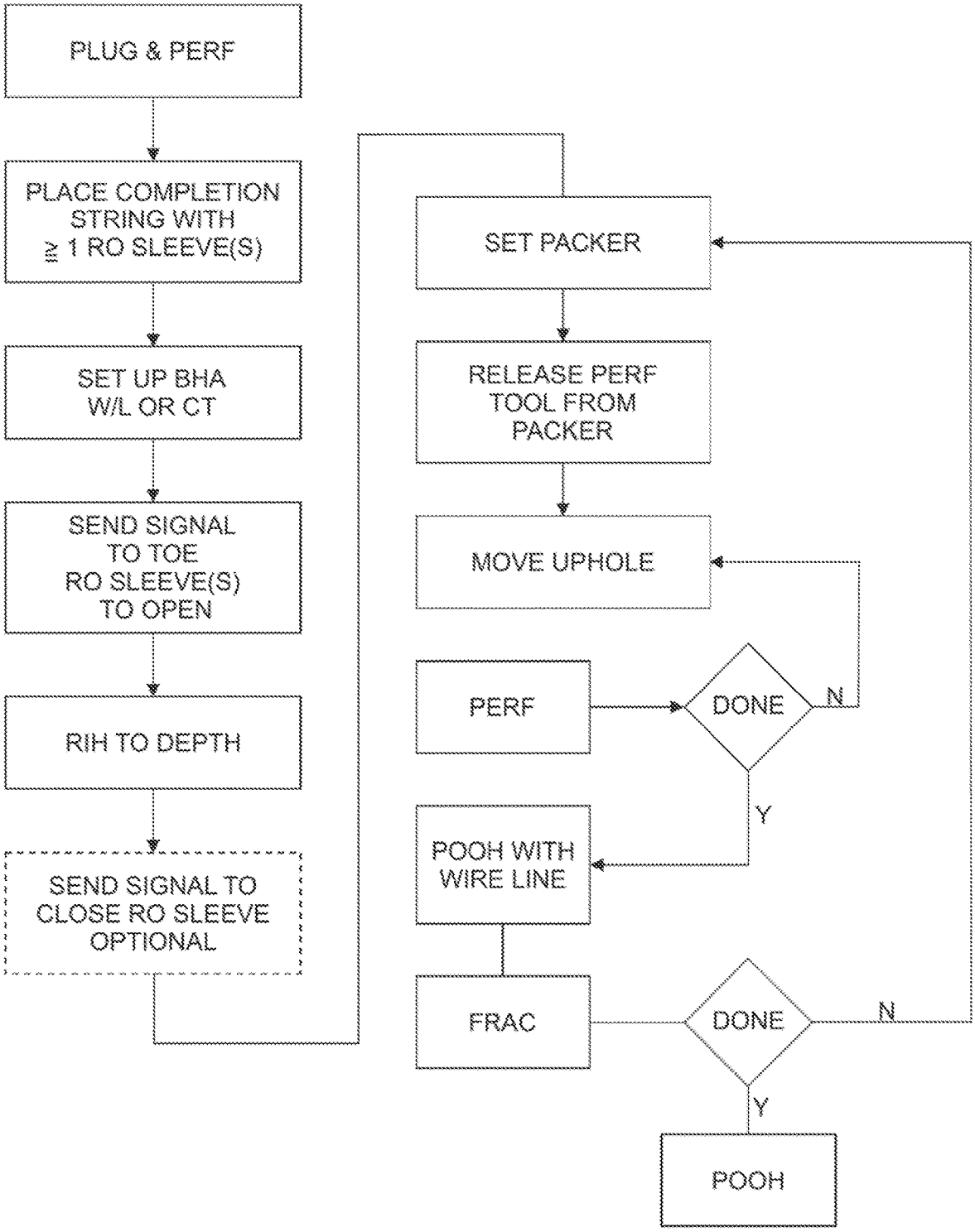
FIG. 20 is a flow chart illustrating one use of an RO Sleeve at a toe of a plug and perf operation.

Examples of coded signals produced by a surface vibrator and detected downhole, such as by the FIM tool, are shown in FIGS. 19A through 19C. The seismic vibrator is used to provide a coded signal as described for opening a sleeve downhole.

The figures demonstrate that a vibratory signal offset from the wellhead is detectable downhole. While the vibrator coded signal not immediately obvious in downhole data, either in the waveform or the spectra, the signal is clear upon cross-correlation.

As shown in the FIG. 19B, the top spectra represents data from one component of the 3-component FIM tool (geophone) used to detect the vibrator signal downhole. The middle spectra represents the vibrator signal and the bottom spectra represents the cross-correlation between the two.

The vibrator signature is obvious in the FIM data however there is a small, and manageable amount of noise.

In FIG. 19C, the vibrator signal is detected downhole using the FIM tool during pumping of the frac. The top frame is waveform data for one component of the FIM tool, the middle frame is the spectra of the vibrator showing a coded signal having four unique patterns repeated three times (1,2,3,4,4,3,2,1,1,2,3,4). The third frame is the particular pattern (pattern 2) being searched for in the FIM data and the fourth frame is the cross-correlation of pattern 2 and the FIM data. While the vibrator signature is not at all obvious in the raw FIM data, it is apparent in the cross-correlation as pattern 2 is detected 3 times corresponding to the three spikes in the cross-correlation.

Shock waves generated by the sleeve shifting open or closed are readily detectable at surface using a 3-component sensor attached to the wellhead. Instrumentation sub pressure sensors located at the RO Sleeve demonstrate a slight pressure drop as the sleeve shifts. The next frame illustrates data from the instrumentation sub shock sensors indicating that the sleeve has shifted and the following three frames illustrate data from the wellhead shock sensor which readily detect the sleeve shift.

FIG. 18B illustrates the effectiveness of the percussion system wherein the shock wave generated by striking the wellhead with the hammer (CM) is detectable with the FIM tool. The top frame shows wellhead sensor data and the following three frames show data from the 3-components of the FIM tool.

Applicant believes that use of seismic vibration may be more robust in noisy environments when compared to wellhead percussion, however seismic vibration may require additional data manipulation such as cross-correlation which requires more battery power which may be a disadvantage. Depending on the application, either wellhead percussion or seismic vibration may be advantageous.

ROCS™ RO Sleeve SYSTEM

FIG. 21A illustrates a system utilizing embodiments taught herein and in particular a percussion system. Advantageously the system eliminates use of a CT rig and CT reel and trailer as used in conventional fracturing operations. The frac iron is hooked up directly to the wellhead. As shown the code module (CM) is added to the wellhead, such as by bolting to the casing flange. A plurality of remote operated control sleeves (ROCS™) are installed in the casing in the wellbore at staged intervals.

Figure 22A:
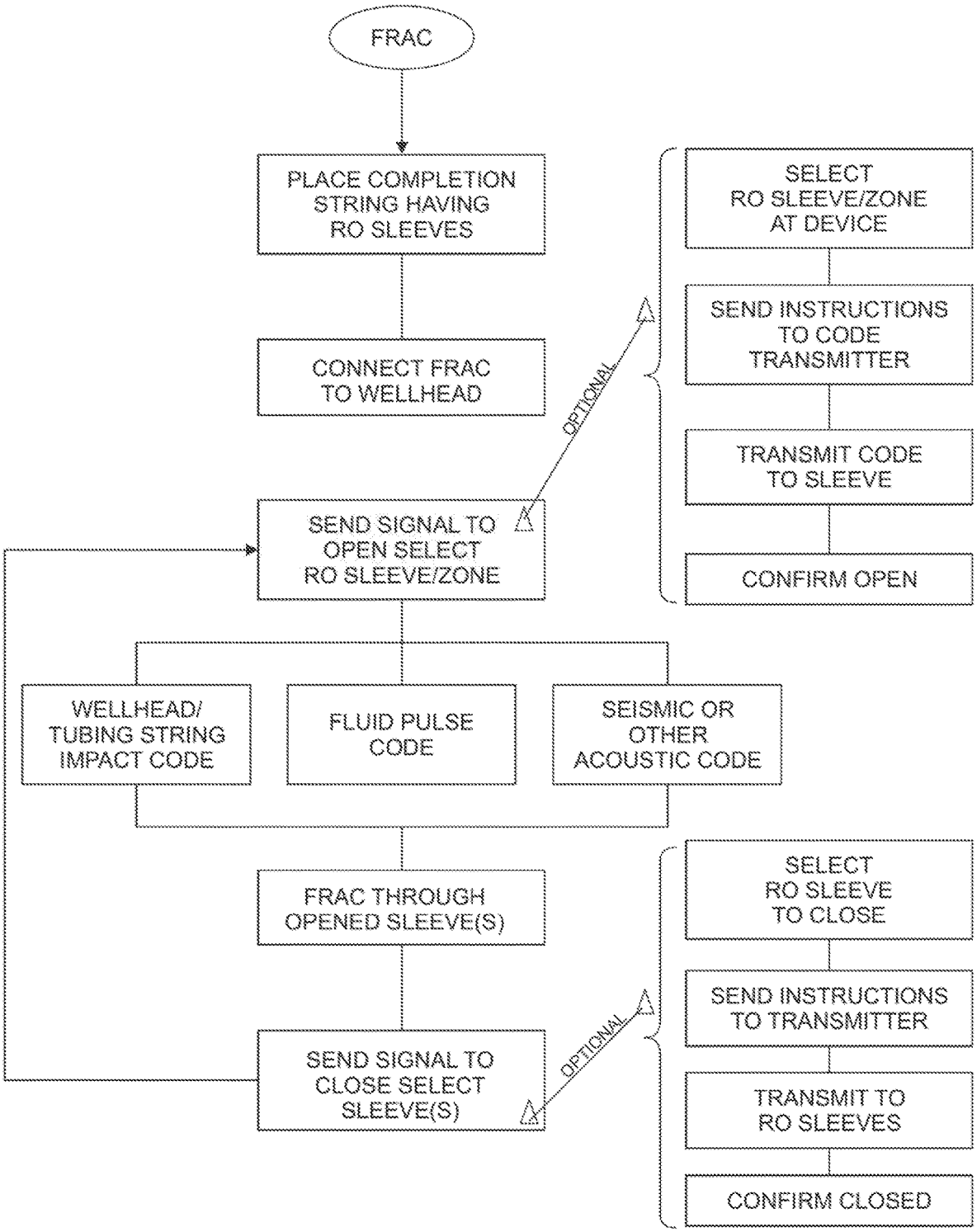
FIG. 22A is a flow chart illustrating one use of RO Sleeves for fracturing without requiring object actuation or coiled tubing to the completion string.
Figure 22B:
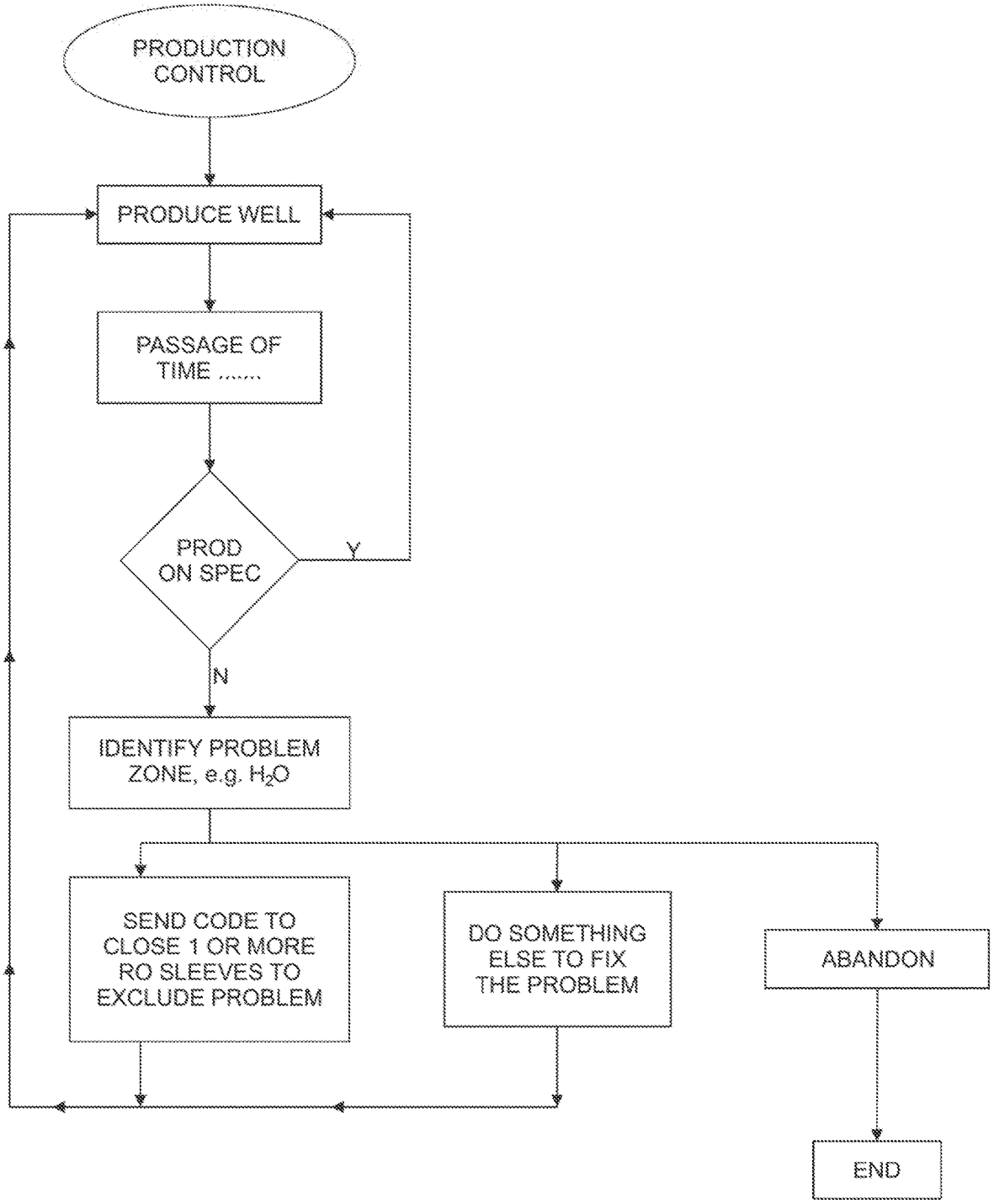
FIG. 22B is a flow chart illustrating one use of RO Sleeves for control of production fluids from a wellbore.

A frac operation using the ROCS system embodiment shown in FIG. 22A. A code is sent from the code module to a ROCS sleeve to open, such as to a sleeve at the toe of the wellbore; The code may be initiated by an operator using a smartphone phone to send a signal to the code module on the wellhead. The operator also receives a confirmation signal from the code module, at the cell phone, that the sleeve has shifted. The code is sent from the operator in a data van to the power unit for the code module which sends a signal to the code module on the wellhead to send the signal to the ROCS sleeve to shift open. The code module sends a confirmation signal to the power unit when it detects the sleeve has shifted and the power unit transits the confirmation signal to the data van.

An actuator module on ROCS sleeve receives unique signal from surface to shift sleeve to open ports. The hydraulic line to shift sleeve is pressurized to open the frac ports. An indication or confirmation is received at surface, such as a shock signal as a result of sleeve shifting, is received at surface, detected by sensors in the control module indicating sleeve has shifted. The control module sends a signal to the operator on the connected smartphone or to the data van allowing confirmation of shifting and calculation to verify intended sleeve was shifted. Once it has been confirmed the sleeve has shifted open the frac is pumped.

Once the frac is complete a signal sent from surface to the actuator module to pressurize hydraulic line to shift sleeve in opposite direction to close the ports, the pumped frac remaining in the formation to prevent the pumped frac fluids from flowing back into the wellbore Again, shifting of the sleeve to close ports creates an impact which is detected at surface by wellhead sensors, such as in the control module. The control module transmits the confirmation of the shifting of the sleeve to close to the operator, either at the cell phone or data van. The confirmation signal allows calculation to ensure it was the intended sleeve that was closed.

After all of the stages to be frac'd have been frac'd, the surface equipment is removed and a pumping system is installed in the vertical portion of the wellbore, such as a pumpjack, production tubing and a bottom hole pump.

Thereafter, an operator hooks a control module to the wellhead and a code or series of codes are sent to all of the ROCS sleeves causing all of the sleeves to shift to open the ports at each stage for the production stage. The pumpjack is started and hydrocarbons are produced at surface.

FIG. 21B illustrates a system as described herein utilizing a seismic vibrator. Operation, with the exception of the source of the signals to the sleeves, is substantially the same as for the percussion system.

Steam Assisted Gravity Drainage/Steam Applications

Figure 27:
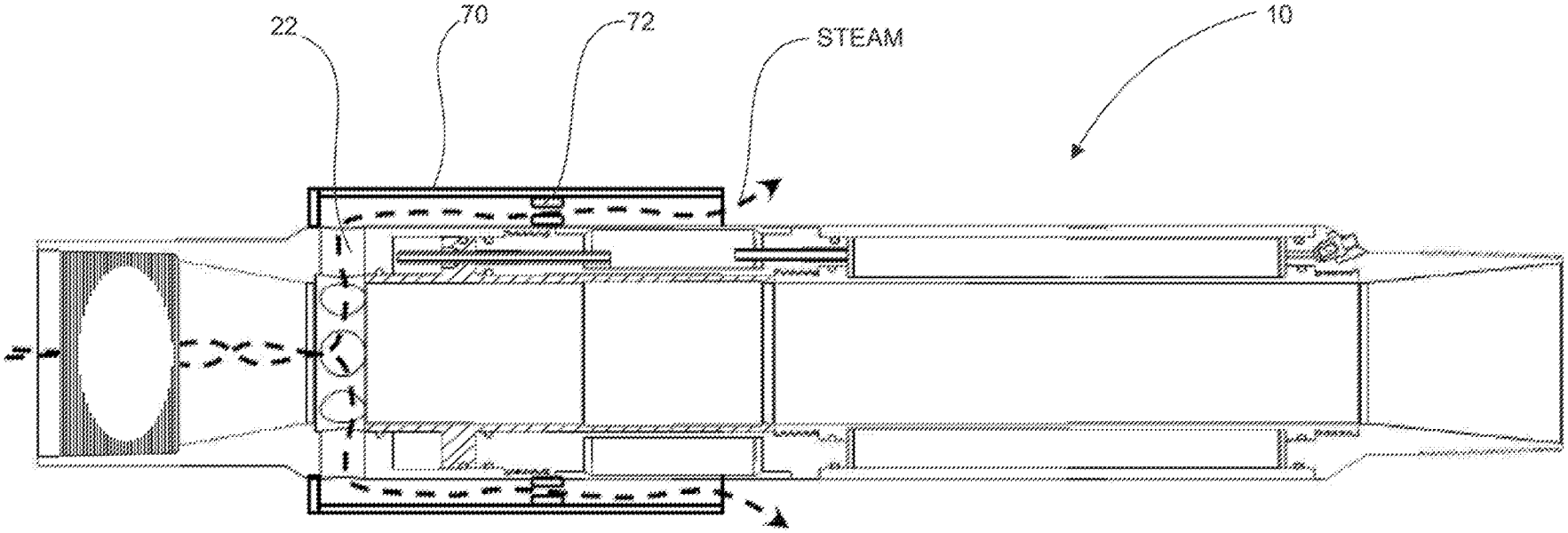
FIG. 27 illustrates a remote operated sleeve valve equipped with a shield for effective discharging steam, such as in SAGD implementations.
Figure 28:
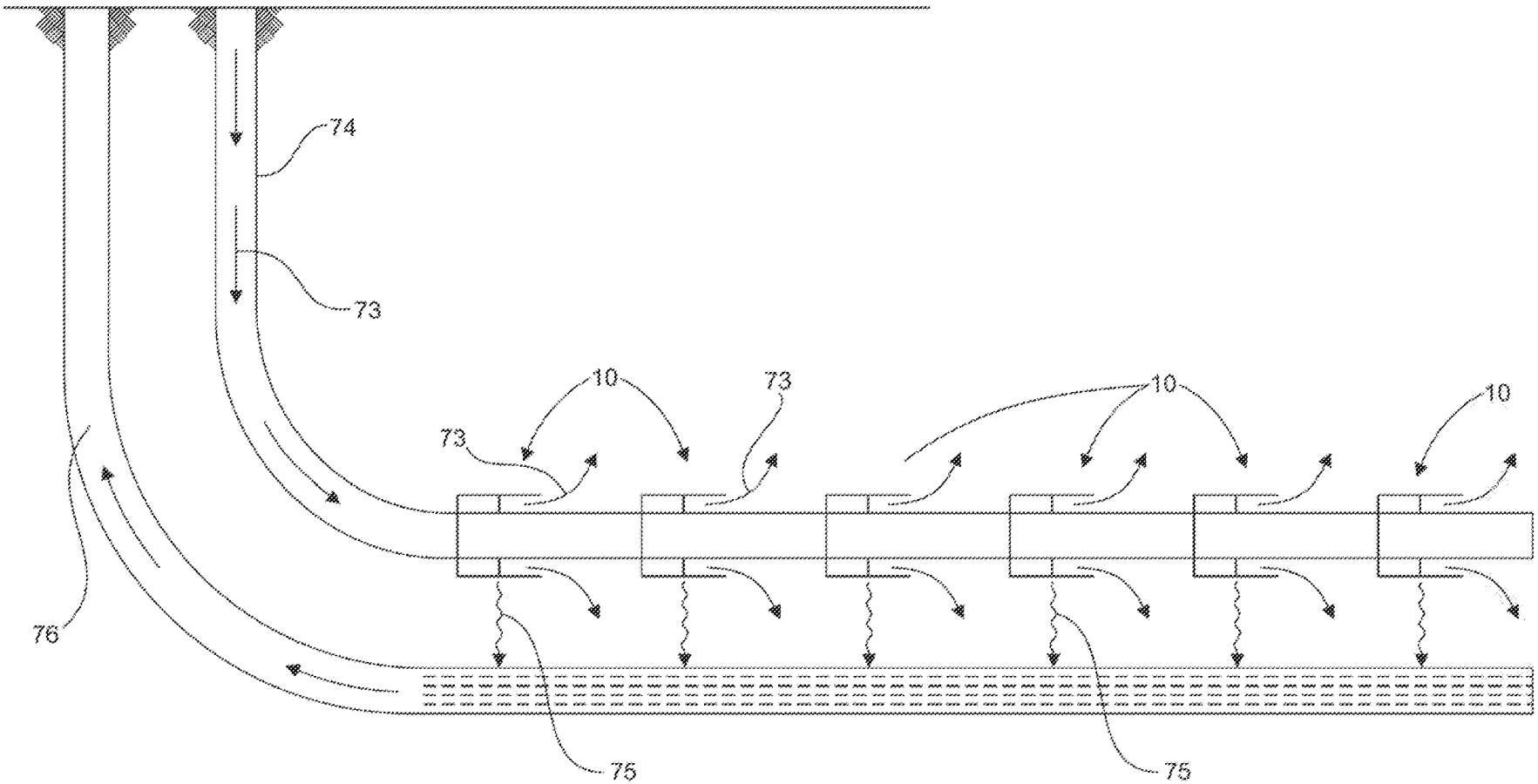
FIG. 28 illustrates a plurality of the remote operated sleeve valves of FIG. 27 in a SAGD scenario.

With reference to FIGS. 27 and 28, the RO Sleeves 10 are equally applicable in SAGD operations. RO Sleeve equipped individual steam valves enable steam mass flow management and distribution along a steam injection. As shown in FIG. 27, a steam shield 70 is provided about the steam discharge ports 22. The shield 70 can include annular orifices or openings 72 to exclude formation debris and sand, while enable steam 73 to exit. As a result, steam operations, such as those in pairs of steam injection and production wells 74,76 are improved. Injection of steam can be controlled, such as to close of areas for example that are off spec, or suffered breakthrough to the production well, and mobilized oil 75 can be recovered at the production well 76.

We claim:

1. A system for remotely managing the fluid flow in a wellbore, comprising:

one or more remote operated, ported sleeve valves located along a tubular string in the wellbore and actuable for controlled fluid access through the ports thereof, each of the sleeve valves being coded with a unique actuation code for targeted actuation;

a vibration source at surface for generating wireless vibrator signals, each vibrator signal comprising a unique sequence of frequency sweeps to define, collectively, a unique signal code distinguishable in a cross-correlation of the time and/or frequency domain responses, the signal code corresponding to the actuation code for selected one or more sleeve valves of the one or more remote operated sleeve valves; and a signal module at each of the one or more remote operated sleeve valves for receiving the vibrator signals and decoding the actuation code from the signal code in the received vibrator signals; and an actuator for actuating the select sleeve valves having the corresponding unique actuation code to open or close the respective ports.

2. The system of claim 1 wherein the vibration source comprises vibration equipment operatively connected to a wellhead of the wellbore and adapted to transmit the signals via vibrations along the wellbore.

3. The system of claim 1 wherein the vibration source comprises a seismic vibrator.

4. The system of claim 1 wherein the signal module further comprises remote operated sleeve valve circuitry for decoding the actuation code from the signal code in the received vibrator signal and comparing the signal code to the unique actuation code for the selected sleeve valves.

5. The system of claim 4 wherein the remote operated sleeve valve circuitry cross-correlates a time domain response and/or a frequency domain response between a pre-defined vibrator signal stored in the circuitry of the sleeve and the received signals at the sleeve valves.

6. The system of claim 4 wherein the vibrator signal transmits a configured sequence of vibrations for receipt as waveform data at the remote operated sleeve valves;

each remote operated sleeve valve circuitry further comprises a 3-component vibration sensor for detecting the received vibrator signal and generating 3-component data therefrom over time; and the decoding of the signal code comprising cross-correlation of one component of the 3-component data in the received vibrator signal and the configured vibration sequence of the vibrator signal.

7. The system of claim 6 wherein the signal module further comprises downhole sensors for one or more of 3-component vibration sensors, pressure sensors, temperature sensors, or flow sensors.

8. The system of claim 6 wherein the configured sequence of vibrations of the vibrator signal has a unique pattern.

9. The system of claim 8 wherein the unique patterns are repeated multiple times.

10. The system of claim 1 wherein the tubular string extends downhole from a wellhead at surface, the seismic vibrator being offset from the wellhead.

11. The system of claim 10 wherein the seismic vibrator is adjacent the wellbore.

12. The system of claim 10 wherein the seismic vibrator is adjacent at least a toe of the wellbore.

13. The system of claim 10 wherein the seismic source is adjacent the one or more sleeve valves in the wellbore.

14. A method for fluid management of a wellbore completed with a plurality of remote operated sleeve valves located along a completion string, whereupon receipt of an acoustic signal from surface, each sleeve valve being remotely actuable, between an open position and a closed position to control fluid communication therethrough, the method comprising:

positioning a vibration source at surface for generating vibrator signals transmitted to the plurality of sleeve valves, the vibrator signals including a configured sequence of frequency sweeps including a unique signal code corresponding to a unique actuation code for selected sleeve valves of the plurality of sleeve valves;

receiving the vibrator signals at the selected sleeve valves;

decoding the actuation code from the unique signal code; and actuating the selected sleeve valves having the corresponding actuation code so as to control fluid communication therethrough.

15. The method of claim 14 further comprising detecting vibration variance at the one or more sleeve valves to infer fluid flow thereat.

16. The method of claim 14 further comprising first placing the completion string in the wellbore.

17. The method of claim 14 wherein receiving the signals further comprises comparing pre-defined waveforms of the vibrator signal and the waveforms of the received signals at the select sleeve valves.

18. The method of claim 17 wherein receiving the signals further comprises detecting 3-component waveform data at the select sleeve valves, wherein decoding the actuation code from the signal code further comprises cross-correlating one component of the detected 3-component waveform data in the received signal with the pre-defined waveform of the vibrator signal.

19. The method of claim 17 further comprising generating vibrator signals at a wellhead of the wellbore.

20. The method of claim 17 comprising generating vibrator signals offset from the wellhead.

21. The method of claim 17 wherein the vibrator source is a seismic vibrator at surface and the vibration signals are generated offset from a wellhead of the wellbore.

22. The method of claim 21 wherein the vibration signals are generated adjacent a toe of the wellbore.

23. The method of claim 21 wherein the vibration signals are generated adjacent the sleeve valves in the wellbore.

24. The method of claim 14 wherein decoding the digital code further comprises cross-correlating a time domain response and/or a frequency domain response of the vibrator signal and received signals at the sleeve valves.

25. The method of claim 24 wherein receiving the vibrator signal comprises a unique sequence of individual and variable frequency sweeps to define the unique signal code.

26. The method of claim 25 wherein the unique sequence of the vibrator signal has a unique pattern.

27. The method of claim 26 further comprising repeating the unique patterns multiple times.

28. The method of claim 14 further comprising confirming actuation of the one or more selected sleeve valves by detecting at surface one or more shock waves corresponding to the actuation of the selected sleeve valves.

29. The method of claim 28 further comprising determining the time response of the one or more shock waves for confirming the position of the one or more selected sleeve valves that were actuated.

30. The method of claim 14 further comprising generating the unique signal code at a baud rate of less than about 10 bits/sec.

31. The method of claim 30 wherein the unique signal code is generated at a baud rate of about 1 bit/sec.

32. The method of claim 14 wherein the wellbore is subject to background noise, and further comprising generating the vibration signal at an amplitude that exceeds a threshold during a pre-defined time window wherein the received signal has an amplitude greater than that of background noise.

33. The method of claim 32 wherein the amplitude of the received signal is more than two times that of background noise.

* * * * *